United States Patent [19]

Nagata et al.

[11] Patent Number: 4,636,184

[45] Date of Patent: Jan. 13, 1987

[54] ARBOR GUIDING APPARATUS

[75] Inventors: Tomizou Nagata; Norikuni Miyaoka, both of Tokyo, Japan

[73] Assignee: Japan Tobacco Inc., Tokyo, Japan

[21] Appl. No.: 648,732

[22] Filed: Sep. 10, 1984

[30] Foreign Application Priority Data

Sep. 13, 1983 [JP] Japan ..... 58-167587

[51] Int. Cl.[4] ..... B31B 1/32

[52] U.S. Cl. ..... 493/98; 493/164; 493/173; 493/910; 53/575

[58] Field of Search ..... 493/93, 111, 164, 166, 493/169, 173, 217, 250, 252, 910, 98; 53/575, 234, 236, 148

[56] References Cited

U.S. PATENT DOCUMENTS

| | | | |
|---|---|---|---|
| 1,868,048 | 7/1932 | Day et al. | 53/575 |
| 2,931,276 | 4/1960 | Zerlin | 493/164 |
| 3,464,326 | 7/1964 | Egleston | 493/164 |
| 3,479,787 | 11/1969 | Bardenhagen et al. | 53/575 |
| 3,574,294 | 4/1971 | Egli | 493/164 |
| 3,978,639 | 7/1976 | Ferozzi | 493/164 |
| 4,150,520 | 4/1979 | Palmieri et al. | 53/225 |

*Primary Examiner*—Francis S. Husar
*Assistant Examiner*—William E. Terrell
*Attorney, Agent, or Firm*—Shlesinger, Arkwright, Garvey & Fado

[57] ABSTRACT

An arbor guiding apparatus is disclosed. It has a plurality of arbors arranged at least in two rows of arbors and in tandem on a rotary packing drum with respect to its axial direction. It also has a guiding device of the arbors in the radial direction. The guiding device includes supporting members axially supporting the arbors as well as connecting rods. One of the connecting rods include a threeway shaft at its one end, one way of the shaft being for engagement with a cam follower for guiding the arbor in the first arbor row while another way of the shaft being for engagement with a cam follower for guiding the arbor in the second arbor row. It further includes a device for effecting a relative movement of the arbors in the first and second arbor rows. The relative movement device essentially includes a pinion interposed therebetween.

10 Claims, 80 Drawing Figures

FIG. 1ℓ

ARBOR GUIDING APPARATUS

BACKGROUND OF THE INVENTION

This invention relates to an arbor guiding apparatus and more particularly to an arbor guiding apparatus which is to be employed in a packing machine, especially for cigarettes, wherein an arbor formed of a hollow metal tube in the shape of a square sleeve is used as a part of the machine for forming a double bag container made of an aluminum foil and a package paper by winding such sheet materials around said arbor and folding the same into a rectangular hexahedron shape. In order to form such an aluminum foil and package paper container, arbors are arranged in a plurality of rows so that a single continuous process for forming containers can be achieved.

Hereby, it should be noted that the packing form which the present invention intends is not limited to cigarette packing and therefore, the apparatus according to the present invention is not limited to packing cigarettes. Likewise, a first packing sheet material and a second packing sheet material which will be described later are not limited to an aluminum foil and a package paper. Instead, it should be understood that other materials can be selected depending on the circumstances. However, in view of the fact that this type of packing form is mostly used for packing cigarettes and developement of improved apparatus therefor is desired, the present invention will be described hereunder in the context of cigarette packing.

The afore-mentioned configuration of the package of cigarettes, i.e., a rectangular hexahedron shape, which is made of sheet materials is well known and called a "soft pack". In an automatic packing machine for making the soft pack package, a bag shaped packing container with its one end opened is formed or prepared beforehand at one position of the packing machine and a group of a predetermined number of cigarettes, for example, a group of cigarettes consisting of 7 pcs., 6 pcs. and 7 pcs. in three layers, are fored at an other position thereof, and the latter is inserted into the former. In this way, the packing means for forming a bag shaped packing container with its one end opened beforehand with the help of a packing container forming apparatus and thereafter inserting a group of cigarettes therein is advantageous when applied to the packing of such goods as cigarettes which are very easily damaged, by using soft sheet materials. Therefore, many attempts have been made to develop this type of packing machine in recent years. In this type of machine, the folding and sealing functions for said opening end portion are effected in succeeding steps in order to complete the packed goods.

Heretofore, a forming apparatus for a packing container has been generally called an arbor turret, wherein arbors formed of a hollow metal tube in the shape of a square sleeve are equally spacedly on the circumference of a packing drum constituting a part of a packing machine in the rotary disc form, and the arbor turret is intermittently rotated around the rotary shaft of the drum. In the vicinity of the path for the arbors, there are provided a sheet of aluminum foil feeder and a sheet of package paper feeder and a number of container forming mechanisms, such as folding claws, etc. for forming a bag, all of which are designed to undertake such functions as the feeding of aluminum foil sheet, winding and folding the same around the arbors, folding of the one end portion thereof, or feeding of a sheet of package paper, winding and folding the same, folding of one end portion thereof, sealing, etc. All of these works or functions are effected, while the arbor turret is temporarily stopped in the process of its intermittent rotation. On the other hand, the above-mentioned aluminum foil and package paper feeders, etc. are also assigned with such works or functions as winding and folding the sheet materials with respect to the arbors, while the arbor turret is being rotated. Also, a group of predetermined number of cigarettes prepared at another position or step are inserted through said opened end portion of the bag shaped container by way of said opening of the sleeve of the arbor, and simultaneously, a pusher is activated to push said bag from the arbor, while the arbor turret is temporarily stopped in the process of its intermittent rotation. In this way, a packing container is formed by the function of said container forming mechanism synchronous to the intermittent rotation of the arbor turret.

In this packing container forming apparatus or in a packing machine including said apparatus, the apparatus or packing machine is required to be rotated intermittently in order to effect a certain kind of works or functions, as mentioned above, which results in limitation of the productivity of said machine. Of course, there are many other causes which are considered to limit the productivity of this type of packing machine. For example, the transfer speed between one step and another, and the speed acceleration are allowed only to a limited extent, since such goods as cigarettes are readily damaged. However, if certain functions, which are required to be effected while the arbor turret is stopped as mentioned above, could be successfully eliminated or improved, and a continuous rotation could be achieved instead of an intermittent rotation, productivity of the machine would be significantly increased.

To this end, there is disclosed in Japanese Patent Publication (Kokoku Publication after examination) Nos. 46-26840, 47-40399 and 48-33400 an improved packing machine, wherein a packing drum is caused to be rotated in a consecutive manner, and arbors formed of a square-sleeve-shaped hollow metal and mounted on a packing drum are wound around with a sheet of aluminum foil and package paper in order to obtain the above-mentioned double bag with one end portion thereof closed. According to this prior art, however, during a full rotation of the packing drum, the aluminum foil sheet is fed to the surface of the arbors, the folding function is effected and in addition, a sheet of package paper is fed thereupon and another folding function is effected in order to obtain a double bag with its one end closed. Furthermore, in the above art, sheet supporting members for feeding said packing sheet materials as well as forming devices thereof are provided in a position outside of the arbors. Furthermore, since a number of processes are required in bag forming mechanisms such as the folding of the packing sheet materials for forming a double bag, etc., a long distance is required for said bag forming processes. Because of the foregoing, the packing drum is required to be made large in its diameter, and the drum is obliged to be arranged in such a manner as to be rotated on the horizontal plane.

SUMMARY OF THE INVENTION

The fundamental problem of the present invention is to continuously rotate the packing drum, to shorten the diameter of the drum in order to facilitate the high speed rotation thereof, to reduce the size of the container forming apparatus by arranging the rotary shaft of the drum horizontally, eventually to reduce the size of the packing machine and finally to provide the above mentioned apparatus enabling the achievement of greatly increased productivity and desirable performability.

Therefore, one of the objects of the present invention is to provide the afore-mentioned apparatus, wherein said arbors are arranged on the packing drum in tandem in the direction of the rotary shaft thereof and in rows consisting of a first row of circumferentially spaced arbors for forming an aluminum bag and a second row of circumferentially spaced arbors, axially spaced from the first row, for forming a package paper bag thereupon and means is provided in order to shift the first row to the second row in a consecutive manner, so that the arbors can form the double bag during one working cycle which is substantially equal to two continuous rotations of the packing drum.

Another object of the present invention is to provide an arbor guiding apparatus, wherein the arbors, which are movably arranged in the radial direction for forming a bag, can effect a relative movement with respect to each other between the first row of arbors and the second row of arbors, while the bag is being formed.

In order to achieve the above objects and others, there is essentially provided an arbor guiding apparatus in an arbor apparatus for forming a packing container formed of a double bag of an aluminum foil and a package paper of the type including a first arbor row for forming an aluminum bag and a second arbor row for forming a package paper bag thereupon, an arbor guiding apparatus comprising a plurality of arbors arranged in at least two rows of circumferentially spaced arbors and in tandem on a rotary packing drum with respect to the axial direction, means for guiding a pair of said arbors as one set in the radial direction of the drum, and means for effecting a relative movement of said pair of arbors while the drum is rotated.

BRIEF DESCRIPTION OF THE DRAWINGS

FIGS. 1*a–l* is a schematic view showing the steps of formation of a double bag;

DETAILED DESCRIPTION OF THE EMBODIMENTS

Preferred embodiments of the present invention will be described next, with reference to the accompanying drawings.

Firstly, the shaping of a packing container according to the invention is shown in FIG. 1 in its typical forms.

Figure 1A:
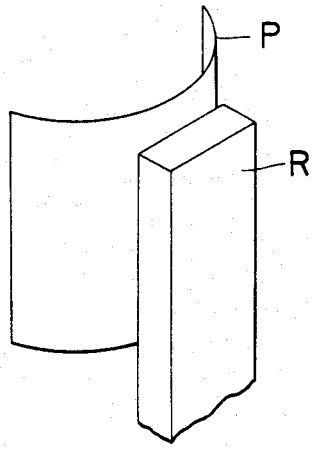
Figure 1B:
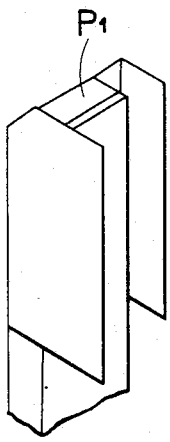
Figure 1C:
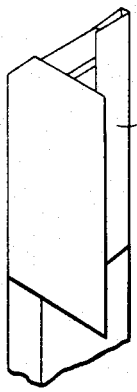
Figure 1D:
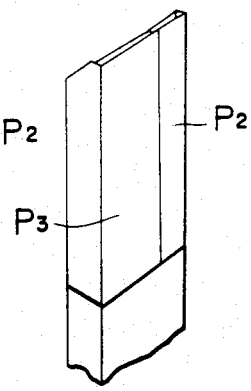
Figure 1E:
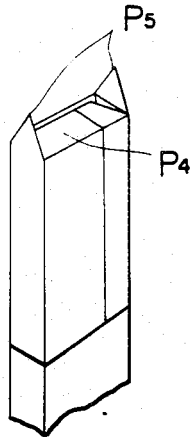
Figure 1F:
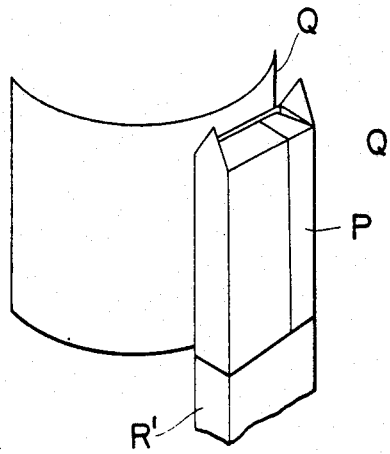
Figure 1G:
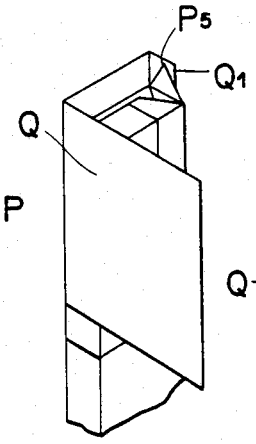
Figure 1H:
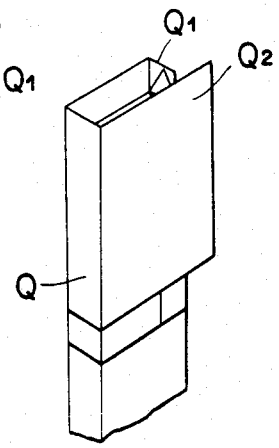
Figure 1I:
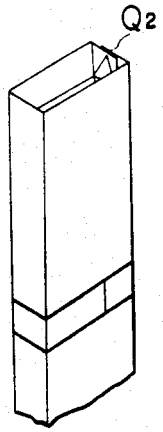
Figure 1J:
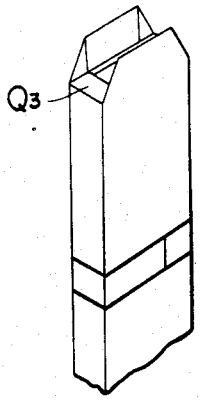
Figure 1K:
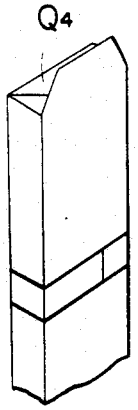
Figure 1K:
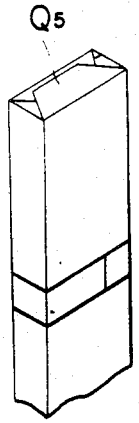

Referring to an aluminum foil P in the first step, an arbor R moves adjacent a supporting member for supporting the aluminum foil P which is cut into a predetermined dimension beforehand (FIG. 1*a*), the aluminum foil P is wound around the body of the arbor R and a bottom inner flap $P_1$ is folded (FIG. 1*b*). After a body inner flap $P_2$ is folded (FIG. 1*c*), a body outer flap $P_3$ is folded (FIG. 1*d*). Finally, a bottom outer flap $P_4$ is folded, thereby leaving a pair of triangular ears opposite with respect to each other on the bottom portion (FIG. 1*e*). In this state, as a second step, an arbor R' moves adjacent a supporting member for supporting a package paper Q (FIG. 1*f*), and while maintaining a body inner flap $Q_1$ in the folded state, the package paper Q is wound around the arbor R' (FIG. 1*g*). After the folding of the body is effected (FIG. 1*h*), a body outer flap $Q_2$ is folded (FIG. 1*i*). Furthermore, as a third step, a pair of bottom ears $Q_3$ of the package paper are folded (FIG. 1*j*). After a bottom inner flap $Q_4$ is folded (FIG. 1*k*), a bottom outer flap $Q_5$ is folded (FIG. 1*l*). Since an adhesive agent is applied to the body outer flap $Q_2$ and the bottom outer flap $Q_5$ beforehand, these flaps are attached to the body inner flap $Q_1$ and the bottom inner flap $Q_4$, respectively.

Figure 2:
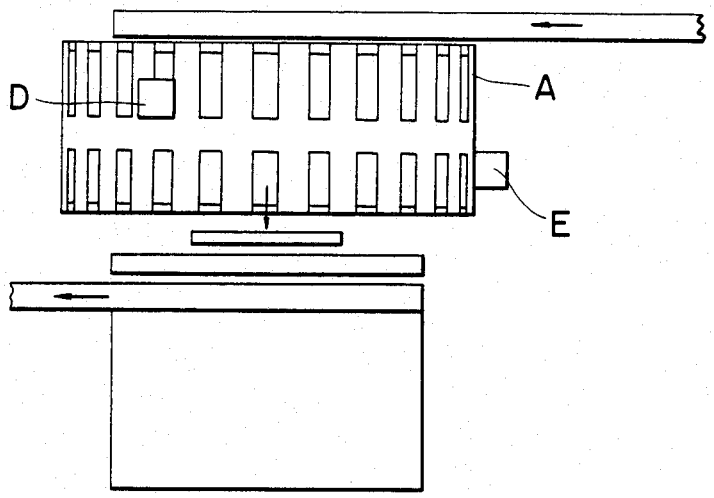
FIG. 2 is a plan view showing the outline of a packing drum.
Figure 3:
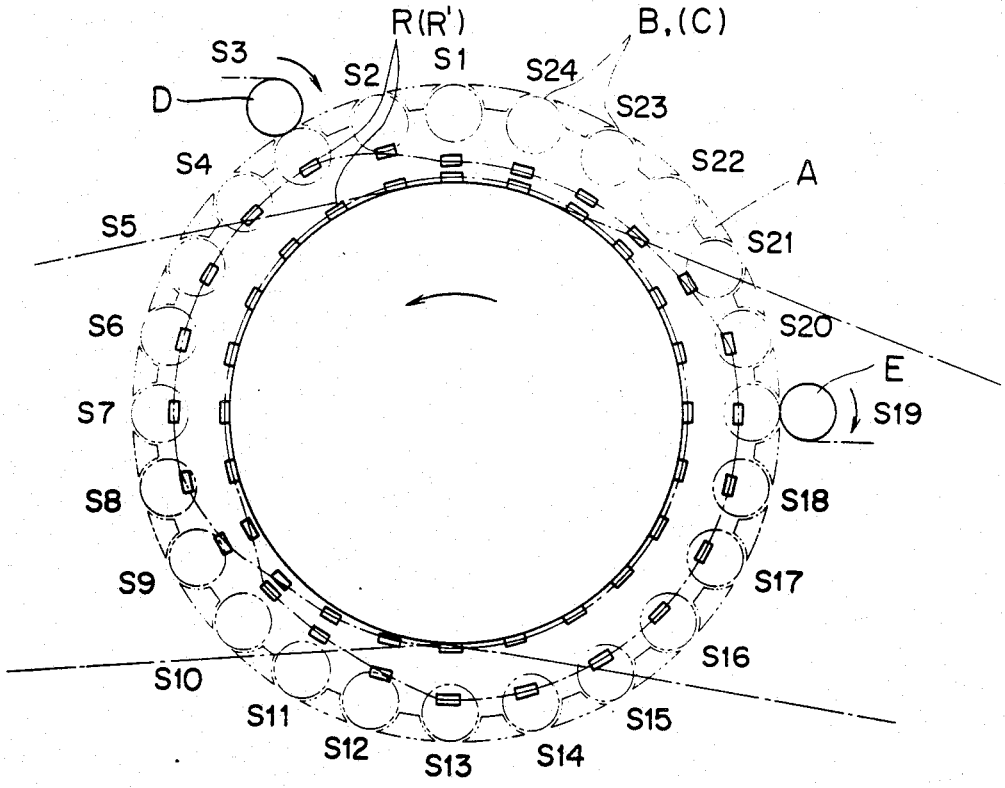
FIG. 3 is a front view of the above.
Figure 4:
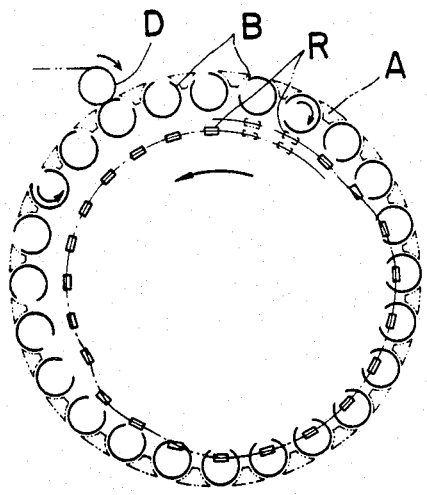
FIG. 4 is a front view showing schematically the movement of arbors with respect to suction rings in the process of receiving and folding aluminum foil to be used for an inner bag.
Figure 5:
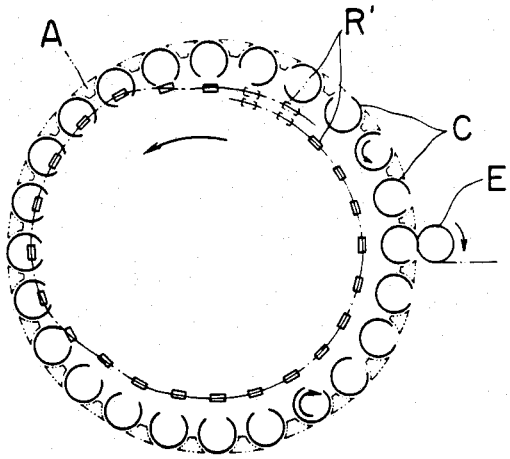
FIG. 5 is likewise a front view showing schematically the movement of arbors with respect to suction rings in the process of receiving and folding package paper to be used for an outer bag.
Figure 6:
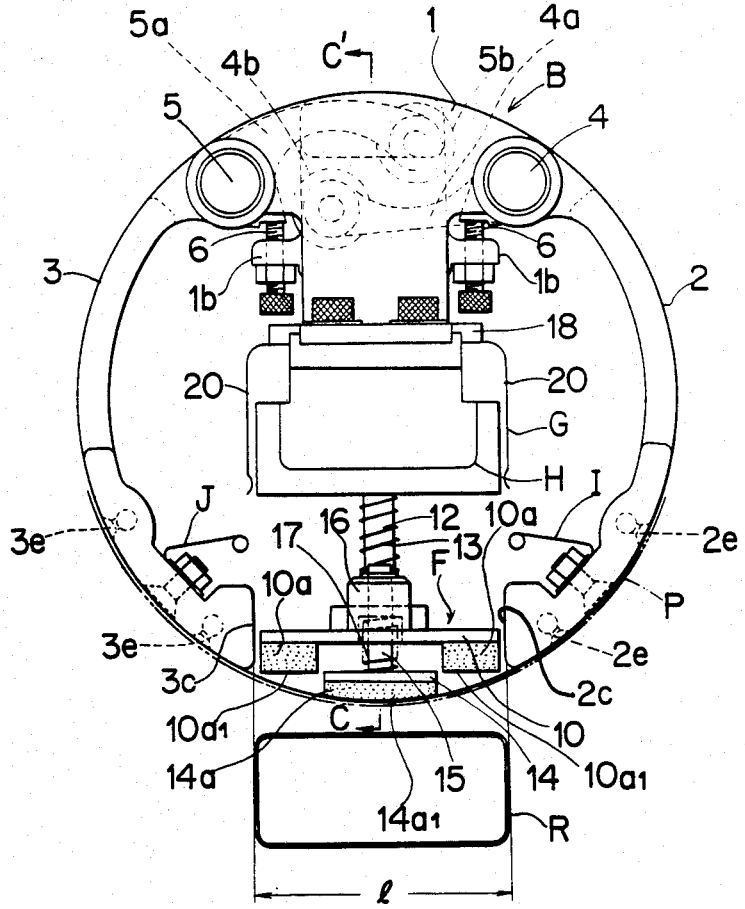
FIG. 6 is a front view showing the aluminum foil suction ring.

Referring to FIGS. 2 and 3, the outline of a packing drum of a preferred embodiment is illustrated. Also, in FIG. 58, a sectional view of said packing drum taken along the rotary shaft thereof is schematically illustrated.

The packing drum A is provided with 24 suction rings B and 24 suction rings C, respectively, along its circumference, and therefore 48 rings in total. Said suction rings B and C are of a cylindrical shape partly cut away, and arranged in two rows of circumferentially spaced rings on the packing drum A. Furthermore, said suction rings B and C are arranged in tandem in the direction of the rotary shaft of the packing drum A, so that each axially spaced tandem pair forms one set of rings for forming a bag of aluminum foil P and package paper Q as will be described later.

The 24 suction rings B are adapted to serve for receiving aluminum foil P and winding the same around the arbor R, while the 24 suction rings C are for receiving package paper Q and winding the same around the arbor R'. Adjacent to the outer periphery of the packing drum A, there are provided an aluminum foil feed drum D in the row of the suction rings B and a package paper feed drum E in the row of the suction rings C. The aluminum feed drum D as well as the package paper feed drum E are normally rotated and according to the rotation of the packing drum A, the aluminum foil feed drum D is caused to feed the aluminum foil P of a predetermined dimension to a corresponding suction ring B one after another, while the package paper feed drum E is caused to feed the package paper Q of a predetermined dimension to a corresponding suction ring C one after another. The aluminum suction ring B and the package paper suction ring C are arranged opposite to the arbors R and R', respectively. The arbors R and R' are arranged to be movable independently in the radial direction of the packing drum A and movable in the relative motion in the axial direction to effect a shifting of their positions, or arbor change. After the bag forming work of the aluminum foil P is completed, the arbor R is caused to move with respect to the arbor R' positioned in the other row in the axial direction, and said arbor R is subjected to the bag forming function using the package paper Q upon the aluminum bag in the other arbor row in the axial direction.

In FIGS. 2 and 3, just for convenient purposes, the positions of the suction rings B and C as well as the positions of the arbors R and R', which are arranged in tandem on the circumference of the packing drum A are alloted with stage numbers. According to this embodiment, the circumference is divided into 24 stages or sections, and one each of the stage numbers S1, S2, S3 . . . , S24 is assigned to each stage starting from the top in FIG. 3 and proceeding counterclockwise according to the order of the working steps in order to show the respective stages in order of said rotary angle positions. Said stage numbers will be used for describing the present invention from time to time by referring to FIGS. 56, 57, 59, 60, 61 and 62.

Figure 56:
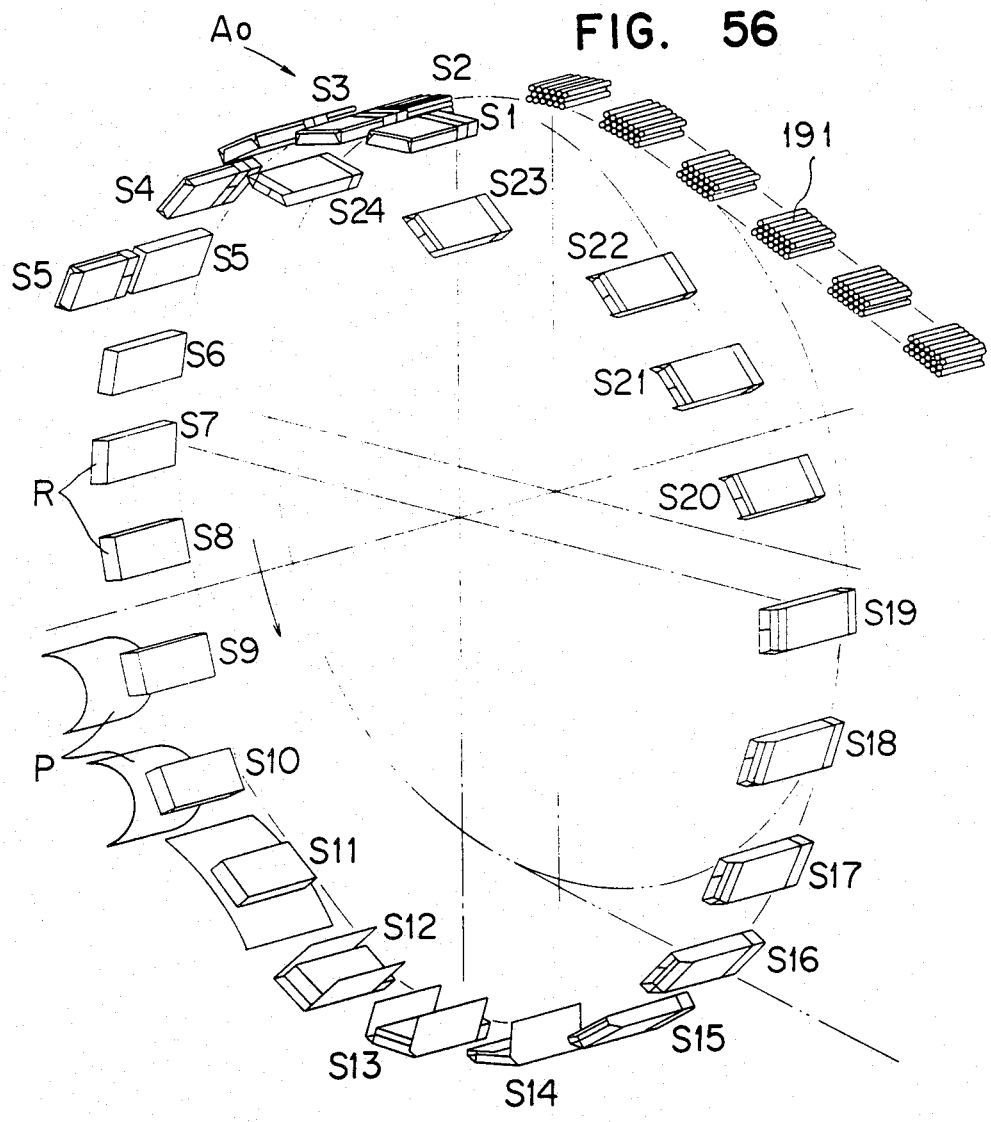
FIGS. 55 to 57 are flow sheets showing the cigarette packing process by dividing it into three portions just for convenient purposes.
Figure 55:
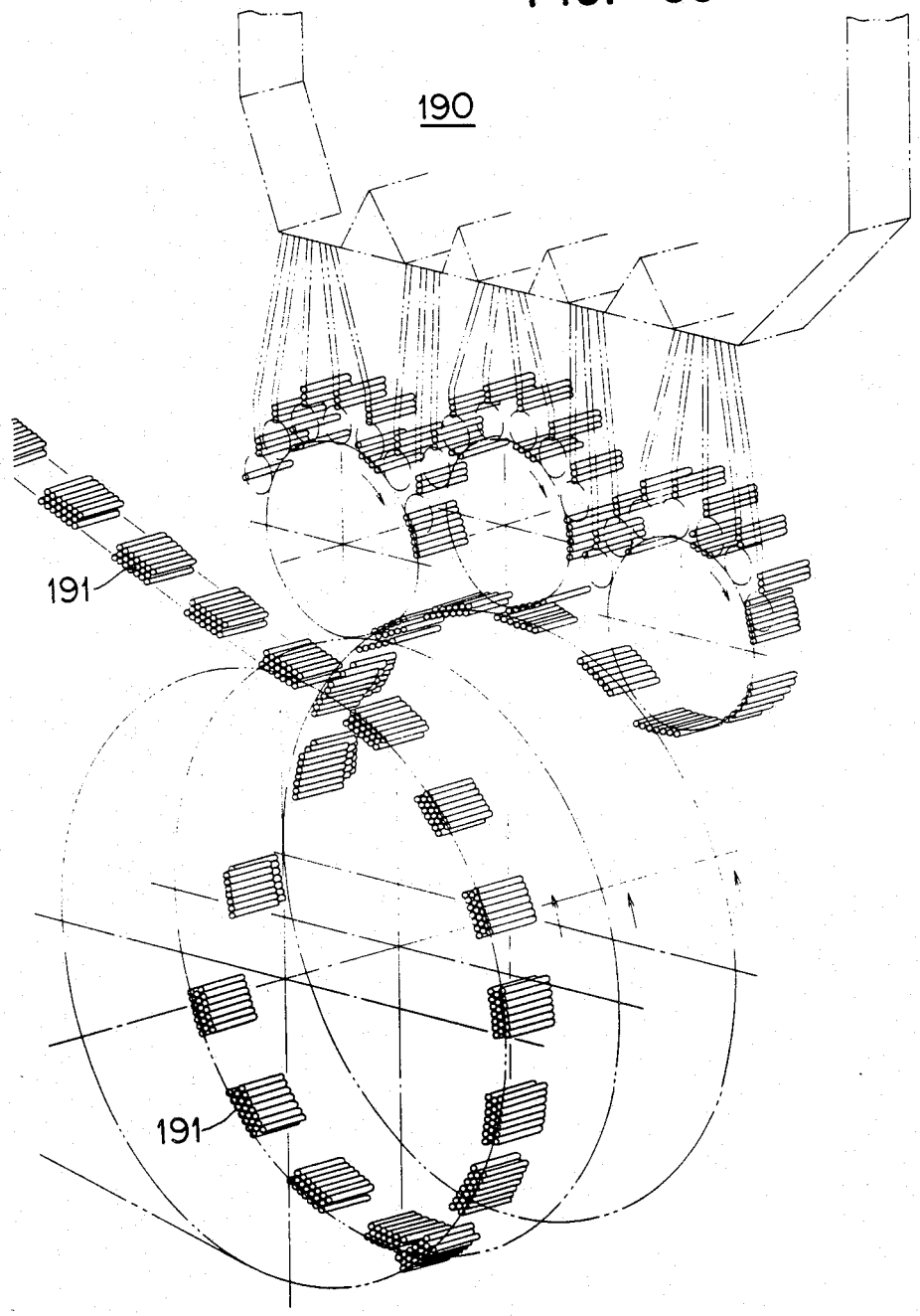
Figure 57:
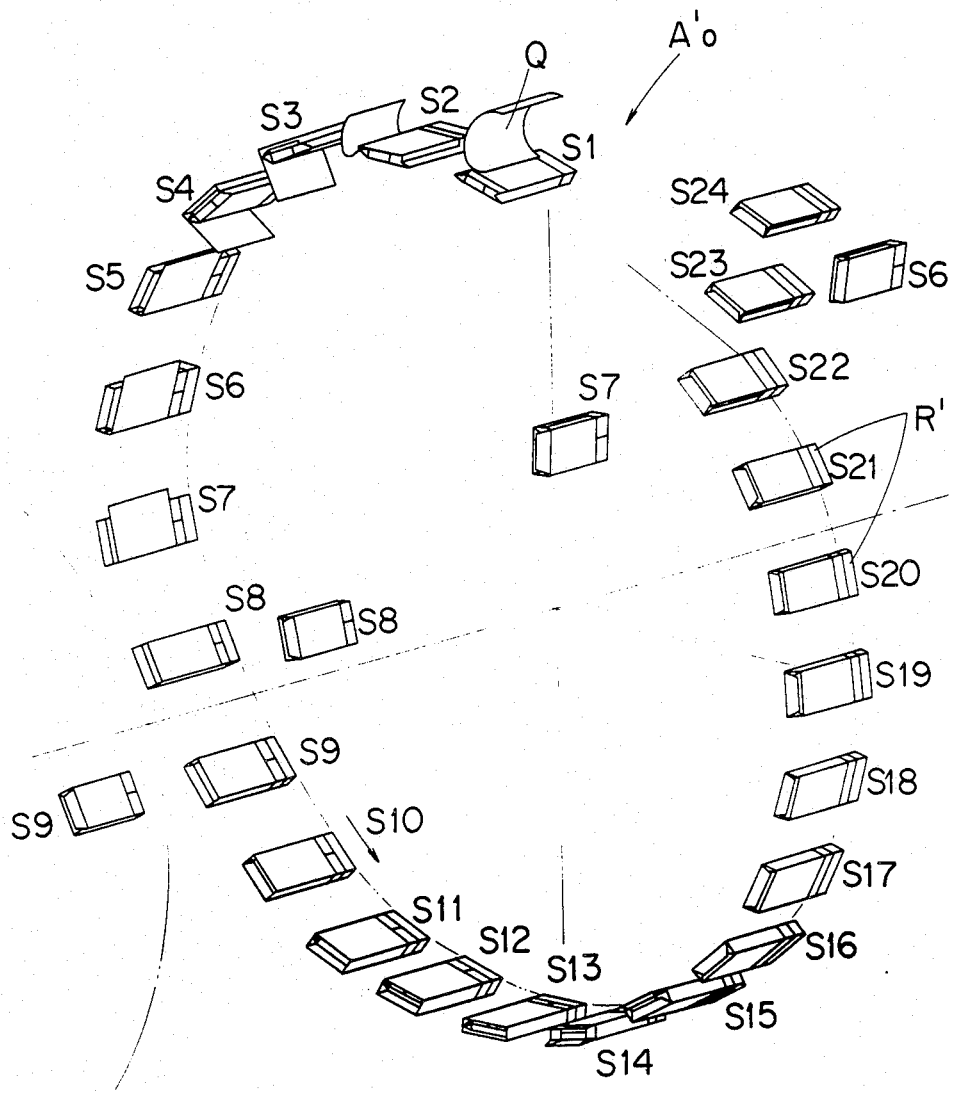

In FIGS. 55, 56 and 57, a schematic view of the processes of a packing machine including the packing container forming processes according to the above-mentioned embodiment are illustrated. Although the packing machine includes other processes such as the folding and sealing of one end portion of the bag already containing cigarettes, etc., they are not shown in the drawing, since they are not directly related to the understanding of the present invention. In the packing container forming processes, in order to obtain an easy understanding, the first row of the arbors for forming an aluminum bag and the second row of the arbors for forming a package paper bag upon said aluminum bag are shown widely spaced apart. The respective arbor positions are shown by using said stage numbers, so that each working step of the forming of a packing container may be readily understood.

A cigarette packing machine includes a process for forming a group of 20 cigarettes out of the cigarettes collected in a hopper through means for taking out groups of cigarettes by the continuous rotation of the drum device. Said respective groups of cigarettes are transferred by a conveyor and inserted into the double bags formed on the outer peripheries of the arbors through working steps in said first and second arbor rows. As shown in the drawing, during the stages from the stage Nos. S22 to S1, when an arbor change or position shifting of the arbors is to take place between the first row and the second row of the arbors, the arbors which already have a formed double bag in the second row are traveled into the first row. From S1 to S12, the afore-mentioned cigarettes are inserted into the double bag through the inner bore of the arbor, and subsequently, the bags containing the cigarettes are pushed out onto the next working step of a bucket drum device (not shown) by means of a pusher (not shown). This step is shown in the drawing by illustrating the goods to be packed.

In the first and second rows of the arbors on the packing drum A, the respective arbors R and R′ are not only provided with container forming mechanisms such as sheet folding claws, etc., but also aluminum suction rings B and package paper suction rings C adapted to feed the sheet materials to the arbors R and R′, and to cooperate to fold thereof.

Nextly, referring to FIGS. 6 to 23, 63, 65 and 66, the aluminum suction ring B and the folding mechanisms which cooperate with the aluminum suction ring B to form an aluminum bag on each of the arbors R will be described with regard to their structures and functions.

The aluminum suction ring B has generally an annular outer peripheral configuration as a whole because of the presence of two suction arms 2 and 3. Said suction arms 2 and 3 are arranged to be pivotable inwardly with respect to a bracket 1 by means of shafts 4 and 5.

Figure 7:
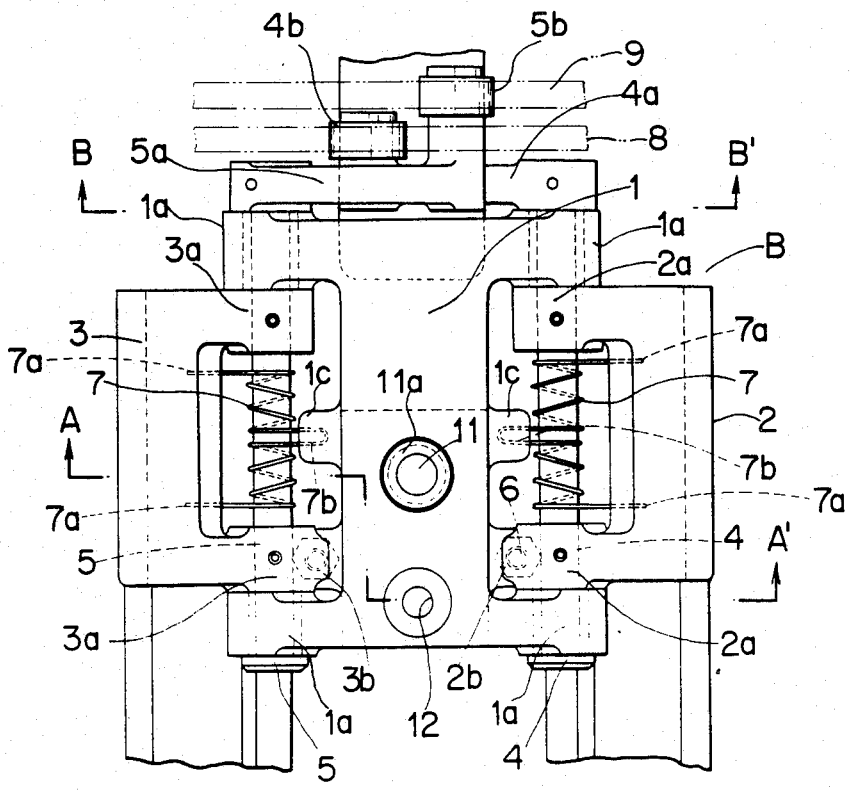
FIG. 7 is a plan view of the above.
Figure 8:
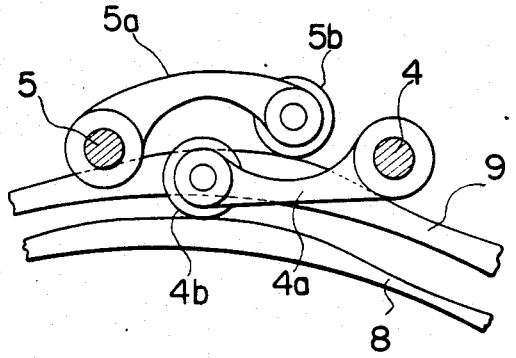
FIG. 8 is a sectional view taken on line B—B′ of FIG. 7.
Figure 9:
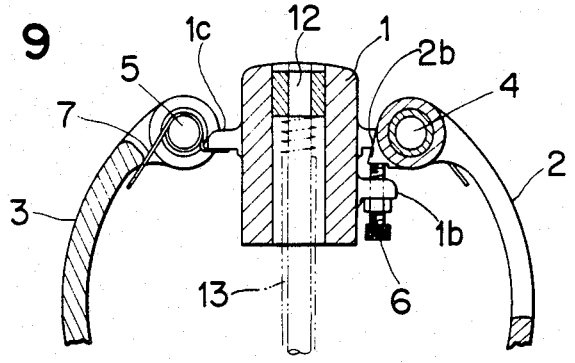
FIG. 9 is likewise a sectional view taken on line A—A′ of FIG. 7.
Figure 10:
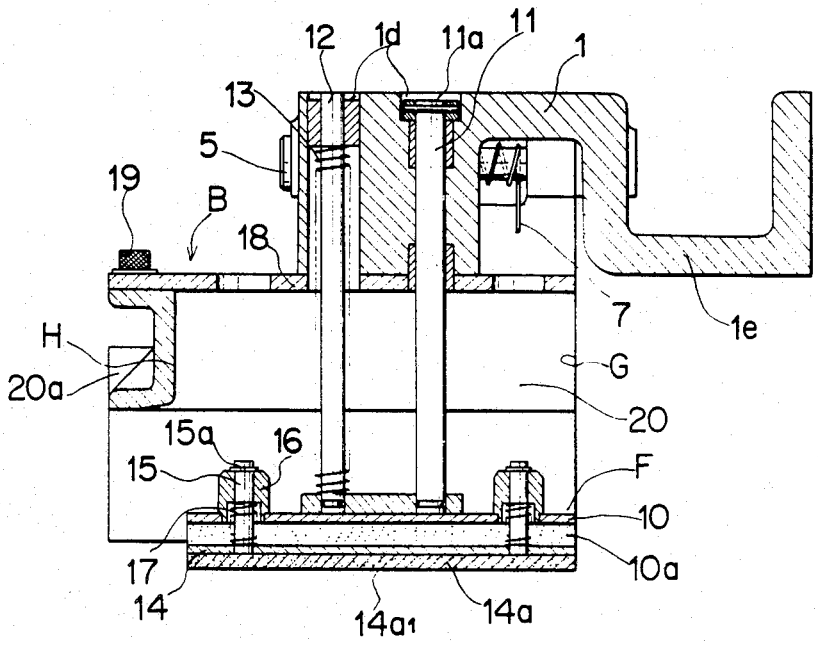
FIG. 10 is a sectional view taken on line C—C′ of FIG. 6.
Figure 13:
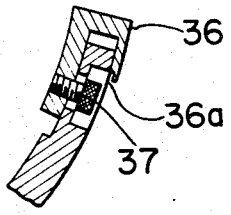
FIG. 13 is an enlarged sectional view of the aluminum foil stopper.
Figure 14:
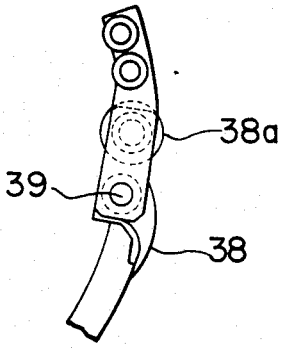
FIG. 14 is an enlarged sectional view of the aluminum foil clamping claw.
Figure 11:
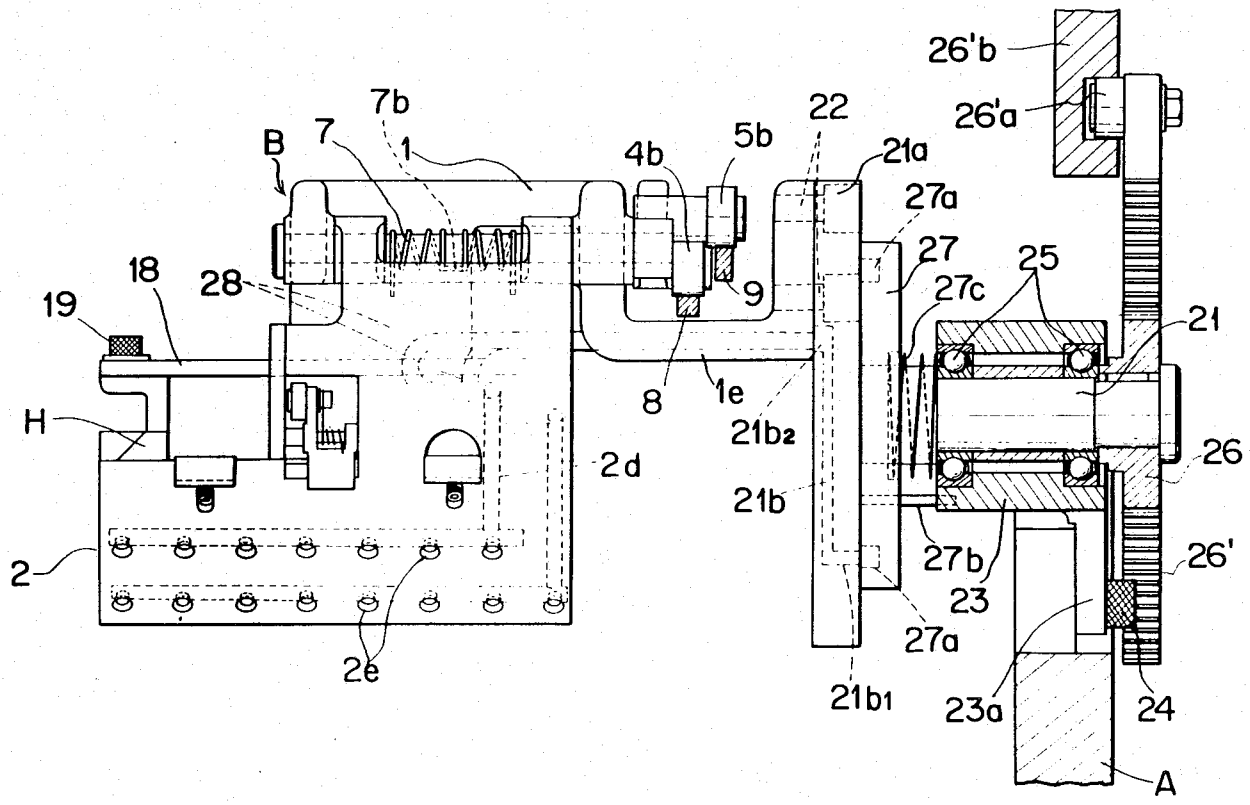
FIG. 11 is a side view of the aluminum foil suction ring.
Figure 12:
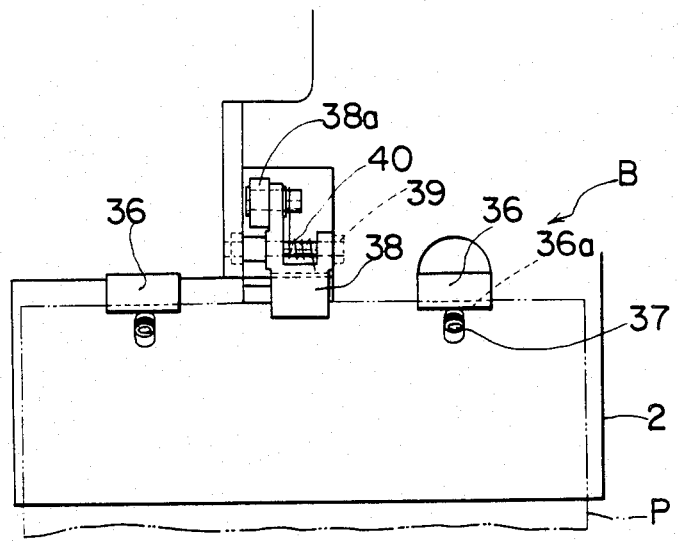
FIG. 12 is an enlarged side view showing the portion of an aluminum foil stopper and clamping claw.
Figure 18:
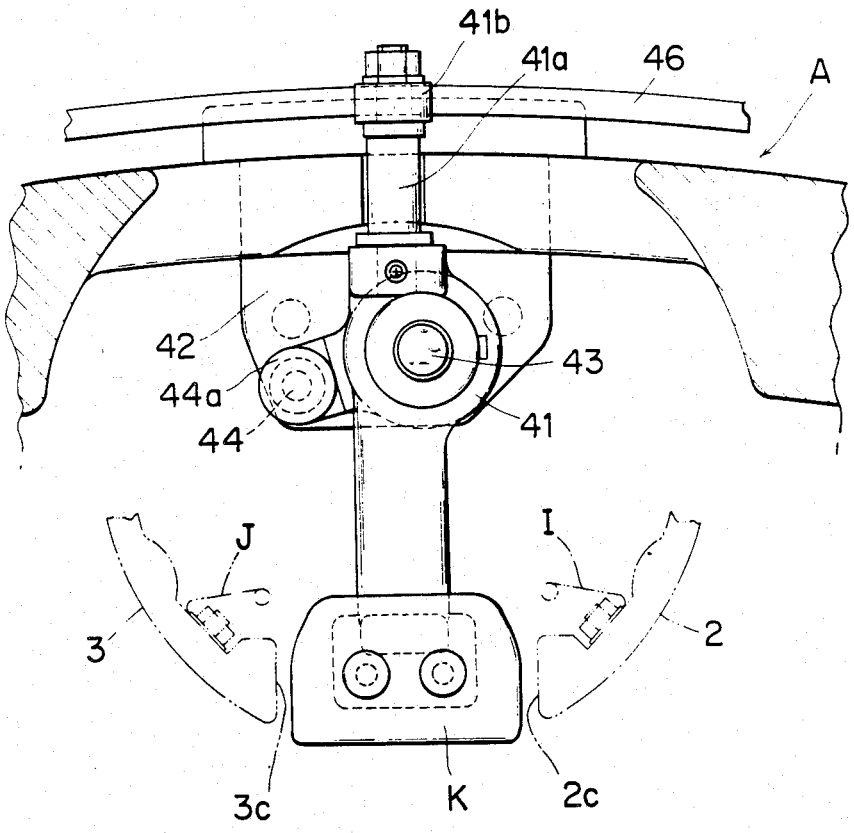
FIG. 18 is a rear view of a bottom outer flap folding claw.
Figure 15:
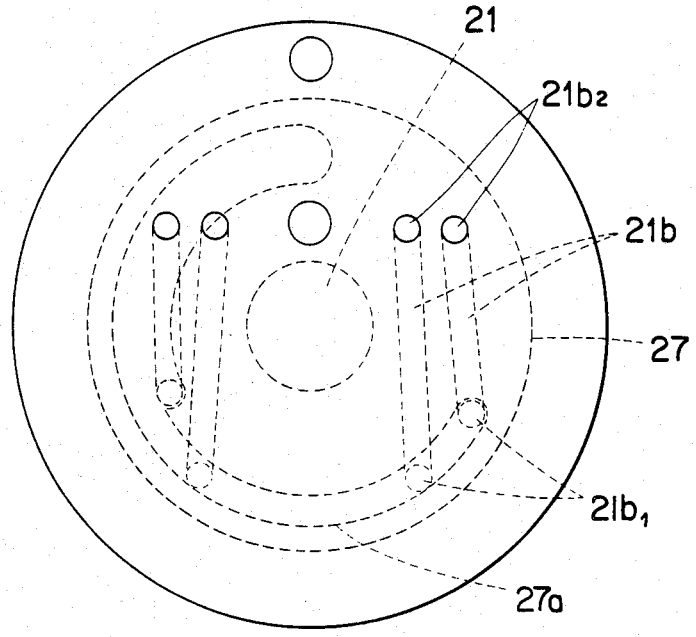
FIG. 15 is a detailed view of a control ring of the aluminum foil.
Figure 16:
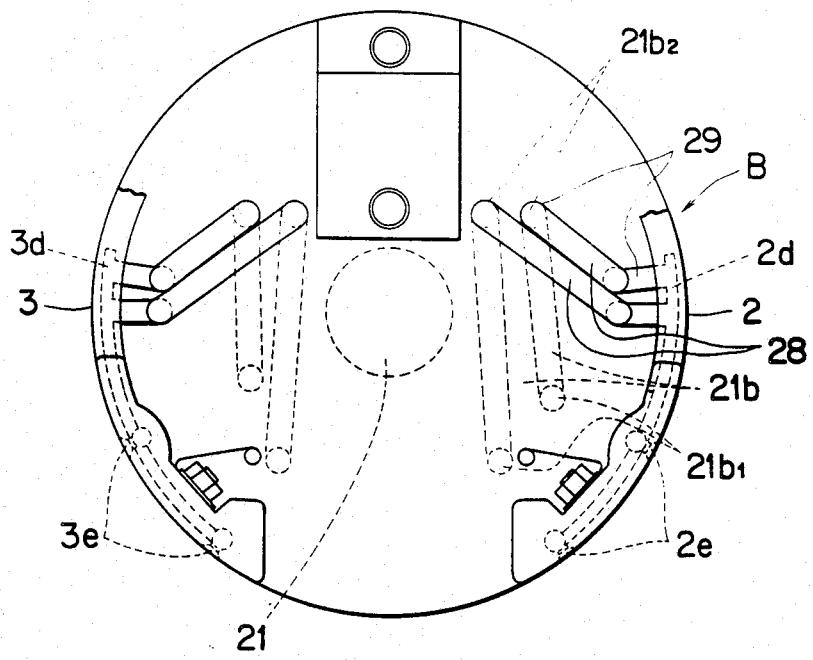
FIG. 16 is a detailed view of an aluminum foil suction transfer mechanism.
Figure 17:
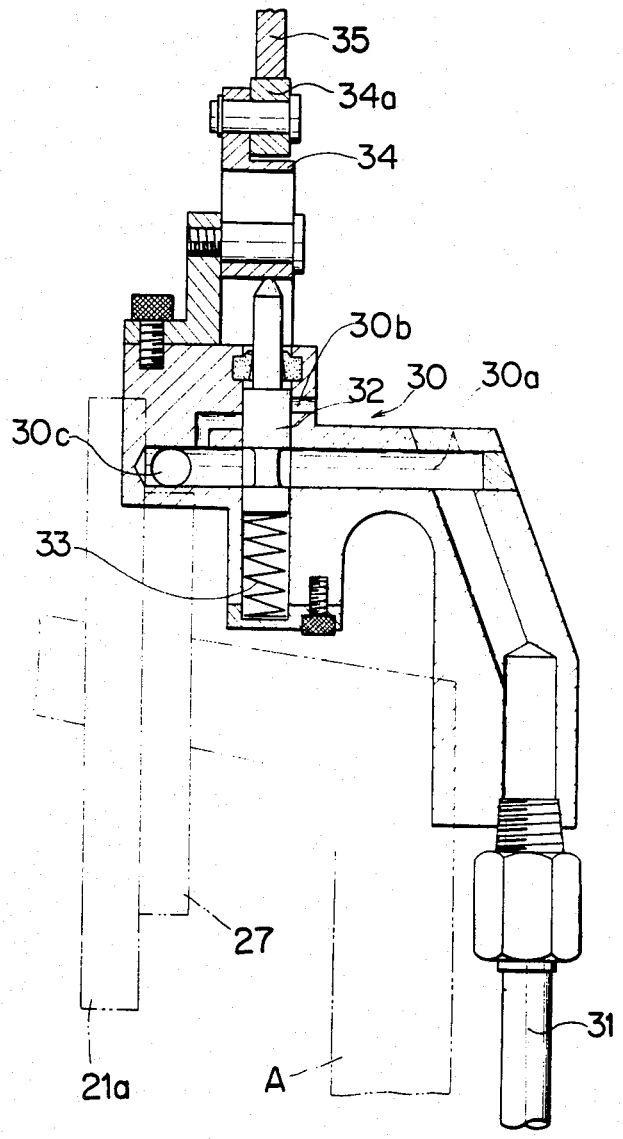
FIG. 17 is a sectional view of a suction cut-off valve portion.
Figure 19:
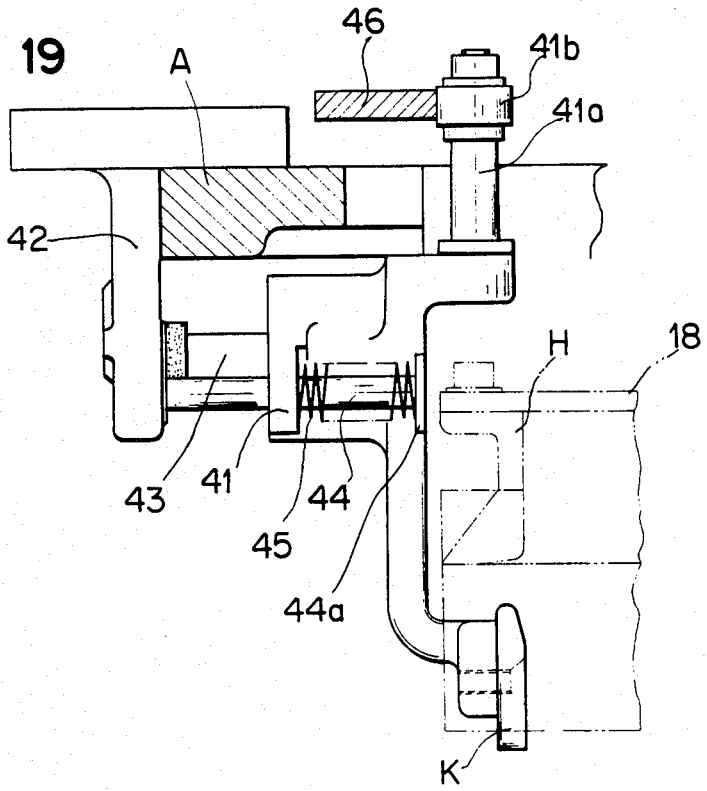
FIG. 19 is a side view of the above.
Figure 22:
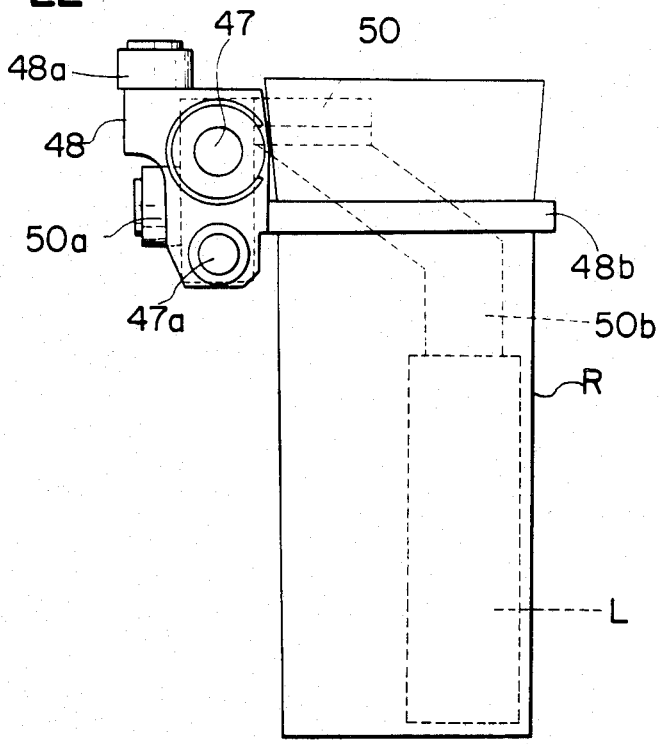
FIG. 22 is a plan view of an arbor supporting mechanism.

The bracket 1 is provided with four shaft supporting members 1*a* extending in both directions across the axis of the bracket 1 at the ends of the bracket 1 as seen in the plan view of FIG. 7. Between each pair of shaft supporting members 1*a*, 1*a* on each side of the bracket 1, a shaft 4 or 5 is disposed.

The suction arms 2 and 3, which have an arcuate outer peripheral surface, are bifurcated at the upper portions thereof and include two pieces of pivotal attachment portions 2*a* and 3*a*. Said suction arms 2 and 3 can be pivoted with respect to the bracket 1 by extending said shafts 4 and 5 into said pivotal attachment portions 2*a* and 3*a*.

The bracket 1 is provided with an adjustable stopper 6 secured to a supporting portion 1*b* at the inner side of one of the shaft supporting portions 1*a*, and at the inner sides of the pivotal attachment portions 2*a* and 3*a* connecting portions 2*b* and 3*b* are provided so that the suction arms 2 and 3 are restricted to pivot outwardly.

Return springs 7 are wound around the shafts 4 and 5, both ends of said springs 7 being retained by the suction arms 2 and 3, and an intermediate drawn out end portion 7*b* is retained by a knob 1*c* of the bracket 1, so that the suction arms 2 and 3 which are formed to pivot inwardly by means of a mechanism as will be described later are returned until the connecting portions 2*b* and 3*b* are engaged with the stoppers 6.

The suction arms 2 and 3 are integrated to the shafts 4 and 5. At one end of the shafts 4 and 5, levers 4*a* and 5*a* are mounted in alternate positions in the axial direction are extend inwardly. Said levers 4*a* and 5*a* are provided with cam followers 4*b* and 5*b* at the tip portions thereof, which are engaged with separate cams 8 and 9 firmly secured to an outside portion of the packing drum A and separately pivot the suction arms 2 and 3 inwardly, when the packing drum A is being rotated.

At the free end portions of the suction arms 2 and 3, guide walls 2*c* and 3*c* are disposed opposite with respect to each other with an open space l therebetween. A bottom clamp F is positioned within the space l. Two slide shafts 11 and 12 are secured to a main plate 10 of the bottom clamp F and reach to through-holes 1*d* of the bracket 1. One of the main guide shafts 11 is provided with a stopper 11*a* at the other end thereof in order to regulate the descending position of the bottom clamp F. The other shaft 12 is adapted to serve solely for preventing rotation and a return spring 13 is wound therearound.

In the bottom clamp F, a movable plate 14 with a comparatively narrow width is movably mounted under the main plate 10 through mounting shafts 15 which are supported by slide guide members 16 mounted on the main plate 10. At the upper ends of the mounting shafts 15, stopper rings 15*a* for engaging with the slide guide members 16 are mounted. A spring 17 is wound around each of the mounting shafts 15 between the slide guide members 16 and the movable plate 14.

A pressure welded member 14*a* made of a rubber material is mounted on the under-surface of the movable plate 14, and on the under-surface of the main plate 10, a pressure welded member 10*a* is likewise mounted at positions outside both ends of the movable plate 14.

The under surface $14a_1$ of the pressure welded member 14*a* is formed in an arcuate shape having the same radius as that of the outer periphery of the suction arm, while the under-surface $10a_1$ of the pressure welded member 10*a* is formed in a plane parallel to the upper surface of the arbor R.

At the upper portion of the bottom clamp F in the bore defined within the suction arms 2 and 3, the bracket 1 is firmly secured to a U-clamp formed of a resilient plate through a mounting plate 18. Said U-clamp G is designed to have a sufficient width and depth for accommodating the bottom clamp F and the arbor R therein.

On the mounting plate 18, a folding claw H for folding the bottom inner flap $P_1$ is fastened in a position proximate to one side of the U-clamp G by a screw 19. The opposite wall portions 20 of the U-clamp G extend to both side portions of said bottm folding claw H in a partly cut out state and serve as a regulating plate 20 for the bottom folding.

The bracket 1 is fastened at its one side to the mounting flange 21*a* of a main shaft 21 by screws 22 through an extended portion 1*e* of the U-shaped section 1*c* which can accommodate said levers 4a and 5a as well as the cam followers 4b and 5b.

A bearing 23 is fastened to the side portion of the packing drum A by a screw 24 through an ear portion 23a thereof. The main shaft 21 is carried at its one side by the bearing 23 through its ball bearings 25. The main shaft 21 is firmly secured with a pinion 26 which is meshed with a rack 26' including a cam follower 26'a engaged with a cam 26'b secured to the outside portion of the packing drum A in order to drive the main shaft 21 to pivot the suction ring B while the packing drum A is being rotated.

A control ring 27 is penetrated by the main shaft 21 therethrough, and prevented from rotation by a pin 27b, and urgedly contacted against a flange 21a by a spring 27c. The control ring 27 is formed with a ventilation groove 27a, to which ends $27b_1$ of through-holes 21b formed on the flange 21a are opened. The other ends $21b_2$ of the through-holes 21b are connected with the ends of nylon tubes 28 through metal connectors 29, and the other ends of the nylon tubes 28 are connected to through-holes 2d and 3d of the suction arms 2 and 3 through the metal connectors 29. The through-holes 2d and 3d are once extended in the circumferential direction and then turned and extended toward the axial direction until they reach to the free end portions of the suction arms 2 and 3, thereby serving to open a plurality of suction mouths 2e and 3e toward the outside in a manner as to form two-rows of through-holes in the axial direction.

The ventilation groove 27a of the control ring 27 communicates with a connecting hole 30c of a valve 30 through a pipe (not shown). The valve 30 is connected with a suction pipe 31. In the valve 30, a valve body 32 normally serves to open a suction path 30a by means of a spring 33, and to close an air inlet port 30b. The valve body 32 is abutted with a mover 34 including a cam follower 34a. When the mover 34 is actuated by a cam 35, the suction path 30a is shut by the valve body 32, and the air inlet port 30b is opened to effect a vacuum break.

In one of the suction arms 2 and 3, a stopper 36 is fastened by a screw 37 in a manner as to define a supporting groove 36a. Said stopper 36 is adapted to effect positioning of the end of the aluminum foil P, when the suction arm 2 receives it from the aluminum foil feed drum D.

A clamping claw 38 for clamping the end of the aluminum foil P is pivotably supported by a shaft 39 between two stoppers 36 and is normally biased in the clamping direction by a spring 40.

The other end of the clamping claw 38 is provided with a cam follower 38a through a shaft 39, and while the suction ring B is being pivoted, the clamping claw 38 is opened by a cam (not shown) fixed to the packing drum A for receiving the end portion of the aluminum foil P fed by the aluminum feed drum A and normally for clamping the aluminum foil P in order to prevent the dropping of the aluminum foil P when the suction is cut. For the same reason, the other suction arm 3 is also provided with a clamping claw. On the inner sides of the free end portions of the suction arms 2 and 3, folding claws I and J formed of a resilient plate are mounted in order to fold the body inner flap $P_2$ and the body outer flap $P_3$.

On one side of the two suction arms 2 and 3, a folding-claw K is movably provided in the axial direction of the suction ring B in a position close to the space l in order to fold the bottom outer flap $P_4$. The folding-claw K is mounted on a slide block 41. Said claw K is movably mounted on the shaft 43 of a bracket 42 fixed to the outer periphery of the packing-drum A, and is normally biased in the departing direction with respect to the suction ring B by a spring 45 provided between the slide block 41 and shaft 44 adapted to prevent the rotation, and is moved forward with respect to the suction ring B by a cam 46 through a cam follower 41b mounted on a pin 41a of the slide block 41.

The arbor R having a square sleeve shape is arranged in such a manner as to be movable in the radial direction with respect to the packing drum A and is held by an arm 48b with respect to a slide block 48 slidably mounted on a shaft 47 which is parallel to said moving direction. The cam follower 48a is engaged with a yoke shaped driving member 49a mounted on a rod 49 which is disposed in the radial direction with respect to the main cam mechanism provided at the central portion of the packing drum A and is caused to move up and down in accordance with the rotation of the packing drum A.

Another slide block 50 is mounted on the shafts 47 and 47a and a seaming clamp L is supported by a supporting plate 50b with respect to said slide block 50. The seaming clamp L is normally biased in the abutting direction against the artbor R by a spring 51.

In the outer peripheral portion of the packing drum A, a shaft 52a is slidably penetrated into both ends of supporting blocks 52 provided on the bearing 23. At one end of the shafts 52a, a fork shaped, associatingly movable rod 53 including a cam follower 53a at its intermediate portion is mounted, and the cam follower 53a is engaged with a cam 54 mounted on the outside portion of the packing drum A. Also, at the other end of one of said shafts 52a, a presser piece 52b is provided for abutting against the cam follower 50a of the slide block 50 in the seaming clamp L in the resisting direction with respect to the spring 51, so that the seaming clamp L is separated apart from the arbor R by the presser pieces 52b actuated by a cam 54 resisting the spring 51 while the packing drum A is being rotated.

With the above construction, when each of the suction rings B approaches the aluminum foil feed drum D in accordance with the rotation of the packing drum A, the pinion 26 is rotated through the rack 26' by means of the cam 26'b. As a result, the open portion between the free end portions of the suction arms 2 and 3 is brought to be in opposite relation with respect to the aluminum foil feed drum D. The aluminum foil P of a predetermined dimension is fed from the aluminum feed drum D and abutted against the supporting groove 36a of the stopper 36, and the positioning of the aluminum foil P is effected. Then, the aluminum foil P is delivered to the suction ring B by means of the rotation of the packing drum A and absorbed by the suction mouths 2e and 3e in an evenly spreaded state with respect to the right and left suction arms 2 and 3. At this moment, the bottom clamp F serves to position the aluminum foil P on the outer periphery of the suction ring B by filling the open portion defined between the suction arms 2 and 3 with the concentric annular configuration.

When the receipt of the aluminum foil P is completed, the suction ring B is rotated at 243° counter-clockwise and brought to be in a position opposite to the arbor R, wherein the open portion thereof is facing toward the central portion of the packing drum A.

Thereafter, the arbor R is moved with respect to the suction ring B by means of the yoke shaped driving member 49*a* and enters into the suction ring B through the open portion defined between the suction arms 2 and 3. At this moment, when the arbor R is moved for 3 mm after contacting the aluminum foil P, the suction for the suction mouths 2*e* and 3*e* is abruptly cut. As a result, the suction arms 2 and 3 are released from supporting the aluminum foil P. Then, the aluminum foil P is sandwiched between and carried by the bottom clamp F and the arbor R, and moved into the suction ring B in that state.

The aluminum foil P is provisionally folded around its body portion by the opposing guide walls 2*c* and 3*c* formed on the free end portions of the suction arms 2 and 3. Then, the arbor R is entered into the U-clamp with its side body rubbing the side wall portions 20 of the U-clamp G. As a result, the formal body folding results. At this moment, the bottom inner flap $P_1$ is also folded by the folding claw H mounted on one side of the U-clamp G, and the bottom folding regulating plate 20*a*, which is mounted on the side wall portions 20 in an extended manner, serves to prevent the triangular ear portions from escaping, so that correct folding can be effected.

Immediately after the above step, the suction arm 2 is pivoted inwardly by the cam 8, and the body inner flap $P_2$ is folded by the rubbing motion of the folding claw I mounted thereon. Then, the suction arm 3 is pivoted inwardly by the cam 9, and the body outer flap $P_3$ is folded by its folding claw J in the same manner.

Thereafter, only the suction arm 2 is returned to its initial position and in the state where the inner and outer body flaps $P_2$ and $P_3$ are pressed by the folding claw J of the suction arm 3, the seaming clamp L is caused by the cam 54 to withdrawn the presser piece 52*b* and approach to the arbor R, and the inner and outer body flaps $P_2$ and $P_3$ are pressed away thereby. Because of the foregoing, the suction arm 3 is returned to its initial position.

Then, a folding claw K for folding the bottom outer flap $P_4$ is moved forward to the folding position by the cam 46. In this state, the arbor R is withdrawn together with the seaming clamp L. At this time, the folding of the bottom outer flap $P_4$ is also effected by the folding claw K, and the guide walls 2*c* and 3*c* serve to prevent the triangular ear portions $P_5$ from escaping.

The arbor R is moved to the next working step together with the seaming clamp L for receiving the package paper Q for the bag making operation. The package paper bag is used as an outer bag of the aforementioned aluminum inner bag. The suction ring B is rotated at 243° clockwise in order to receive the next aluminum foil P, and thereby maintains its attitude ready to receive the aluminum foil P.

Nextly, referring to FIGS. 24 to 37, 64, 67 and 68, the mechanism and function of a package paper suction ring C and it associated devices for forming a package paper bag and folding the double bags on the arbor R' will be described.

The package paper suction ring C includes two suction arms 56 and 57, and is formed substantially in an annular configuration, as a whole. One of the suction arms 56 is pivotably mounted on a shaft 58 so that it is pivotable inwardly, while the other arm 57 is pivotably mounted on a shaft 59 so that it is pivotable outwardly, both with respect to the bracket 55. However, due to the positional relation for receiving the package paper Q, an extended portion 56' of one of the suction arms 56 extending in the axial direction is formed wider in its width compared with an extended portion 57' of the other suction arm 57.

The bracket 55 includes two shaft supporting portions 55*a* at its one end in the axial direction in its plan shape, said supporting portions 55*a* being extended in both directions crossing the axial direction in its plan shape. The other end of the bracket 55 is fixed to a mounting flange 66. Shafts 58 and 59 are provided between the shaft supporting portions 55*a* and the mounting flange 66*a* opposite with respect to each other in the axial direction.

The suction arms 56 and 57 are provided with arcuate outer peripheries and are formed in a fork-shape at the upper portions thereof excluding said extended portions 56' and 58', and include two pivotally attaching portions 56*a* and 57*a*. Said two pieces of arms 56 and 57 are pivotably disposed by making said shafts 58 and 59 penetrate through said pivotally attaching portions 56*a* and 57*a*.

The bracket 55 is provided with an adjustable stopper 55*c* fastened to a supporting portion 55*b* by a screw at the inner side of one of the shaft supporting portions 55*a*. At the pivotally attaching portion 56*a* in the suction arm 56, a connecting portion 56*b* extends over the bracket 55 and reaches to a position opposite to the stopper 55*c*. While, at the pivotally attaching portion 57*a* of the suction arm 57, a shaft supporting portion 57*b* extending under the bracket 55 is provided and at the same time, said shaft supporting portion 57*b* is provided with an adjustable stopper 57*c* retaining the under surface of the bracket 55. Thus, the suction arm 56 is restricted to effect such pivotal movement as to spread outwardly. On the other hand, the suction arm 57 is restricted to effect such pivotal movement as to retreat inwardly.

Return springs 60 are wound around the shafts 58 and 59, both ends 60*a* of said springs 60 being retained by the under-surfaces or over-surfaces of the suction arms 56 and 57 and an intermediate drawn out portion 60*b* is retained by the under-surface or the over-surface of the bracket 55, so that the suction arms 56 and 57 forced to pivot inwardly or outwardly by mechanisms as will be described later are returned to their initial positions by means of stoppers 55*a* and 57*c*.

The suction arms 56 and 57 are interposed to the shafts 58 and 59. At one end of the shafts 58 and 59, levers 58*a* and 59*a* are mounted in alternate positions in the axial direction and extended inwardly. Said levers 58*a* and 59*a* are provided with cam followers 58*b* and 59*b* at the tip portions thereof which are engaged with separate cams 62 and 63 firmly secured to the outside portion of the packing drum A. Because of this structure, when the packing drum A is rotated, the suction arm 56 is pivoted inwardly and the suction arm 57 is pivoted outwardly.

At the free end portions of the suction arms 56 and 57, guide walls 56*d* and 57*d* are disposed opposite to each other with a space l defined therebetween. Within said space l, a bottom clamp F' is positioned.

In the bottom clamp F', a movable plate 114 with a comparatively narrow width is movably mounted under a main plate 110 through mounting shafts 115 which are supported by slide guide members 116. At the upper ends of the mounting shafts 115, stopper rings 115*a* for engaging the slide guide members 116 are mounted. Between said slide guide members 116 and said movable plate 114, a spring 117 is wound around each of the mounting shafts 115. The main plate 110 is movably mounted on the slide guide members 116 with respect to a mounting plate 110'. Said slide guide members 116 are supported by slide guide members 116' mounted on a mounting plate 110'. At the upper ends of the slide guide members 116, stopper rings 115'a for engaging the slide guide members 116' are provided. Between said slide guide members 116' and the main plate 110, springs 117' are provided around the slide guide members 116.

The movable plate 114 is provided with a pressure welded member 114a made of a rubber material and, on the under-surface of the main plate 110, a pressure welded member 110a made of a rubber material is likewise mounted at positions outside both ends of the movable plate 114. The under surface $114a_1$ of the pressure welded member 114a is formed to have an arcuate shape with the same radius as that of the outer periphery of the suction arm, while the under-surface $110a_1$ of the pressure welded member 110a is formed in a plane parallel to the under-surface of the arbor R'.

In other words, the bottom clamp F' is fastened to a rack 65 by screws 64' through a metal connector 64. Said rack 65 is arranged to be movable within a mounting flange 66a and meshed with a pinion 67' mounted on one end of a transmission shaft 67 which is concentrically disposed within a main shaft 66 for supporting the suction ring C pinion 67'' mounted on the other end of the transmission shaft 67 is meshed with a rack 69 having a cam follower 69a engaged with a cam 68 secured to the outside portion of the packing drum A. Therefore, when the packing drum A is rotated, the bottom clamp F' is caused to move up and down.

The rack 69 includes a portion where no teeth are formed in order not to be engaged with the pinion 67''. Said portion of the rack 69 having no teeth corresponds to a position where the under-surface $114a_1$ of the pressure welded member 114 of the bottom clamp F' is formed in the same radius as that of the outer periphery of the suction arms 56 and 57. The arrangement is such that when the suction ring C is pivoted, the bottom clamp F' is not actuated. In order to prevent an idle movement at this time, a ball 71 biased by a spring 70 is fitted in a recess 65a defined on the rack 65 within the mounting flange 66a.

A pinion 66' is secured to the main shaft 66, and meshed with a rack 121 having a cam follower engaged with a cam 120 secured to the outside portion of the packing drum A, so that when the packing drum A is rotated, the main shaft 66 is driven to pivot the suction ring C.

A U-clamp G' is movably disposed by means of slide shafts 72 and 72' with respect to the bracket 55, and biased toward the guide walls 56d and 57d of the suction arms 56 and 57 by mens of a spring 73 so that it is normally positioned in the proximity of the walls 56d and 57d, and the descent position thereof is regulated by a stopper ring 72'a. The U-clamp G' formed of a resilient plate has sufficient depth and width of accommodating the bottom clamp F' and the arbor R'.

A control ring 127 is penetrated by the main shaft 66 therethrough and is prevented in its rotation by a pin 127b and is urgedly contacted against the 66a by a spring 127c. The control ring 127 is formed with a ventilation groove 127a, to which ends $66b_1$ of the through-holes 66b formed on said flange 66a are opened. The other ends $66b_2$ of the through-holes 66b are connected with the ends of nylon tubes 128 through metal connectors 129, and the other ends of the nylon tubes 128 are connected to through-holes 56e and 57e defined on the suction arms 56 and 57 through the metal connectors 129. The through-holes 57e and 57e are extended in the circumferential direction and then turned and extended in the axial direction for opening up a plurality of suction mouths 56f and 57f toward the outside at the free end portions of the suction arms 56 and 57. The ventilation groove 127a of the control ring 127 is connected with a valve as in the case with the aluminum foil suction ring B through a pipe.

The suction ring C is provided with a stopper 36' for positioning the package paper Q when received, as well as its clamping claw 38' as in the case with the suction ring B.

At one side of the U-clamp G' in its maximum ascended position with respect to the axial direction, an aluminum main presser M is provided. In the aluminum presser M, two pieces of L-shaped to-be-actuated elements 75 and 76 are pivotably attached to shafts 77 with respect to the bracket 42 fixed to the outer periphery of the packing drum A. One side portion of said L-shaped to-be-actuated elements 75 and 76 are formed with fork shaped connectors 75a and 76a, to which an actuator 78a of an actuating rod 78 is engaged, and the other side portions thereof are provided with supporting plates 79 fastened by screws 80. The free end portions of the supporting plates 79 are each provided with presser pieces 81 made of a rubber material. The other end of the actuating rod 78 is provided with a cam follower 78b which is engaged with a cam 83 provided at the outside portion of said packing drum A. By closing the supporting plates 79 which are normally biased in a released state by means of a spring 84 according to the rotation of the packing drum A, the presser pieces 81 maintain the state of the body wound around after the seaming clamp L' of the aluminum foil P is removed with respect to the arbor R'.

L-shaped actuators 75 and 76 include collide-and-fit portions 76b around the shafts 77 with respect to the stoppers 42a of the brackets 42. When the portions 76b are brought to be in a collide-and-fit relation with the stoppers 42a, a predetermined released state is maintained.

At the inner side of the free end portion of one of the suction arms 56, a folding claw I' formed of a resilient plate for folding the body is provided.

N denotes a heater block which is provided right under and proximate to the suction arm 57. The heater block N is fastened to an oscillating plate 87 which is oscillatably disposed with respect to a bracket 86 through a heat insulating material 88 by a screw 89. A heater is stored in the heater block N.

A weight 91 is hung downward from the other side of the oscillating plate 87 in order to offset the force of inertia. An actuator 92a of an actuating member 92 is engaged with a fork-shaped portion 87a formed at the intermediate portion of the oscillating plate 87, and the actuating rod 92b which is connected to said actuaing member 92 is slidably carried by bearings 93 and 94, and at the same time, the heater block is moved forward by means of a spring 95 provided between the bearing 93 and a collar 92c. The space defined between the heater block N and the arbor R' can be adjustable by abutting the collar 92C against an adjustable stopper 95'. The actuating rod 92b is provided with a cam follower 92d at its outer end, and the heater block N is withdrawn by a cam 96 through the actuating rod 92b and the actuating member 92. Two cut-out grooves n are formed on the plane of the heater block N which faces the arbor R'. A plate 97 adapted for preventing the flap from escaping is fastened to the bracket 86 through the supporting member 86', and stored in said grooves n in the same plane with respect to the heater block N. Thus, when the heater block N is released due to the stopping of the movement of the machine, etc., the flap is prevented from escaping.

Right under the heater block N, a cooler block O is disposed. The cooler block O is fastened to a holder 101 by bolts through a thermoelectric element 102 for which the Peltier effect is used. Said holder 101 is fastened to one side of an oscillating plate 99 by screws 100, and the oscillating plate 99 is pivotably mounted on a shaft 171. Between the bolts 103 and the holder 101, heat insulating materials 104 are interposed. At the other side of the oscillating plate 99, a cam follower 99*a* is provided and actuated by a cam 99'*a* to advance or withdraw the plate 99 with respect to the path for the arbor R' at every predetermined cycle. Instead of the thermoelectric element 102, other cooling devices may be employed.

In the outer peripheral portion of the packing drum A, a fork-shaped associatingly movable rod 253 is slidably provided by means of its intermediate engaging sleeve portion 253*a* with respect to a supporting shaft 252. A cam follower 253*b* provided at one side of said engaging sleeve portion 253*a* is engaged with a cam 54' provided at the outside of the packing drum A. The end portion 253*c* of said associatingly movable rod 253 is abutted against a cam follower 50'*a* of a slide block 50' in the seaming clamp L' in the resisting direction with respect to a spring 51', so that the seaming clamp L' is separated from the arbor R' by resisting the spring 51', since when the packing drum A is being rotated, it is actuated by the cam 54'.

With the above construction, according to the rotation of the packing drum A, each suction ring C is rotated to receive a package paper Q which is cut in a predetermined dimension beforehand from the package paper feed drum E. Other functions at the time of receipt of the paper are the same as already described with respect to the suction ring B of the aluminum foil P, but the package paper is received in the state nonsymmetric with respect to the suction arms 56 and 57.

When the receipt of the package paper Q is completed, the suction ring C is rotated at 214' counterclockwise and brought to be in a position opposite to the arbor R', wherein the open portion is faced toward the central portion of the packing drum A.

Thereafter, the arbor R' with the afore-mentioned aluminum bag already shaped is moved forward with respect to the suction ring C and entered into the suction ring C through said open portion of the suction arms 56 and 57. When the arbor R' is moved for 3 mm after contact with the package paper Q, the suction for the suction mounts 56*f* and 57*f* is cut. As a result, the suction arms 56 and 57 are released from supporting the package paper Q. Thus, the package paper Q is sandwiched between and clamped by both the clamp F' and the arbor R' and moved into the suction ring C in that state.

The package paper Q is provisionally folded with its body portion by the opposing guide walls 56*d* and 57*d* at the free end portions of the suction arms 56 and 57. While entering, the arbor R' lifts up the U-shaped clamp G'. In the maximum ascended position, the arbor R' completes its entrance into the U-clamp G' and the formal folding is effected.

Next, the aluminum main presser M disposed at the outside of the maximum ascended position of the U-clamp G' is closed to clamp the portion of the aluminum foil P disposed from the package paper Q in the axial direction. In this state, the seaming clamp L' is released from the arbor R'.

Next, in the released state where the suction arm 27 is pivoted outwardly, the suction arm 56 is pivoted toward the closing direction, thereby permitting the folding claw I' to fold the hanging portion of the package paper Q for the body portion. After the package paper Q is pressed by the seaming clamp L', the suction arm 57 is returned. After the aluminum main presser M is released, the suction arm 56 is returned. Then, the arbor R' and the bottom clamp F' are retreated backward. In the above-mentioned state of the arbor R' with the package paper Q wound around the body thereof, the wound around state of the package paper Q is transferred from the U-clamp G' to the guide walls 56*d* and 57*d* at the right above position of the guide walls 56*d* and 57*d* and supported thereby, and simultaneously, the body outer flap $Q_2$ is folded by one of the guide walls 57*d*.

The body outer flap $Q_2$ is applied with an adhesive agent beforehand. In the case where the agent is a hot melt, it is melted by the heater block N provided right thereunder and cooled and hardened by the cooler block O to complete the adhesion.

Nextly, referring to FIGS. 38 to 47, 65, 66, 68 and 69, a detailed description will be set forth hereunder regarding mechanisms for folding one end portion of a double bag, particularly at the end portion of the arbor.

It is one of the features of the present packing machine that a package paper bottom supporting clamp T is inserted into the arbor R' and arranged on the botton in addition to the sleeve shape of the arbor R'.

Referring now to FIGS. 38 to 41, 58, 65 and 66, a package paper bottom supporting clamp T is formed of a square plate having a desired configuration inserted into the sleeve shaped inner bore of the arbor R'. Said clamp T is connected with a pusher shaft 211 which is in turn continuously connected to a package paper supporting rod 213 further extended through a contrarotating connection portion 212.

The package paper supporting rod 213 is provided with a rack and another rack 213*f* is arranged opposite thereto. Between said two racks, a pair of large and small pinions 213*d* and 213*e* in the gear diameter axially supported by the packing drum A are interposed. Said rack 213*f* is slidably penetrated into the packing drum A and provided with a cam follower 213*c* at its one end, said cam follower 213*c* being engaged with a groove cam 213*b*, and driven in the axial direction of the packing drum A.

When said package paper supporting rod 213 is moved, the rack 213*f* is mesh with the pinion with the small diameter, and the pinion with large diameter is meshed with said rod 213, thereby transmitting a multiplied amount of movement.

The foremost position where the package paper supporting clamp T is inserted into the arbor R' is arranged as such that the foremost plane of the clamp T is aligned with the same plane with respect to the innermost plane of the arbor R'.

Said contrarotating connection portion 212 is constructed such that the pushing shaft 211 is fastened to one end of the L-shaped plate 211*a*, a ball stopper 211*b* is mounted on the other end thereof, and the central portion thereof is fastened by a pin 214. At the other end, said pin 214 is provided with a socket 214*a* with a recess and rotatably inserted into a flat plane 213*a*, which is secured to said package paper supporting rod 213. A rotary shaft 215 including a plug 215*a* having a protruded portion opposite to said socket 214*a* with a recess for fitting thereto is rotatably provided on the side wall of the packing drum A. Furthermore, another rotary shaft 216 is provided in parallel relation to said rotary shaft 215. A pinion 216*a* mounted on the rotary shaft 216 is meshed with a pinion 215*b* mounted on the rotary shaft 215. At the other end of the rotary shaft 216, the pinion 216*b* is mounted. Said pinion 216*b* is meshed with a rack 217, at one end of which a cam follower 217*a* is disposed and is engaged with a cam fastened to the outside portion of the packing drum A. At the other end of said rack 217*a*, a return spring 218 is stretched. Said rack 217 is slidably mounted to the packing drum A in the radial direction of the packing drum A.

Said package paper supporting rod 213 is arranged in a manner to avoid a cigarette guide mouth metal V which is disposed on the co-axis with the arbor R′ now in its lowest position in the radial direction, and to effect the alignment of the package bottom supporting clamp T and the axis by means of contrarotation of the L-shaped plate 211*a*. When the package paper bottom supporting clamp T goes in and out of the arbor R′ for effecting the folding operation, the L-shaped plate 211*a* is contrarotated to bring it in alignment with the arbor R′. When the clamp T is in the non-operating position, the L-shaped plate 211*a* is contrarotated in the reversed direction and withdrawn for enabling thereof to reach to the lowest position in the radial direction of the aluminum foil arbor R.

After the arbor R in the aluminum foil arbor row is caused to move toward the outer peripheral direction, the package paper bottom supporting clamp T is guided by a plate cam 219 and contrarotated by the rotation of the pinion 216*b* transmitted from the rack 217 to be in alignment with the arbor R′, and then, guided by the groove cam 213*b* into the arbor R′.

In order to prevent the disengagement of the socket 214*a* with a recess and the plug 215*a* having a protruded portion at the time when moved in the axial direction, the rotation of the clamp T is stopped by the stopper 211*b*.

When the package paper supporting clamp T is inserted, both bottom ears $Q_3$ of the package paper are folded.

Referring to FIGS. 42, 43, 68 and 69, ear folding claws W and W′ are mounted on the tip portion of L-shaped arm members 220 and 220′. The other ends of said arm members 221 and 221′ are arranged in such a manner as to be opened or shut in the right and left direction by meshing with pinions 221 and 221′. The arm members 220 and 220′ are curved in an arm-folded fashion for defining sufficient space in order to accommodate therein a bottom inner flap folding-claw X as will be described hereinafter.

A rack 222 meshing with said pinion 221 is fastened to a shaft 223 slidably penetrated into the packing drum A. On the other end of said shaft 223, an extension member 224 including a cam follower 224*a* at its tip portion is mounted.

The bracket 225 for axially supporting the pinion 221 and 221′ for rotation is fastened to the packing drum A by screws.

A return spring 226 is stretched between the other end of the shaft 223 and the main body.

Said cam follower 224*a* is guided by a cam 224′*a* secured to the outside portion of the packing drum A, and the ear folding-claws W and W′ are actuated by the rotation of the pinion 221 and 221′ transmitted by the rack 222, thereby effecting the aforementioned folding operation.

Attention should be brought to the fact that the quality of the bottom folded portion is improved since at the time when the above-mentioned folding operation of the ear $Q_3$ is effected, a bottom inner flap folding-claw X which will be described in the following paragraph, and a heater block $Y_1$ which will be described later are employed in order to prevent the bottom inner flap $Q_4$ and the bottom outer flap $Q_5$ from escaping.

Referring to FIGS. 44, 45, 68 and 69, the package-paper inner flap folding-claw X includes a horizontal plane $X_1$ and a vertical plane $X_2$, and is fastened to a sliding member 228 through an arm 227. A connecting rod 229 is clamped between two guide rollers 228′ and fastened to a sliding shaft 230 which is slidably penetrated into the packing drum A. On the other end of said sliding shaft 230, an extension member 230*a* including a cam follower 230*b* at its tip portion is mounted. A return spring 231 is stretched between the other end of the sliding shaft 230 and the packing drum A through a mounting piece. At the intermediate position of the sliding shaft 230, a stop ring 230*c* is mounted for positioning the folding claw X.

Said sliding member 228 is inserted into a horizontal shaft 233 extending from a vertical shaft 232 in such a manner as to be slidable in the axial direction, but unrotatable therearound, and is regulated in its position by the connecting rod 229. Said vertical shaft 232 is axially supported by bearings 234 and 235 protruded from the packing drum A in such a manner as to be slidable in the vertical direction but unrotatable therearound. At the other end of the shaft 232, an extension member 232*a* including a cam follower 232*b* is mounted, said cam follower 232*b* being engaged with a cam 232′*b* is fixed to an outside portion of the packing drum A. Also, between the shaft 232 and the bearing 234, a return spring 236 as well as a stop ring 232*c* for positioning the folding-claw X are provided.

With the above construction, said bottom inner flap folding-claw X can effect a motion in the axial direction transmitted through the cam follower 230*b*, as well as a motion in the radial direction transmitted through the cam follower 232*b*, thus permitting the folding-claw X to move in the diagonal direction to shorten the cycle time. When the bottom inner flap $Q_4$ is folded, said claw X is moved in the diagonal direction and made to wait for a while. It is the position or height where the upper plane of the arbor R′ and the horizontal plane $X_1$ of the claw X have a predetermined space. Simultaneously, it is a position where the vertical plane $X_2$ of the claw X and the end plane of the arbor R′ have a predetermined space therebetween.

In a position of the under-surface of the arbor R′ opposite to the above-mentioned horizontal plane $X_1$, a heater block $Y_1$ as will be described later is continuously positioned.

In this way, on the horizontal plane $X_1$ of said claw X, the bottom inner flap $Q_4$ is held from the outside, and on the upper plane of the heater block $Y_1$, the bottom outer flap $Q_5$ is held from the outside, respectively. Nextly, said ear folding-claws W and W' are shut in order to effect the folding operation of both bottom ears $Q_3$. As described above, when the ears $Q_3$ are folded, the flaps $Q_4$ and $Q_5$ are prevented from escaping outwardly, thus assuring a correct folding. This is one of the features of the present apparatus.

After the ears $Q_3$ are folded, the claw X is descended downward in the radial direction through the cam follower 232*b*. When the vertical plane $X_2$ of the claw X is descending along the end plane of the arbor R', the bottom inner flap $Q_4$ protruded from the arbor R' is folded downwardly.

Next thereafter, the heater block $Y_1$ as will be described later is ascended, and upon the bottom inner flap $Q_4$, the bottom outer flap $Q_5$ to which the heater block $Y_1$ was touched externally is folded upwardly. At this moment, the claw X is retreated upwardly in the drawing, and then retreated toward the left side in the drawing.

Nextly, the heater block $Y_1$ and the cooler block $Y_2$ will be described.

Referring to FIGS. 46, 47, 68 and 69, the heater block $Y_1$ and the cooler block $Y_2$ are fastened to a L-shaped member 135 by screws through a heat insulating material 135'. The heater block $Y_1$ includes a heating element 136 and the cooler block $Y_2$ includes a cooling element 137, respectively. Said L-shaped member 135 is firmly secured in a position-adjustable manner to a supporting member 138 axially supported by a yoke-shaped member 138*a* in an oscillatable manner.

At one end of the oscillating shaft 137*a* of the supporting member 138, a lever 137*c* including a cam follower 137*b* at its tip portion is firmly fixed. In order to oscillate the lever 137*c* by engaging with the cam follower 137*b*, an oscillatable cam plate 140 is oscillatably supported by a bearing member 145 through an oscillatable shaft 139. The cam plate 140 is provided with two recesses 140' and 140''. When the cam follower 137*b* is engaged with one of the recesses 140', the heater block $Y_1$ and the arbor R' are positioned in the same radius. On the other hand, when the cam follower 137*b* is engaged with the other recess 140'', the cooler block $Y_2$ and the arbor R' are positioned in the same radius. The sizes of said recesses 140' and 140'' should be large enough so that the heater block $Y_1$ and the cooler block $Y_2$ can obtain a sufficient pressure together with said package bottom supporting clamp T. The lever 137*c* is provided with an arm 137*d*. A return spring 141 is stretched between said arm 137*d* and a mounting piece 144 as will be described hereinafter.

At one end of a slidable shaft 142 slidably penetrated into the packing drum A, a cam follower 142*a* is provided for urgedly abutting against said oscillatable cam plate 140, while at the other end thereof, an extension member 142*c* including a cam follower 142*d* at its tip portion for engaging with a cam 142'*d* fixed to an outside portion of the packing drum A is mounted.

At the other end of said slidable shaft 142, a block 240 including a cut-out portion 240*a* is firmly secured. The position of the cam plate 140 is regulated by abutting an adjustable stopper 241 mounted on the packing drum A against the cut-out portion 240*a*. In other words, the respective pressing plates of the heater block $Y_1$ and the cooler block $Y_2$ are positioned parallel to the end plane of the arbor R'.

Furthermore, the cam 142'*d* is slidably mounted on the outside portion (not shown) of the packing drum A and actuated when the cooler block $Y_2$ is released from its pushing pressure due to the retreat of the package-paper bottom supporting clamp T and when the heater block $Y_1$ is retreated after the machine is stopped.

On the other hand, said shaft 143 fastened to the yoke-shaped member 138*a* and extended therefrom is provided at the other end with a cam follower 144*a* through a mounting piece 144, said cam follower 144*a* being engaged with a cam 149. Said shaft 143 is slidably carried by a bearing member 145 protruded from the packing drum A. A shaft 146 is also slidably carried by said bearing member 145 in a manner as to be parallel to said shaft 143. Said shaft 146 is firmly secured to its upper end to said yoke-shaped member 138*a* for preventing the rotation of the yoke-shaped member 138*a*.

Said heater block $Y_1$ and said cooler block $Y_2$ are provided with presser plates 147 on their opposing planes with respect to the arbor R'. The presser plates 147 can be accommodated in the recesses formed in the surfaces of the heater block $Y_1$ and the cooler block $Y_2$. When the heater block $Y_1$ and the cooler block $Y_2$ are abutted against the bottom outer flap $Q_5$, the presser plates 147 are brought to be in positions on the same plane in the height, and fastened to said yoke-shaped member 138*a* by screws 148.

The heater block $Y_1$ and the cooler block $Y_2$ constructed as mentioned above are moved vertically in the radial direction by the groove cam 149 mounted on a portion other than the main body of the packing drum A through the cam follower 144*a*. Furthermore, the blocks $Y_1$ and $Y_2$ are oscillated in the axial direction by the cam 142'*d* through the cam follower 142*d*. When the ears $Q_3$ are being folded as mentioned above, the upper surface of the heater block $Y_1$ is in a position having a predetermined space with respect to the under-surface of the arbor R' and supports the bottom outer flap $Q_5$ from the under-surface. After the folding operation is finished on the parts of the ears $Q_3$ and the bottom inner flap $Q_4$, the heater block $Y_1$ is ascended to fold the bottom outer flap $Q_5$. At this moment, the heater block $Y_1$ is oscillated in such a manner as to push the bottom outer flap $Q_5$ against the end face of the arbor R' and more particularly against the package-paper bottom supporting clamp T inserted into the end face of the arbor R'. After pressing and heating for a suitable period of time, the heater block $Y_1$ is further ascended. In turn, the cooler block $Y_2$ is made to press and cool the bottom outer flap $Q_5$ for obtaining a sure adhesion. In the present embodiment, a hot melt adhesion agent is suggested to apply to the package-paper beforehand in order to attach the bottom outer flap $Q_5$. However, other suitable adhesive agents may be used during the process. Also, heating and cooling means may be modified, if necessary.

It is not desirable that when the heater block $Y_1$ and the cooler $Y_2$ are being moved in the radial direction, they are caused to move in such a manner as to keep pressing the bottom outer flap $Q_5$, since there is a risk of scratching and damaging the package. Therefore, when the blocks $Y_1$ and $Y_2$ are moved in the radial direction, the amount of the oscillation should be suitably selected according to the configuration of the pressing surface of the cam follower 137*b* of the cam plate 140, so that the afore-mentioned risk can be avoided. According to the present embodiment, an arrangement is made such that notwithstanding the above-mentioned oscillation, the pressure plate 147 is normally caused to keep pressing in order to prevent such phenomenon as that the bottom outer flap $Q_5$ once folded is unfolded, when the machine is stopped.

Nextly, the details of the mechanism for the radial movement of the arbors as well as the structure and function of the mechanism for shifting between the arbor rows will be set forth hereunder.

The arbor R is made to accompany the rotation of the packing drum A with movement in the radial direction to be thereby subjected to the winding and folding operation of the packing sheet materials around the arbor R. The arbors R on the first arbor row which have finished the shaping of the aluminum bag are moved axially to the second row for shaping another package-paper bag thereupon. In turn, the arbors R' on the second arbor row which have finished the shaping of the double bags are moved axially to the first row for inserting a group of cigarettes through the opening of its sleeve and for accommodating the cigarettes into the double bags and pushed out. This series of operation of the arbors R and R' is effected in a continuous manner.

Figure 20:
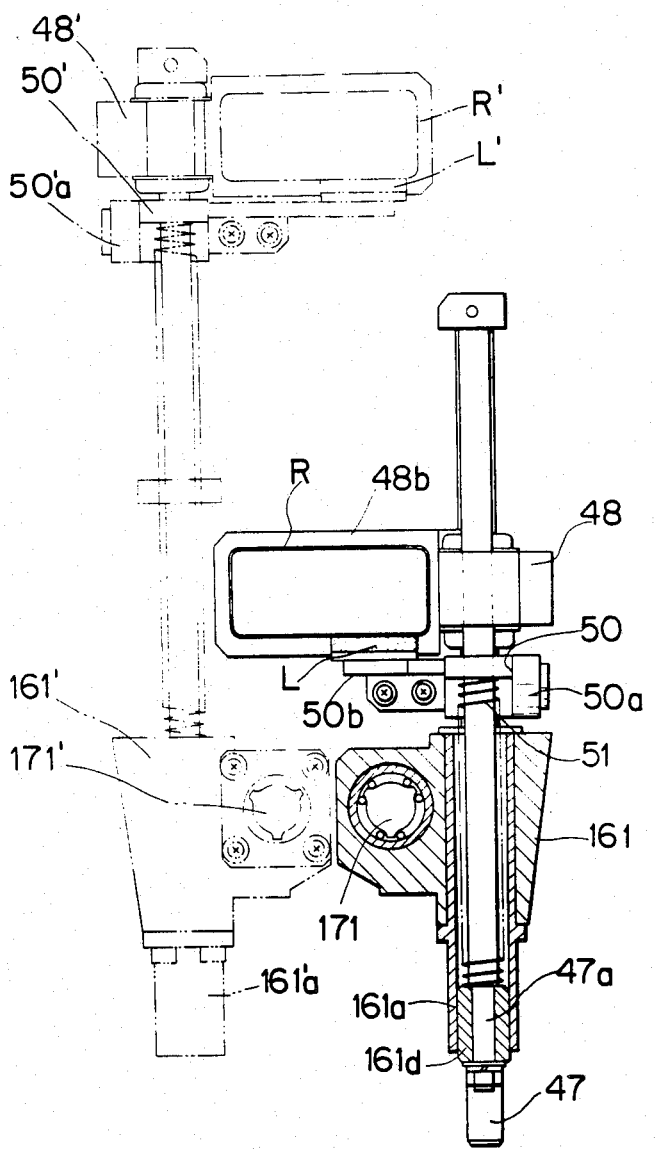
FIG. 20 is a front view showing the arbor and a seaming clamp supporting mechanism.
Figure 21:
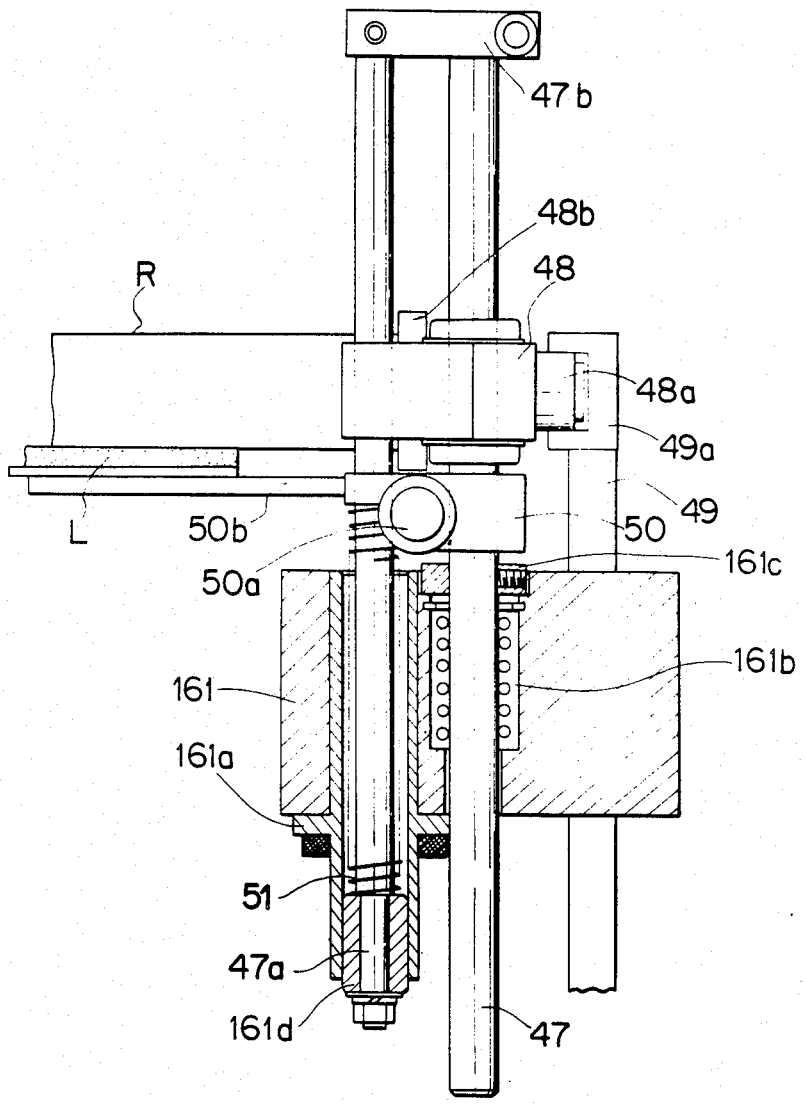
FIG. 21 is a side view of the above.
Figure 23:
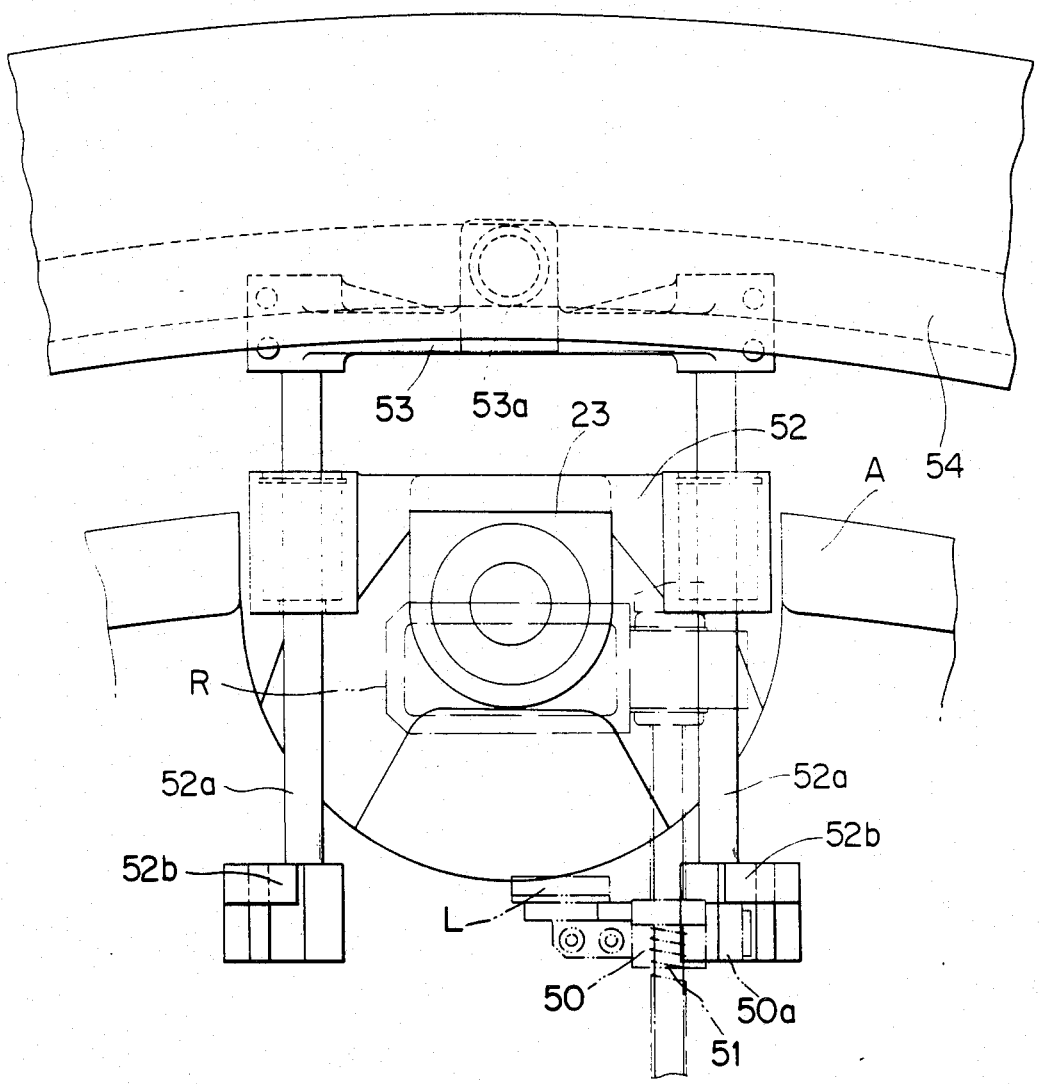
FIG. 23 is a front view of a seaming clamp driving mechanism of the aluminum foil.
Figure 24:
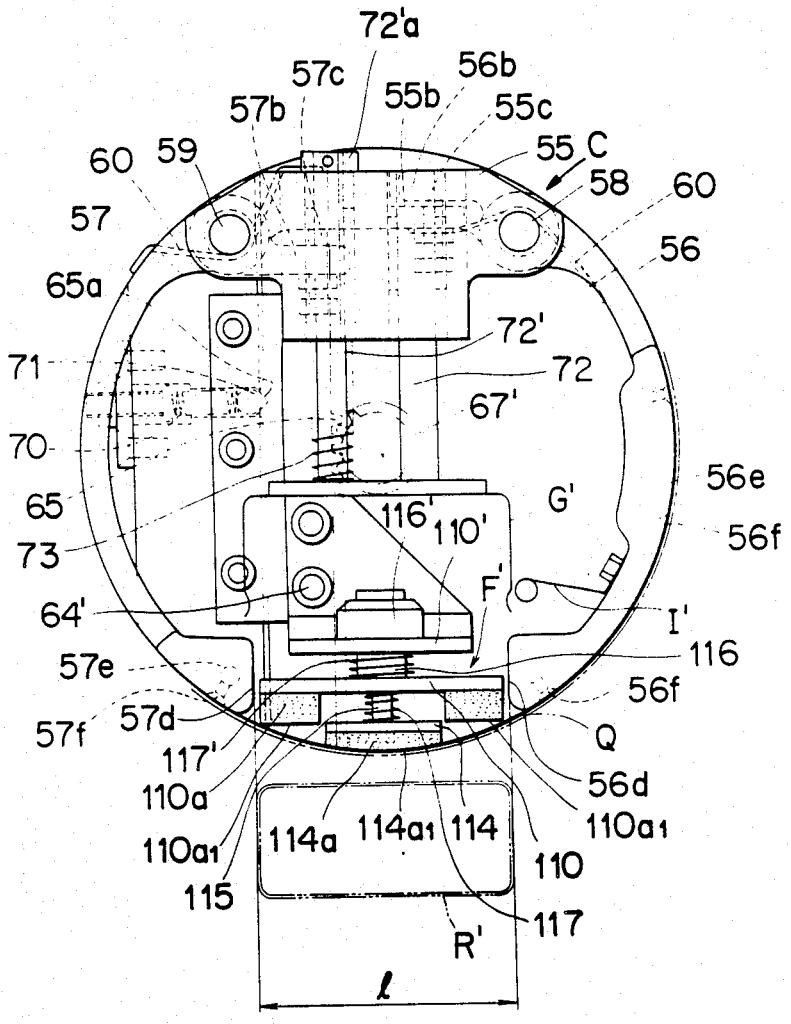
FIG. 24 is a rear view of a package paper suction ring.
Figure 25:
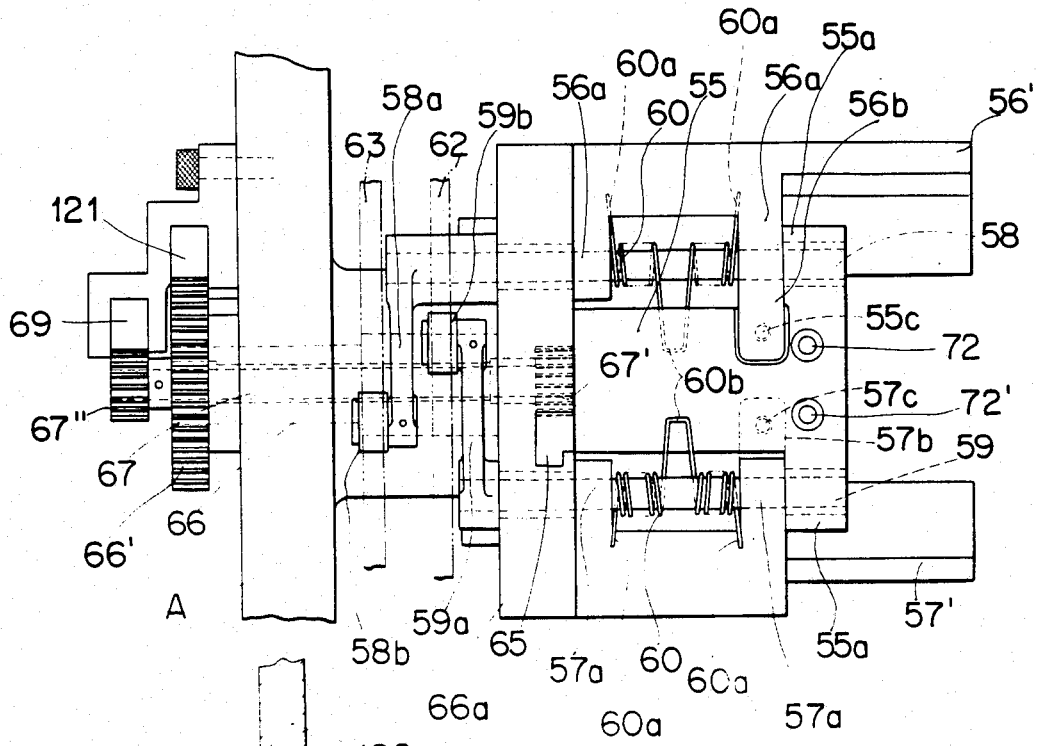
FIG. 25 is a plan view of the above.
Figure 26:
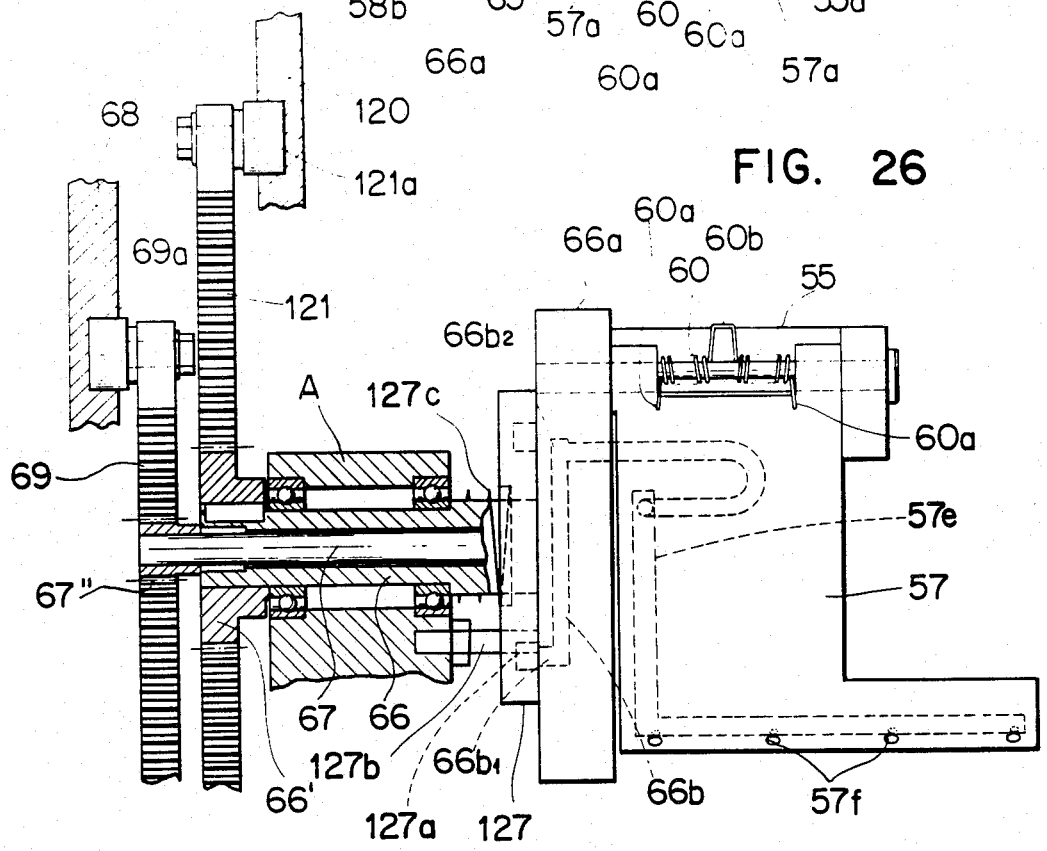
FIG. 26 is an exploded side view of the above showing a suction ring shaft portion.
Figure 27:
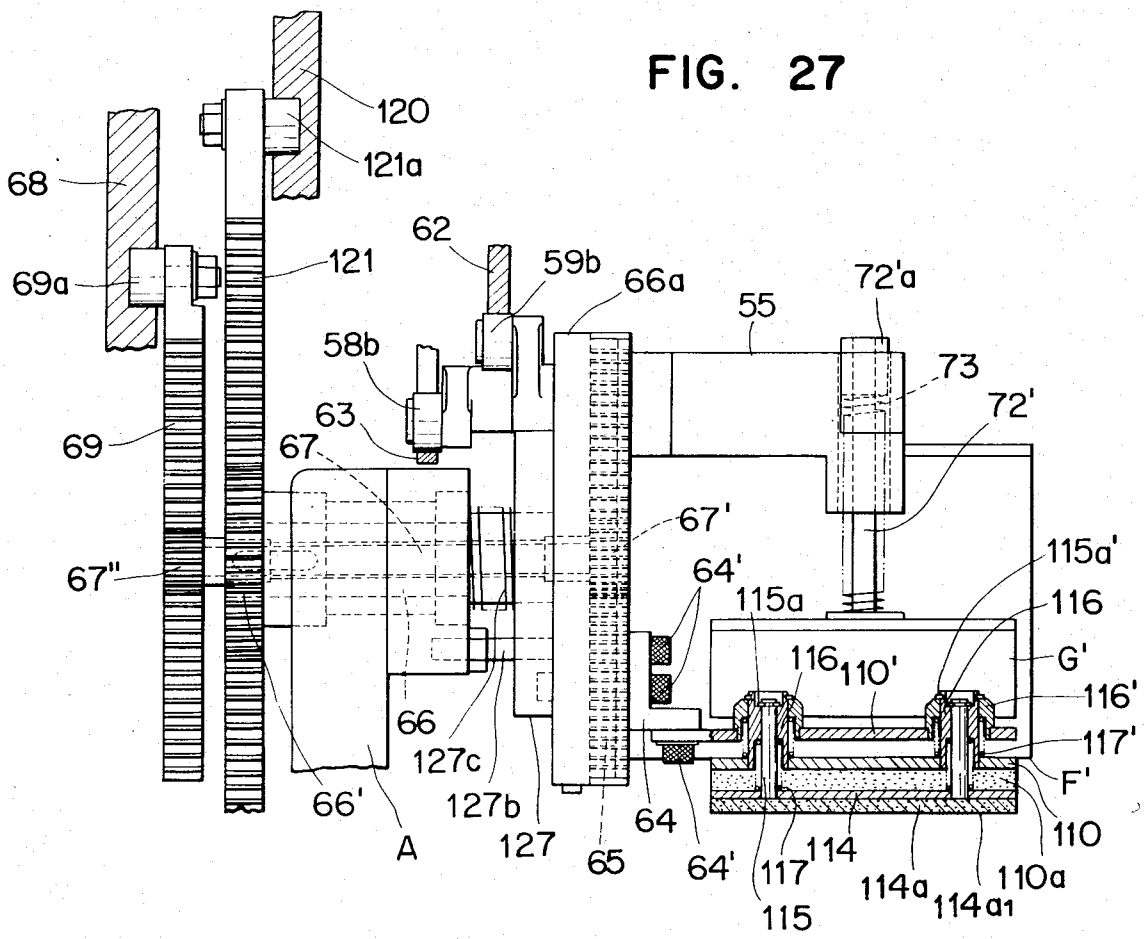
FIG. 27 is an exploded side view of the above showing a bottom clamp.
Figure 28:
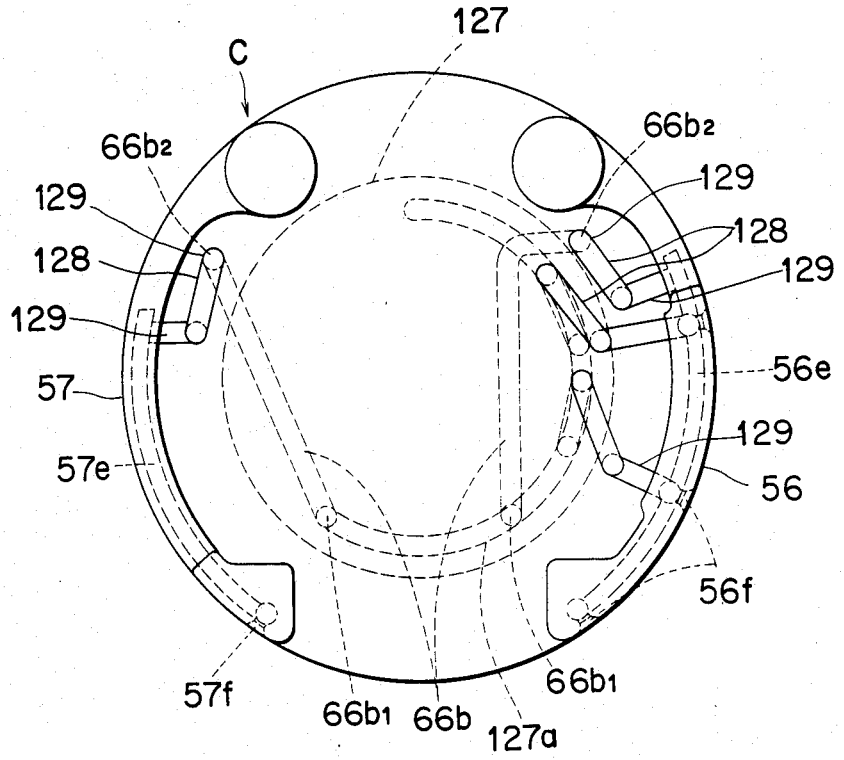
FIG. 28 is a detailed view of a package paper suction transfer mechanism.
Figure 31:
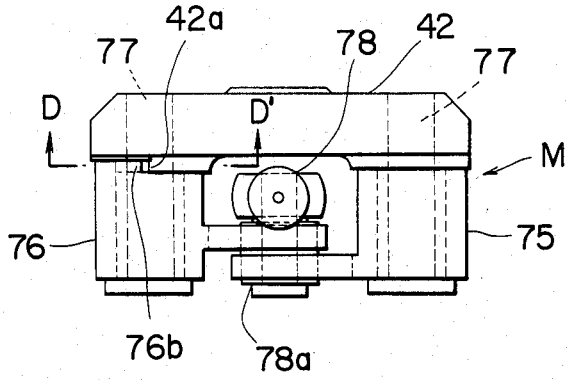
FIG. 31 is a plan view of the above.
Figure 32:
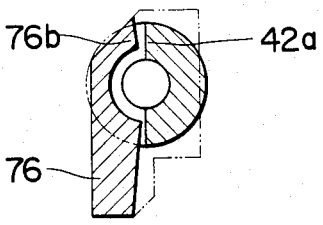
FIG. 32 is a sectional view taken on line D—D′ of FIG. 31.
Figure 29:
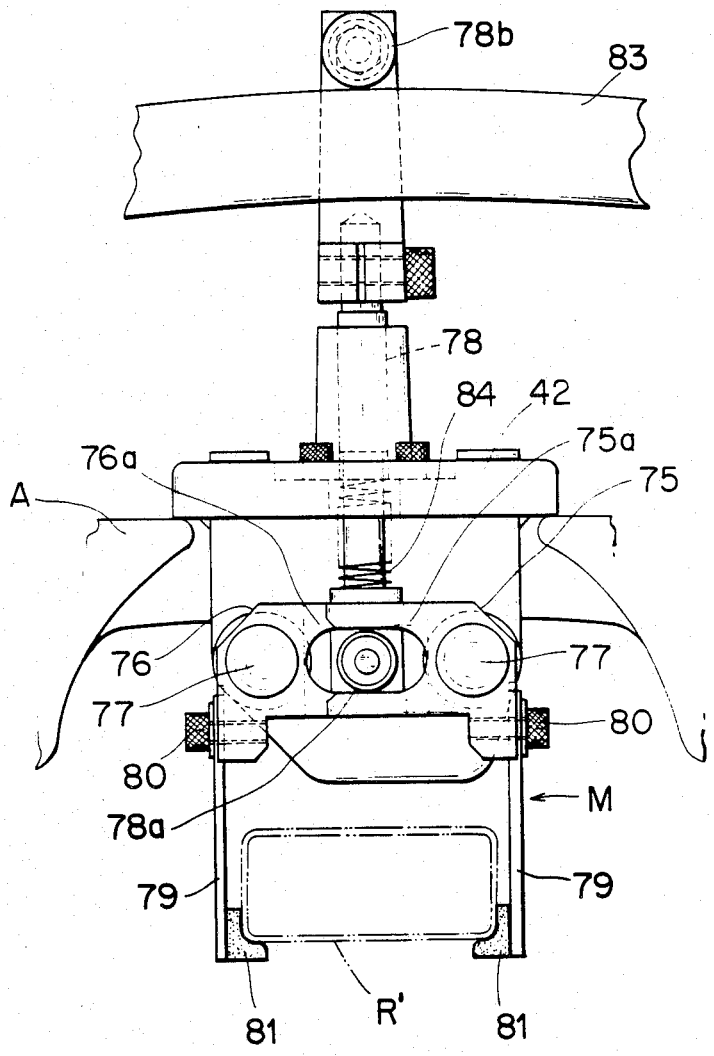
FIG. 29 is a front view of an aluminum foil main presser.
Figure 30:
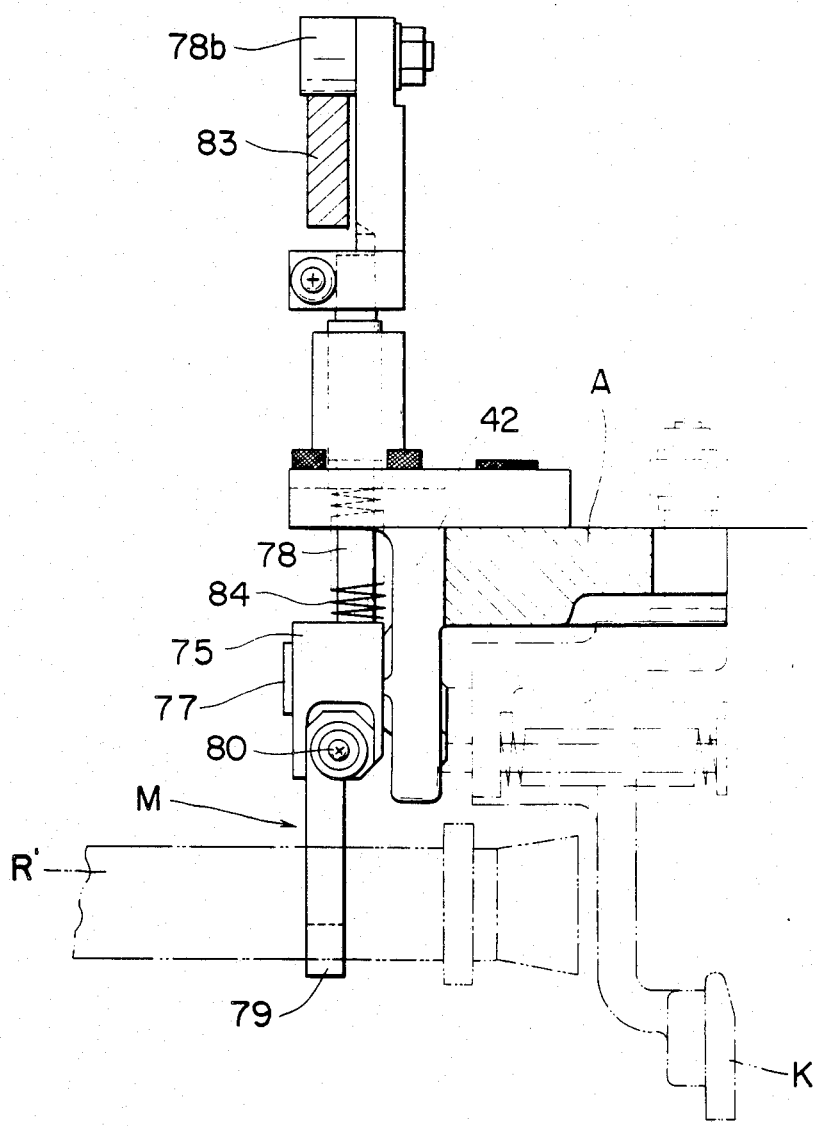
FIG. 30 is a side view of the above.
Figure 33:
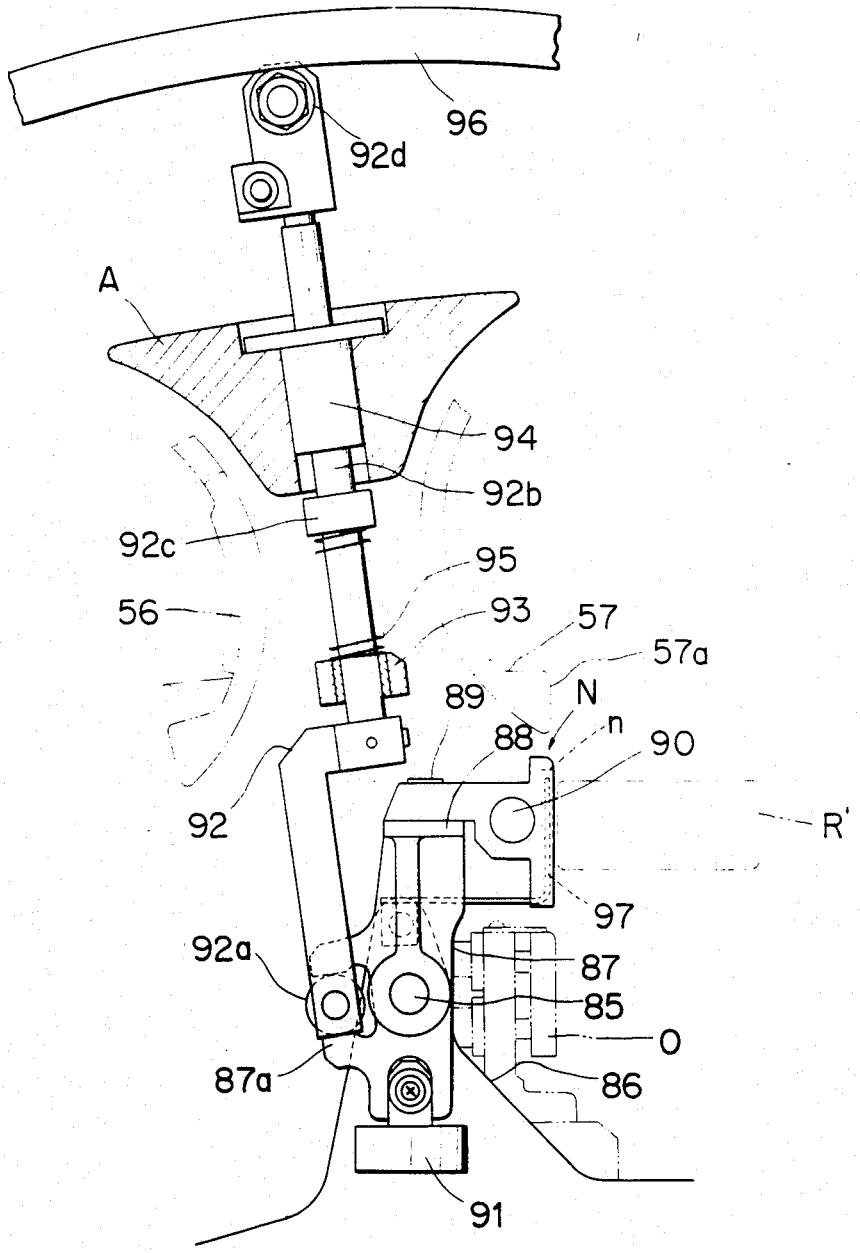
FIG. 33 is a rear view of a heater block.
Figure 35:
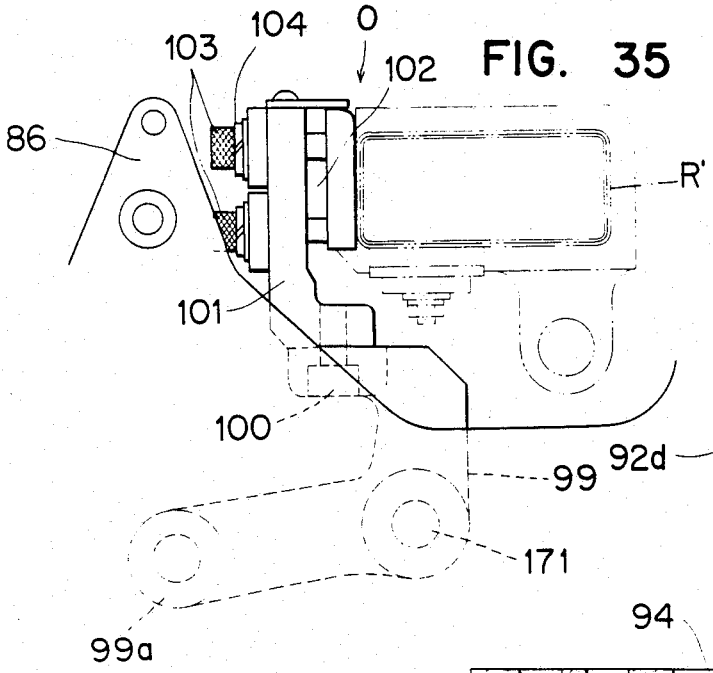
FIG. 35 is a rear view of a cooler block.
Figure 34:
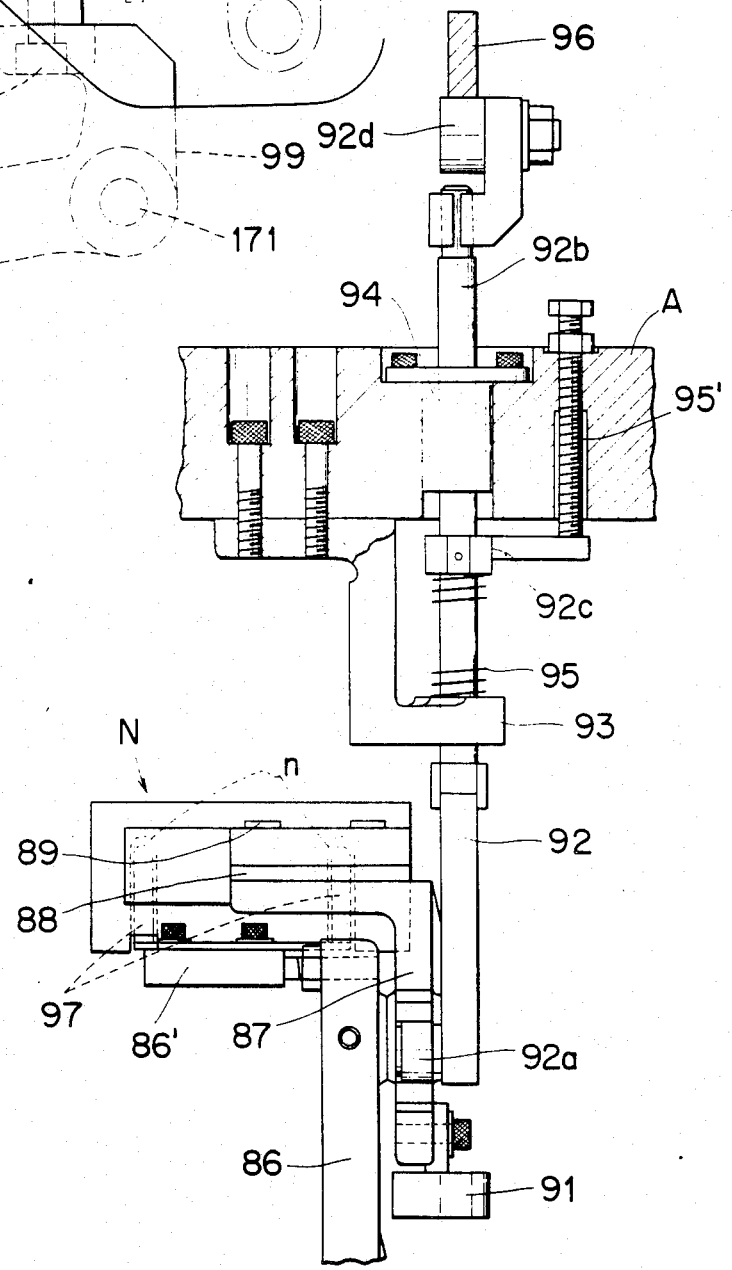
FIG. 34 is a side view of the above.
Figure 36:
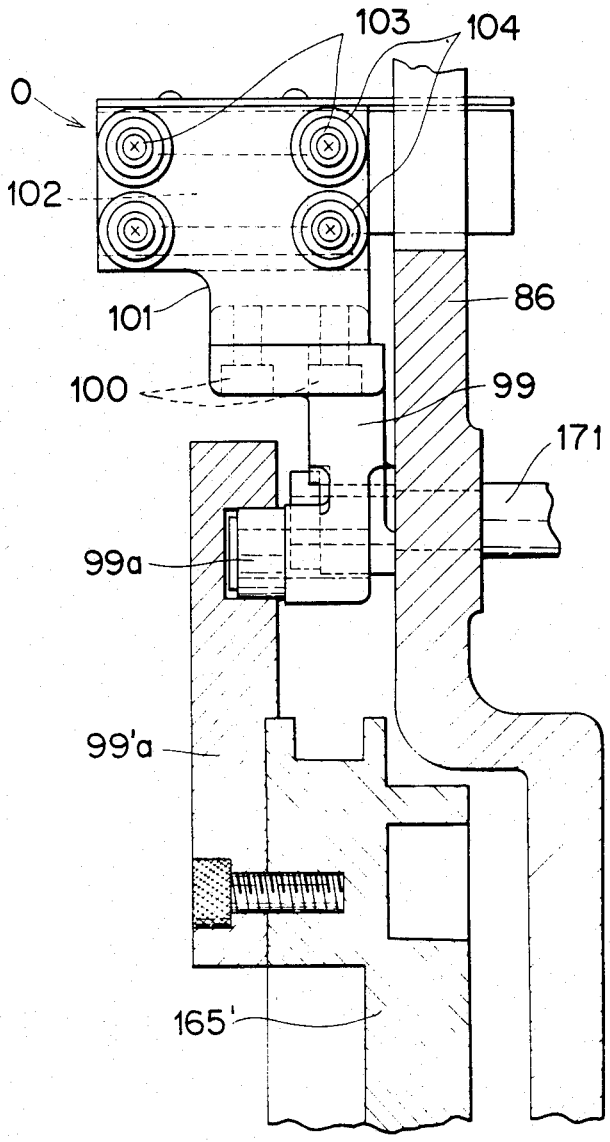
FIG. 36 is a side view of the above.
Figure 37:
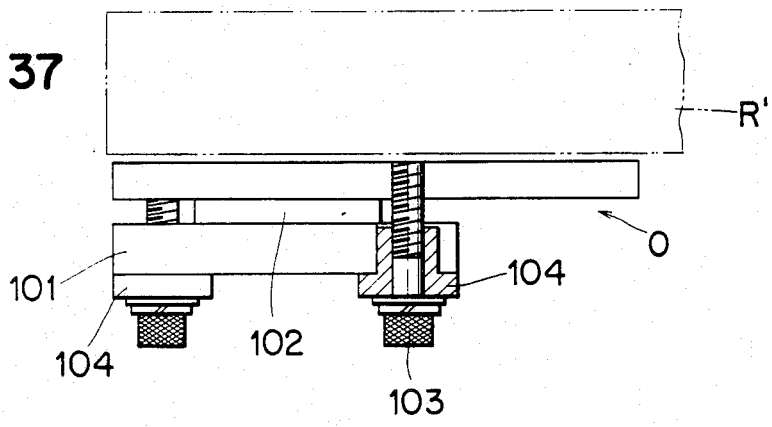
FIG. 37 is a detailed plan view showing a mounting portion of the above.
Figure 38:
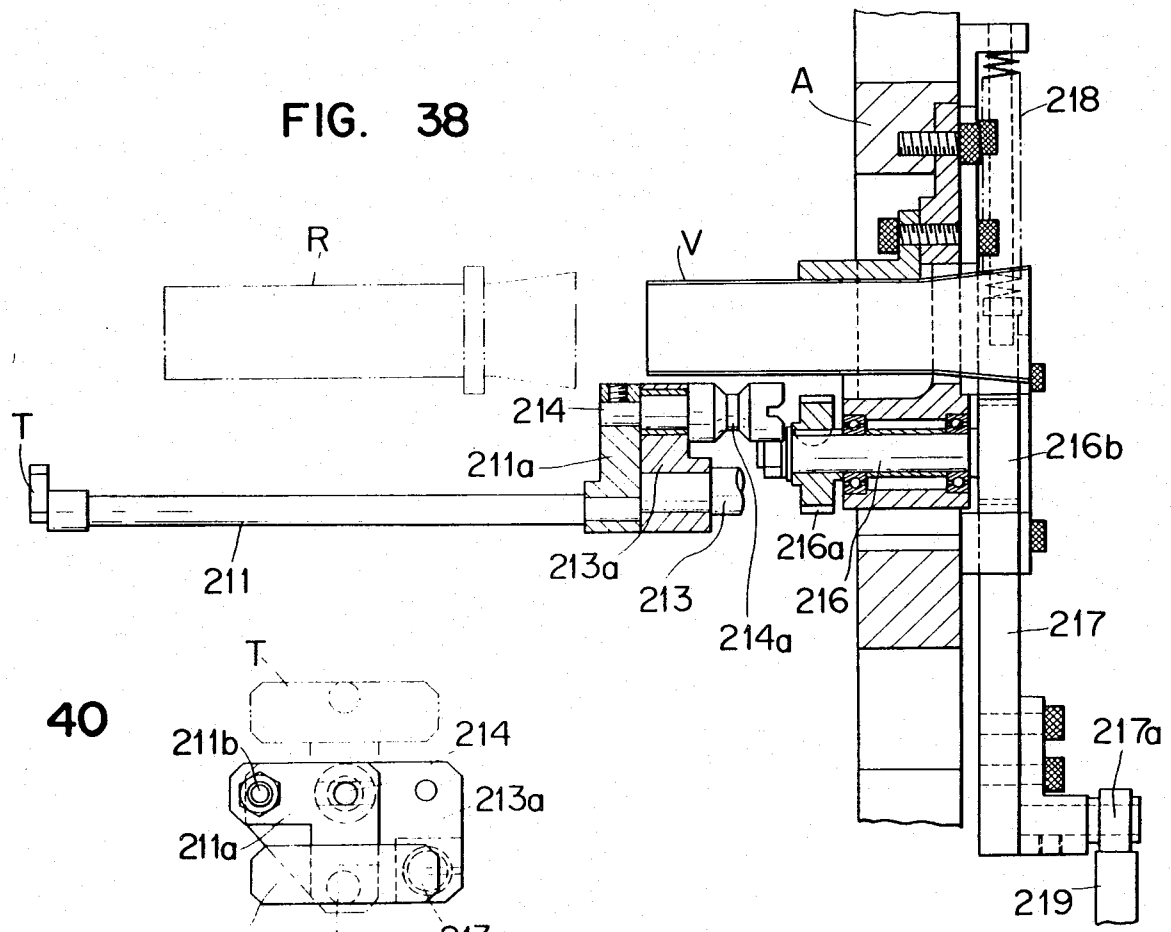
FIG. 38 is a detailed view of a package paper bottom supporting clamp contrarotating transfer mechanism.
Figure 40:
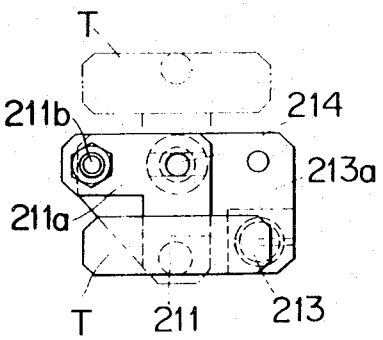
FIG. 40 is a front view of the package paper bottom supporting clamp contrarotating portion.
Figure 39:
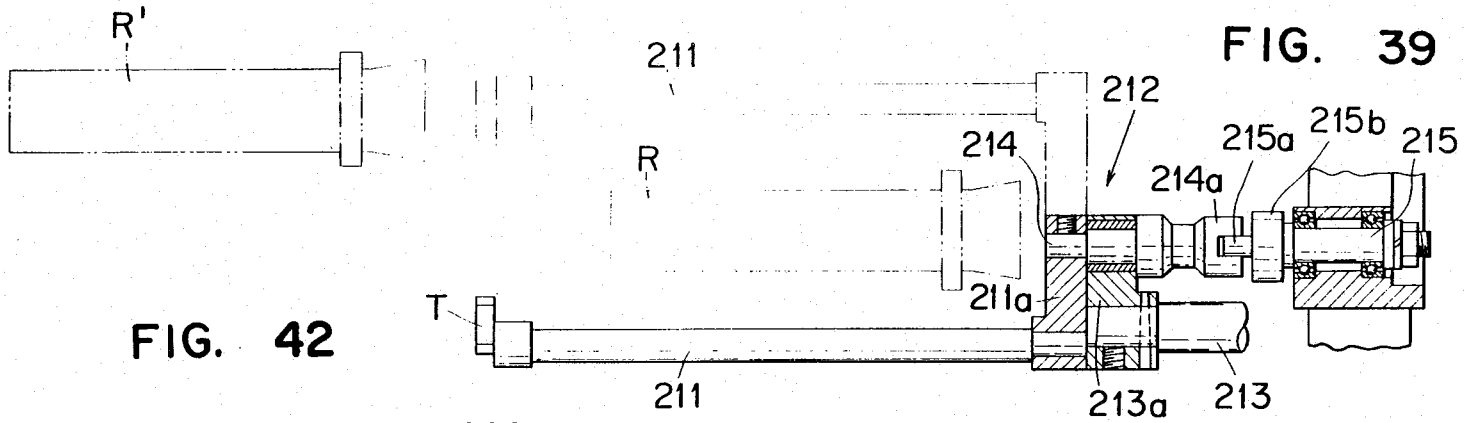
FIG. 39 is a detailed view of a transfer mechanism engaging the same of the above.
Figure 41:
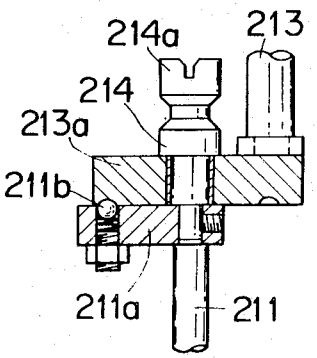
FIG. 41 is a plan view of the above.
Figure 42:
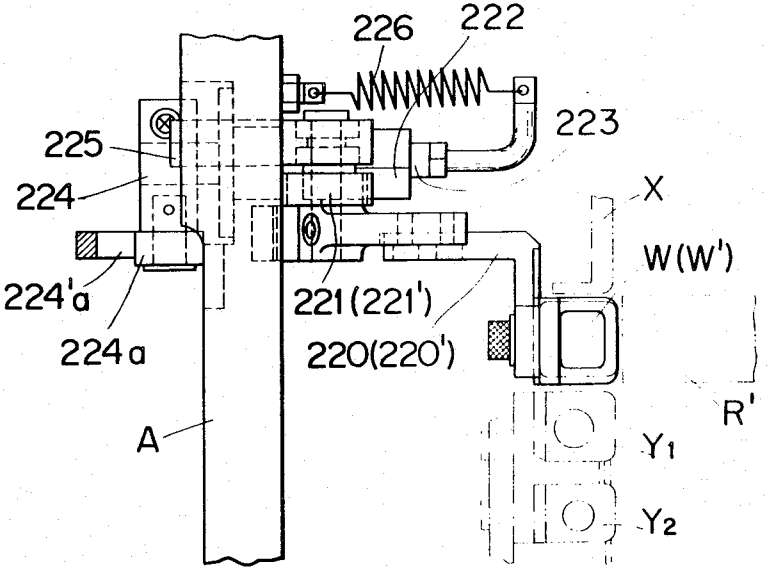
FIG. 42 is a side view of a package paper ear portions folding mechanism.
Figure 43:
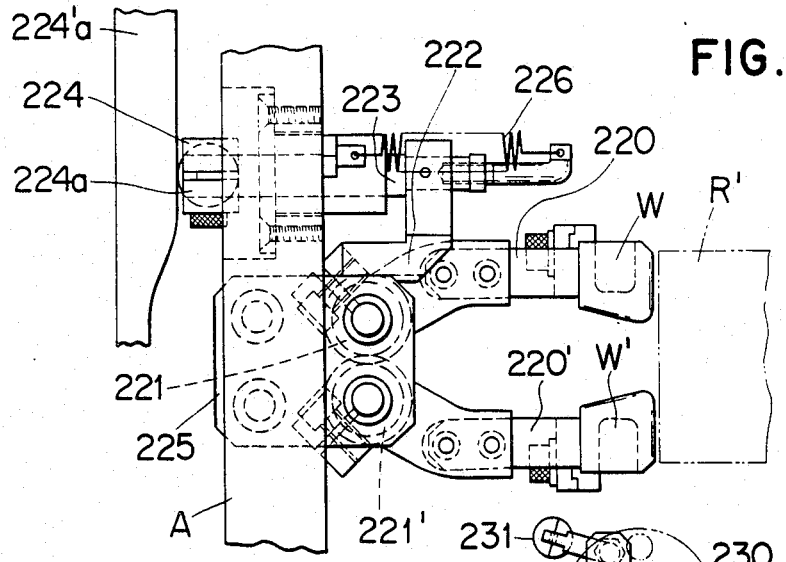
FIG. 43 is a plan view of the above.
Figure 45:
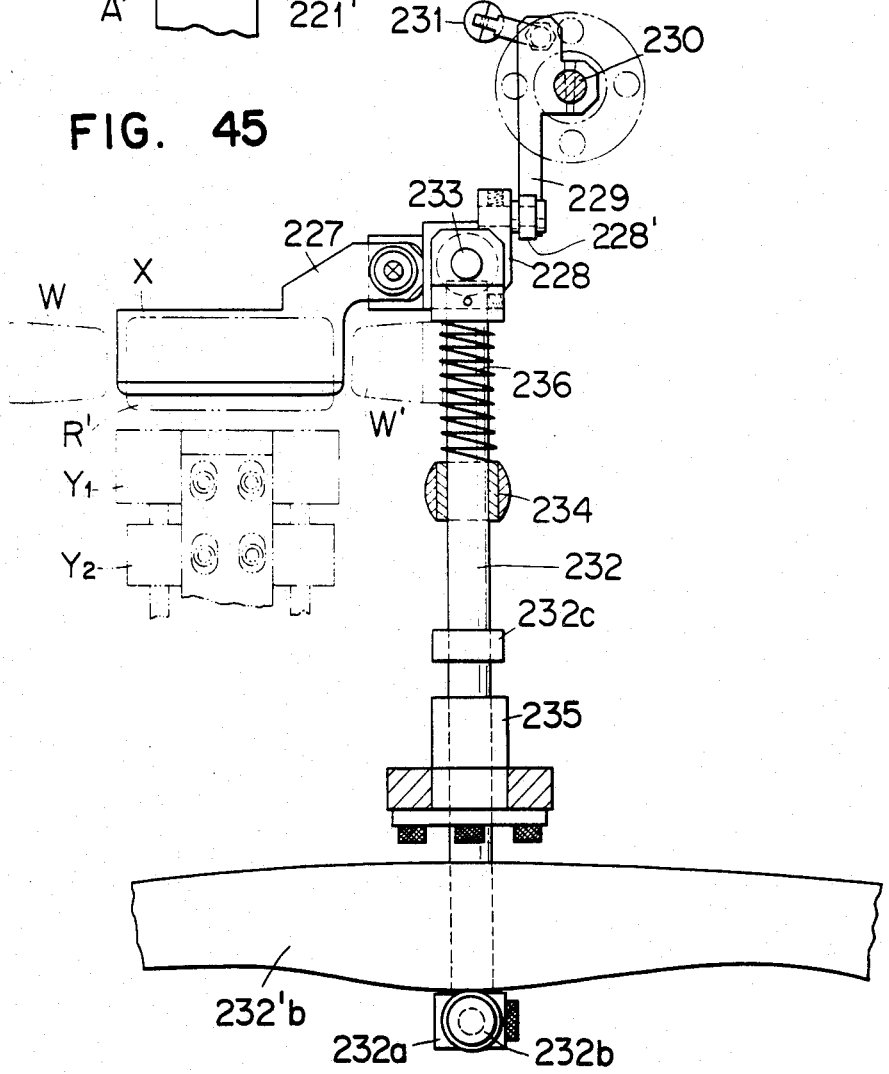
FIG. 45 is a front view of the above.
Figure 44:
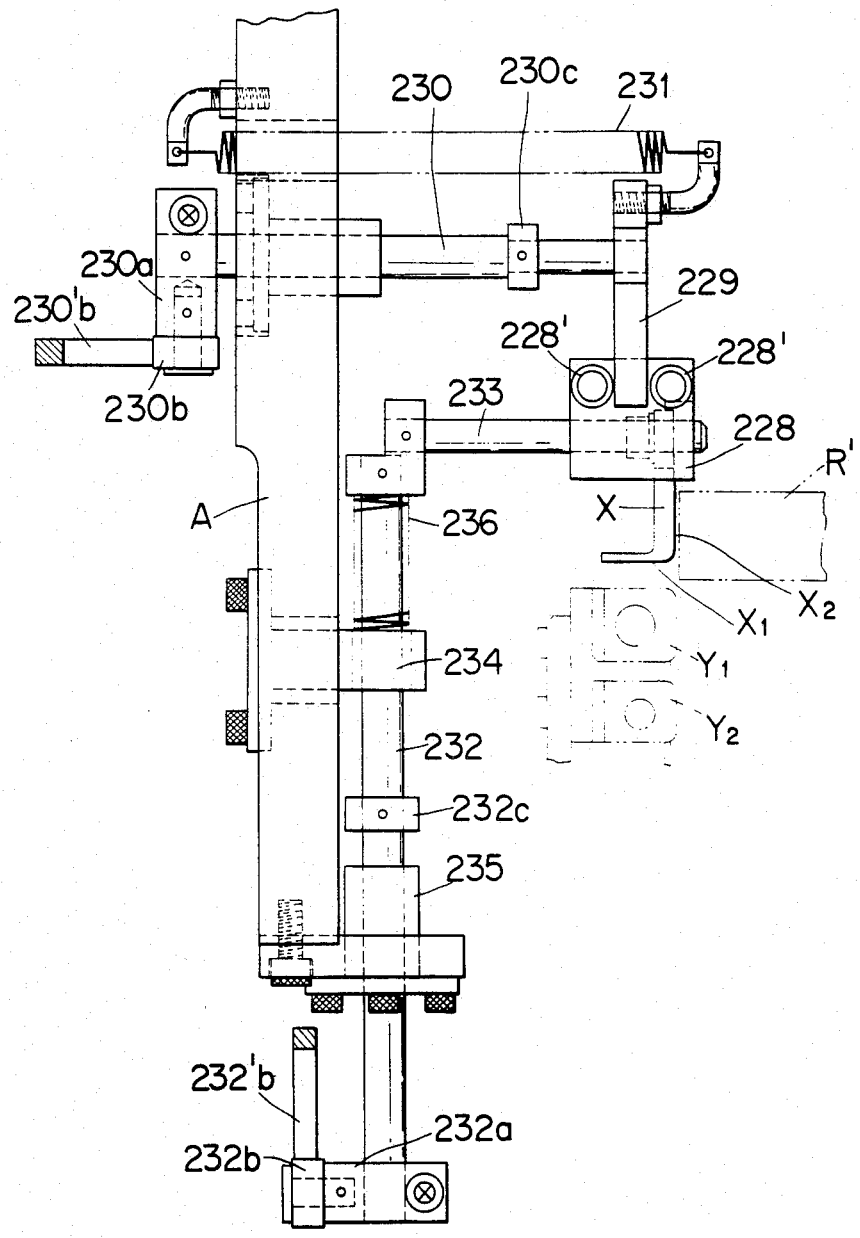
FIG. 44 is a side view of a package bottom inner flap folding mechanism.
Figure 46:
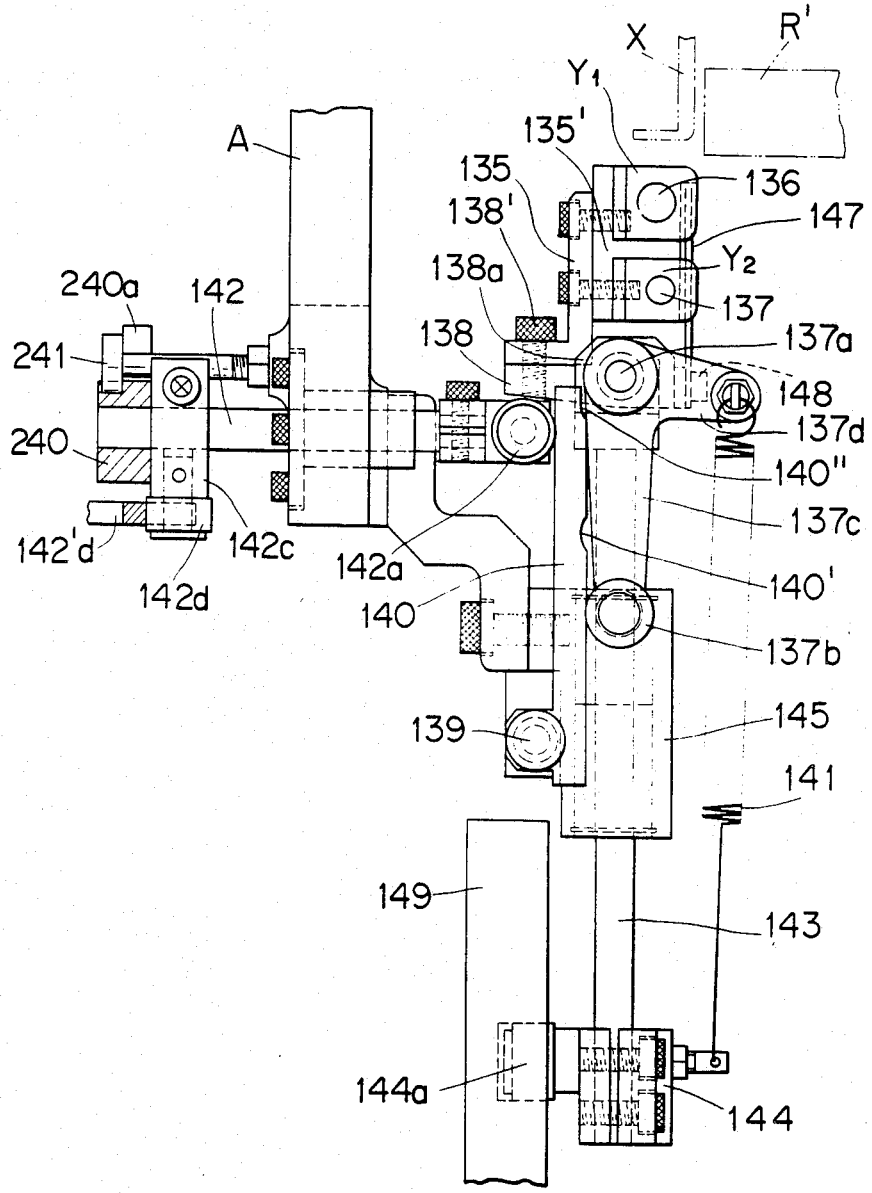
FIG. 46 is a side view of a package paper heater block and cooler block transfer mechanism.
Figure 47:
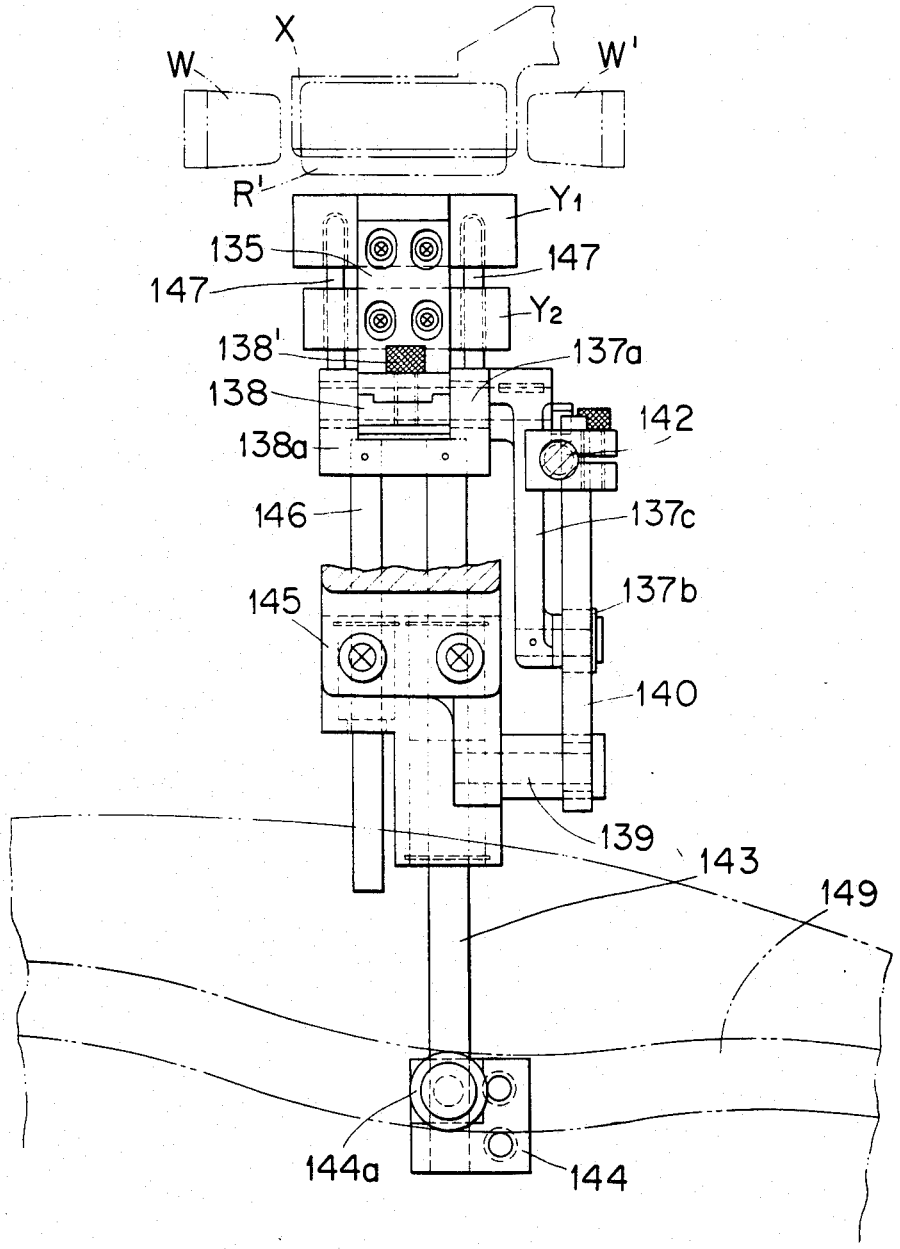
FIG. 47 is a front view of the above.
Figure 48:
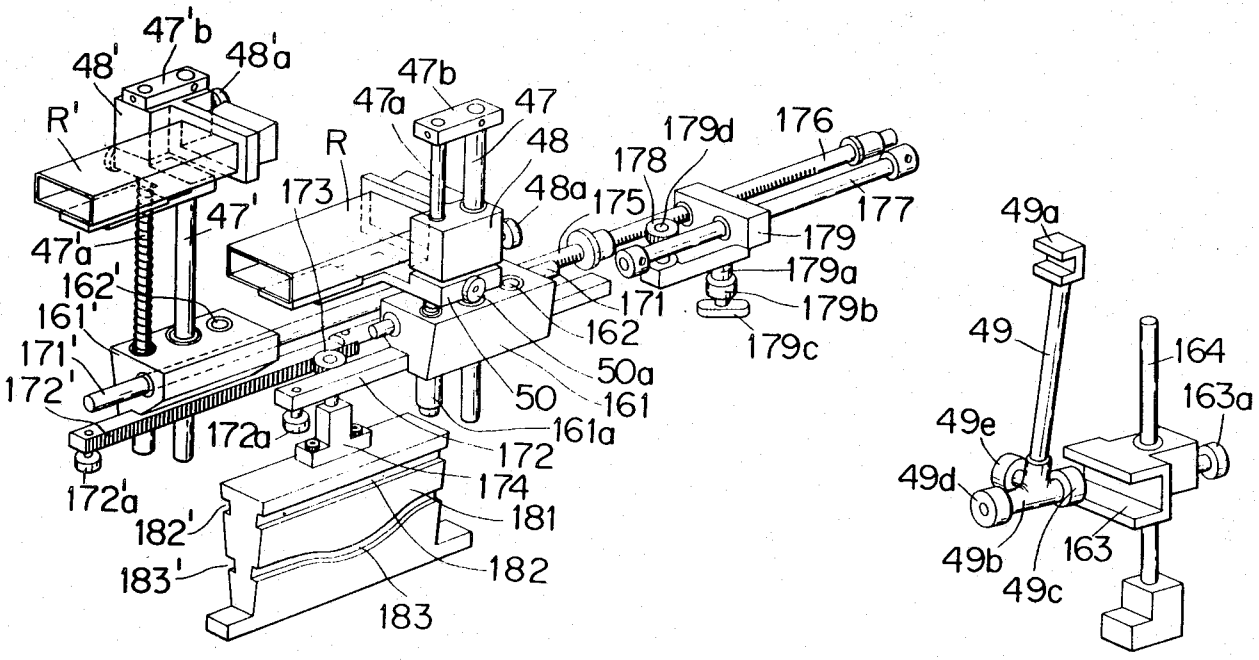
FIG. 48 is a schematic view of an arbor traveling mechanism.
Figure 49:
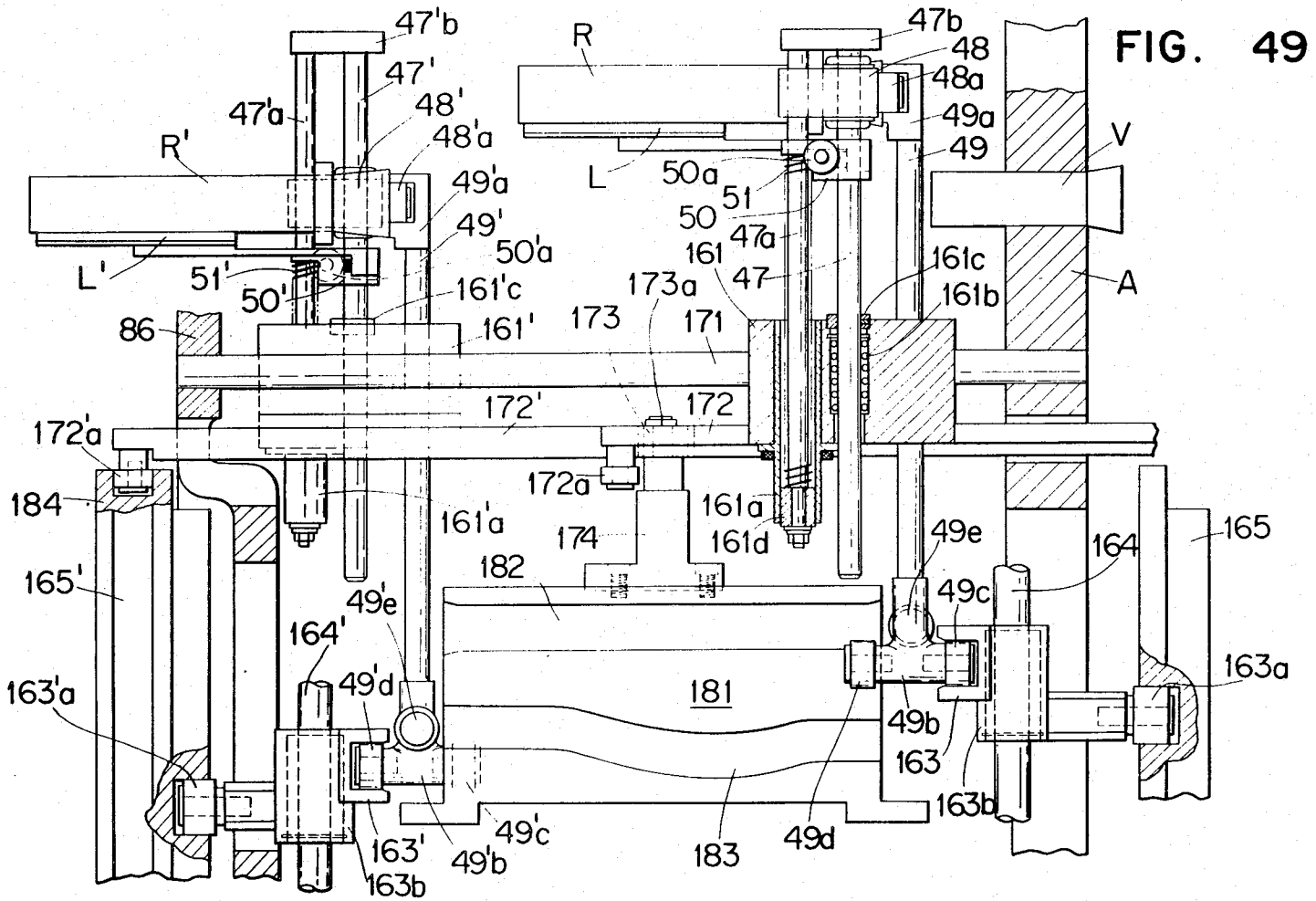
FIG. 49 is a side view of the arbor transfer mechanism.

Referring to FIGS. 20, 48 and 49, an arbor R which is positioned in the first row and an arbor R' which is positioned in the second row are representatively shown as a set or a pair arranged in tandem. One of the set of the arbors R' is supported by its supporting means from its left side as shown in FIG. 20, while the other arbor R is supported by its supporting means from its right side as shown in FIG. 20 in a symmetric manner with an arbor row shifting mechanism disposed therebetween, as will be described later. Said set of arbors R and R' are positioned on a same plane in the radial direction. However, the height of the positions thereof are optionally selected separately. Therefore, regarding the set of arbors R and R', if the structure of either one of the arbors, for example, the arbor R on the first row for folding the aluminum foil is understood, the structure of the other arbor R' having a similar structure will be understood.

Referring to FIGS. 20, 48 to 54, 65, 66 and a slide block 48 integrally supporting the arbor R is mounted on shafts 47 and 47*a* disposed in the radial direction of the packing drum A in such a manner as that the block 48 is slidable in the radial direction (i.e. vertical with respect to the drawings) but not pivotable therearound. Another slide block 50 intergrally supporting a seal clamp L is also mounted on the shafts 47 and 47*a* in such a manner as that the block 50 is slidable in the radial direction (i.e. vertical with respect to the drawings) but not pivotable therearound. The slide block 48 is provided with a cam follower 48*a* for moving the arbor R in the radial direction, or in an up-and-down fashion. The other slide block 50 is also provided with a cam follower 50*a* for moving the seam clamp L in the radial direction, or in an up-and-down fashion.

The shaft 47 is penetrated into a slide member 161 in such a manner as to be slidable in the radial or vertical direction through a ball-bearing 161*b*. Said shaft 47 is provided with a stop ring 161*c* secured by a screw on the intermediate portion with respect to its longitudinal direction in order to regulate the lowest height of the position of the shaft 47. Thus, the lowest height of the position of the shaft 47 is arranged to be the same level where the ring 161*c* is abutted against the slide member 161. This means that the lowest height of the arbor R is regulated in that level. The shaft 47*a* is provided at its lower end portion with a sliding-element 161*d* slidably inserted into a cylinder 161*a*, said cylinder 161*a* being penetrated into the slide member 161 and extended its length of stroke. A helical compression spring 51 is interposed between the slide block 50 and the sliding-element 161*d*. Said shaft 47*a* itself is vertically slidably penetrated into said slide-member 161. The shaft 47 and the shaft 47*a* are connected with each other at their upper ends by a connector 47*b* so that they are moved up and down simultaneously.

The movement of the shafts 47 and 47*a* which is effected in accordance with the radial or vertical movement of the arbor R will be described in detail. When the arbor R is further ascended from the position shown in the right side in FIG. 49, the connector 47*b* is pushed up by the slide block 48. As a result, the shafts 47 and 47*a* are ascended. On the contrary, when descending, the sliding element 161*d* is pushed downward by the slide block 48 through the spring 51 and the shafts 47 and 47*a* are lowered until the stop ring 161*c* is abutted against the slide member 161. The slide block 48 can be descended even further. As shown in the left side in FIG. 49, the slide block 48 is lowered by sliding down on the shafts 47 and 47*a*.

Referring to FIGS. 21 and 48 to 51, the slide member 161 is penetrated by another rod 49 in such a manner as to be slidable in the radial or vertical direction through a shaft-hole 162, and by way of a ball-bearing 161*e* and a bushing 161*f*. However, in FIG. 48, this portion is separately shown in order to avoid complicating the drawing.

Figure 50:
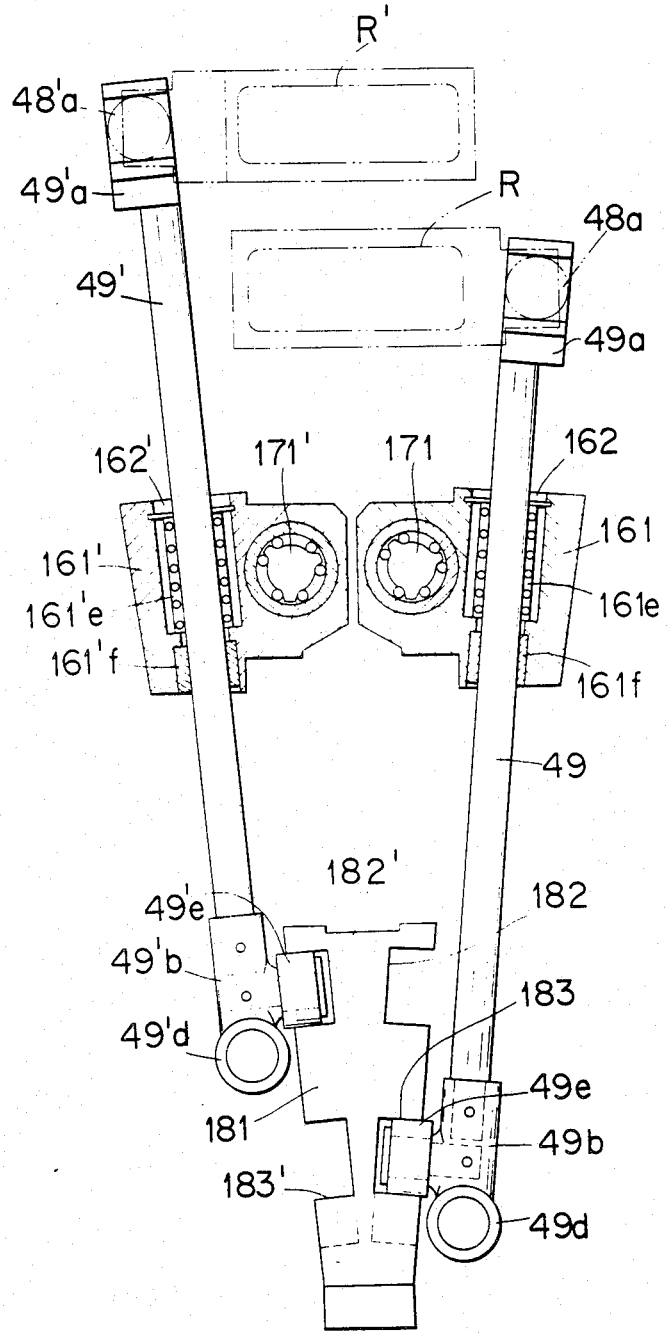
FIG. 50 is a front view of the above showing the traveling mechanism traveling along the guide block.
Figure 51:
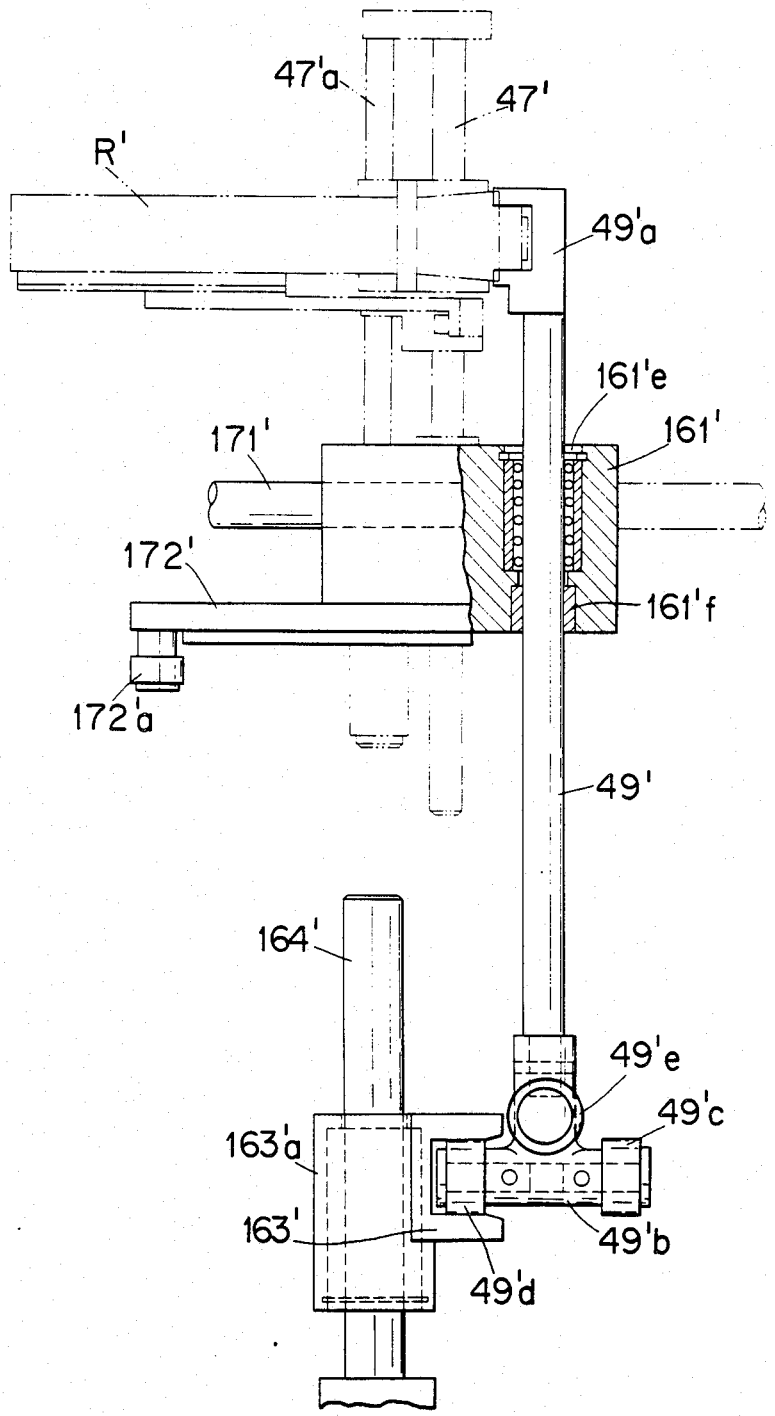
FIG. 51 is a side view of the above.
Figure 53:
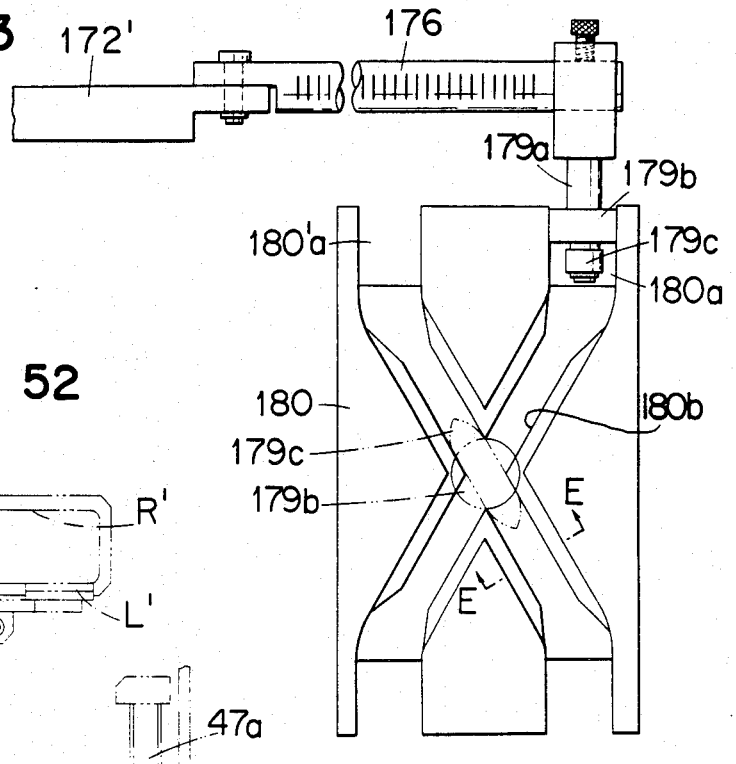
FIG. 53 is a detailed view of an arbor traveling cam drum.
Figure 52:
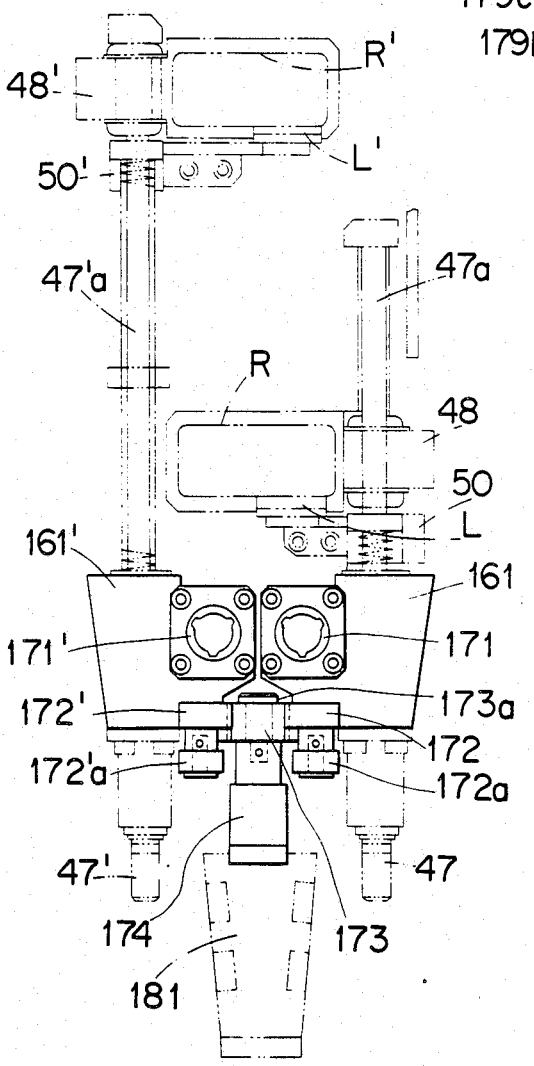
FIG. 52 is a front view of a relative motion machine accompanying the arbor traveling.
Figure 54:
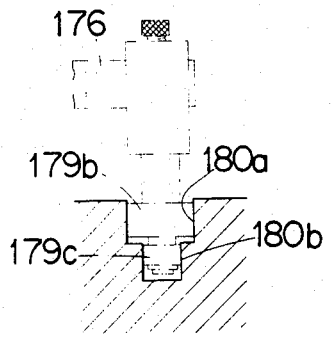
FIG. 54 is a sectional view of a cam groove taken along line E—E' of FIG. 53.

Said rod 49 is arranged eccentric with respect to the center line of the arbor R when the same is being moved toward the radial direction, but generally in the radial direction. In FIG. 50, an arrangement is made such that the center lines of the arbors R and R' are normally moved in the radial direction of the packing drum A. To this end, the actuating rods 49 and 49' are suitably disposed so that the rods 49 and 49' are engaged with the arbors R and R' at positions symmetric with respect to said center line.

At the upper end of said rod 49, a yoke-shaped actuating member 49*a* is firmly secured. Said cam follower 48*a* is engaged with the groove portion of the yoke-shaped actuating member 49*a*. The arbor R is moved in the radial direction by the radial or vertical movement of the rod 49. The rod 49 is vertically moved by means as will be described hereinafter.

At the lower end of the rod 49, a three-way shaft 49*b* is secured. At the respective ends of said three-way shaft 49*b*, cam followers 49*c*, 49*d* and 49*e* are rotatably engaged. The slide member 161 including said rod 49 is arranged movable in the axial bore horizontal direction within a space exceeding the both ends of a guide block 181 by means as will be described hereinafter. In FIG. 49, yoke-shaped blocks 163 and 163' are provided in positions opposite with respect to each other with said guide block 181 therebetween for accepting cam followers 49*c*, 49'*c* and 49*d*, 49'*d*, respectively. The yoke-shaped blocks 163 and 163' are positioned respectively adjacent the first and second arbor rows. However, in order to avoid complicating FIG. 48, only one of the cam followers 49*c* and a yoke-shaped block 163 engaging with said cam follower 49*c* are shown in FIG. 48. It should be noted, however, that a similar yoke-shaped block 163' is symmetrically provided at the left side adjacent the second arbor row for engagement with the cam followers 49*d* and 49'*d*. Refer to FIG. 49.

The cam followers 49*c* and 49′*c*, as well as 49*d* and 49′*d* are arranged eccentric in the right and left direction with respect to the moving-line of the arbors R and R′ in the radial direction. Therefore, the blocks 163 and 163′ are required to have yokes long enough to accommodate the eccentric ammount therein.

The yoke-shaped block 163 includes a block body 163*b*. At the back of the block body 163*b*, a cam follower 163*a* is axially supported for rotation. Said cam follower 163*a* is engaged with a groove cam 165 secured to the outside portion of the packing drum A for the radial movement of the arbor. Likewise, the cam follower 163′*a* axially supported by the yoke-shaped block 163′ is engaged with a groove 165′ for the radial movement of the arbor R′. The block bodies 163*b* and 163′*b* for said yoke-shaped blocks 163 and 163′ are radially slidably penetrated and supported by shafts 164 and 164′ connected to the packing drum A. However, said block bodies 163*b* and 163′*b* are arranged not to be rotatable around the shafts 164 and 164′, so that the yoke-shaped blocks 163 and 163′ are normally kept facing toward a predetermined direction.

With the above construction, the arbor R of the right side in FIG. 49 is given the height of its position in such a manner as that according to the groove cam 165 for the radial movement of the arbor R. The height of the position of the cam follower 163*a* engaging with the cam 165 is transmitted to the cam follower 48*a* which is engaged with the yoke-shaped actuating member 49*a* through the cam follower 49*c* which is engaged with the yoke-shaped block 163. The groove cam 165 is adapted to regulate the position of the arbor for the aluminum foil.

With arbor R′ of the left side of FIG. 49, the height of the position of the arbor R′ is regulated in such a manner as that the height of the position of the cam follower 163′*a* which is engaged with and guided by the groove cam 165′ adapted to move the arbor in the vertical direction is transmitted to the cam follower 48′*a* engaged with the yoke-shaped actuating member 49′*a* through the cam follower 49′*d* engaged with the yoke-shaped block 163′. Said groove cam 165′ is adapted to regulate the position of the arbor of the package-paper. The groove cams 165 and 165′ are each provided with a cut-out area on a part of the circumference so that cam followers 172*a* and 172′*a* can go in and out for regulating the position of the arbor in the horizontal direction, as will be described hereinafter.

In the same manner, the first and second rows of the arbors can be regulated, since the position of the first row is subjected to the position of each arbor, for example, the arbor R, and likewise the position of the second row is subjected to the position of each of the arbors, for example, the arbor R′. When the arbor R is on the first row because of the reason as will be mentioned later, the arbor R′ is on the second row. The arbor rows are shifted in turn, and therefore, it never occurs that both arbors R and R′ are on the same row simultaneously.

The arbors R and R′ are caused to move up and down in the radial direction, or in the radiating direction of the packing drum A. Because of the foregoing reason, the shafts 47, 47*a* and 47′, 47′*a* which are disposed parallel with respect to the above-mentioned direction are made to form a parallel movement of the shafts due to connections between the yoke-shaped actuating member 49*a*, 49′*a*, and the cam followers 48*a*, 48′*a*, although said shafts 47 and 47*a* are arranged in an inclined manner with respect to the rods 49 and 49′ which are radially arranged on the packing drum A.

Nextly, the shifting mechanism of the rows of the above mentioned arbors R and R′ will be described.

The slide member 161 for supporting the arbor R is arranged on the packing drum A and supported by a splined shaft 171 for sliding axially thereupon or in the right and left direction, said splined shaft being secured and parelleled with respect to the rotary shaft of the drum A. Furthermore, said splined shaft 171 is integrally formed with a rack 172 having a suitable length and extending in the sliding direction. Likewise, a slide member 161′ for supporting the other arbor R′ is slidably arranged on a splined shaft 171′ in the axial or right and left direction and is provided with a rack 172′. Said racks 172 and 172′ are arranged facing each other with a pinion 173 rotatably disposed therebetween.

Said pinion 173 is rotatably supported by a pinion shaft 173*a* protruded from a bracket 174 which is mounted on said guide block 181. Said guide block 181 is fixedly mounted on the packing drum A. Consequently, the movement of either one of the racks 172 and 172′ is immediately transferred to the other as a movement in the reversed direction. Consequently, the arbor R and the arbor R′ are caused to move in the reversed direction with respect to each other.

In order to ensure the afore-mentioned movement, the rack 172′ is provided with a rack 176 as its extension in a manner as to be slidable in the axial direction of the packing drum A. Said rack 176 is arranged opposite to a rack 177, and a pinion 178 is interposed therebetween.

Said rack, 177 is fixedly mounted on the packing drum A. A slide block 179 is slidably mounted on said rack 177 as its sliding shaft. Said slide block 179 is slidably penetrated by said rack 176 through its another shaft hole and supported by said both racks 176 and 177. At the same time, said pinion is rotatably supported on a shaft 179*a* extruded from the slide block 179. When the block 179 is moved, a double stroked movement is transmitted to the rack 176, since the amount of the rotary movement of the pinion 178 is added to the amount of movement of the block 179.

Furthermore, said slide block 179 is provided at this rear face with a supporting shaft 179*a*, on which a cam follower 179*b* is rotatably mounted. The groove cam 180*a*, to which said cam follower 179*b* is engaged, is provided on the cylindrical periphery of a cam drum 180 fixedly secured to the outside portion other than the main body of the packing drum A. The groove cam 180*a* is of the type used for a reciprocating operation; two cam grooves 180*a* and 180′*a* are defined on the cam face in such a manner as that the grooves are run in parallel and crossed at one place to form the shape of the FIG. 8. The space between the two grooves 180*a* and 180′*a* is served to regulate the rotary positions between the arbor R and the arbor R′. In other words, the position of the first row of the arbors for aluminum foil and the position of the second row of the arbors for package paper are regulated by said space, or because of the presence of said space. Said space is reduced in dimension corresponding to the double stroke produce by the above-described rack means. In order to facilitate the smooth movement of the cam follower 179*b* at the crossing portion of the first cam groove 180*a* and the second cam groove 180′*a*, a narrow and extended boat-shaped sliding element 179*c* is provided for rotation under the cam follower 179*b* mounted on the slide block 179. In addition, a narrow groove 180*b* is formed in the groove cams 180*a* and 180'*a* in order to guide the boat-shaped sliding element 179*c* into the crossing portion.

At the other ends of said racks 172 and 172', cam followers 172*a* and 172'*a* are mounted. Said cam followers 172*a* and 172'*a* are engaged with and guided by a cam groove secured to a portion other than the main body of the packing drum A and formed in a cutted annular configuration, so that said end portions can be stably supported and the axial position of the arbor R' is stabilized.

A guide block 181 is firmly secured on the packing drum A, and formed with cam grooves thereupon in order to guide the shifting of the arbors R and R'.

Said guide block 181 is provided with cam grooves 182, 183 and 182', 183' on the both side faces thereof extending in the direction of the rotary shaft of the packing drum A. Said cam grooves 182 and 182' are formed in parallel with respect to each other at positions with the same height or radial distance from the rotary shaft of the packing drum A. Also, the cam grooves 183 and 183' are formed parallel with respect to each other at positions with the same height, but beneath the cam grooves 182 and 182'.

According to the preferred embodiment shown in the drawing, the line shapes of these cam grooves are shown as horizontal linear shapes for 182, 182', and as arcuate shapes for 183, 183'. However, other suitable shapes may be selected depending on the circumstances.

A cam follower 49*e* is operatively connected to the arbor R in the aluminum foil row. Said cam follower 49*e* is engaged with cam groove 182, and guided from the right to the left in the drawing. That is, the arbor R is guided to the package-paper row from the aluminum foil row. Also, a cam follower 49'*e* is operatively connected to the arbor R' in the package-paper row. Said cam follower 49*e* is engaged with cam groove 183', and guided from the left to the right in the drawing. That is, the arbor R' is guided to the aluminum foil row from the package-paper row. When arbor R is in the package-paper row and is to be guided from left to right to the aluminum foil row with arbor R' making a reciprocal movement from the aluminum foil row to the package-paper row, the cam follower 49*e* of arbor R engages cam groove 183 and the cam follower 49'*e* of arbor R' engages cam groove 182'.

When the arbor R and the arbor R' are moved in the opposite direction with respect to each other, it is required to differentiate the height of the positions of the arbors R and R' in order to avoid collision, since they are on the same axis in the radial direction of the packing drum A. To this end, said cam grooves 182 and 183, or 182' and 183' are deliberately formed with respect to each other.

It is important to know that a strict structural relation must be established between the guide block 181 and the yoke-shaped blocks opposite with respect to each other provided at its both sides. When the arbor R is in the aluminum foil row, said cam follower 49*e* is engaged with none of the cam grooves 182, 183, on the guide block 181. Likewise, when the arbor R' is in the package-paper row, the cam follower 49'*e* is engaged with none of the cam grooves on the guide block 181. As shown in FIG. 49, the guide block 181 is required to be positioned away from the yoke-shaped blocks 163 and 163'. The distance between the two is required to be at least the diameter of the cam followers 49*e* and 49'*e*. When the cam follower 49*e* is brought to be engaged with the cam groove 182 for guiding the arbor R to its shifted position, the cam follower 49*c* is not yet disengaged from the yoke-shaped block 163. As the engagement between the cam follower 49*e* and cam groove 182 is progressed, the cam follower 49*c* is gradually disengaged from the yoke-shaped block 163. As a result, the arbor R is shifted from the aluminum foil row to the package-paper row. When the cam follower 49*e* is still engaged with cam groove 182 at the edge of the exit thereof, the cam follower 49*d* begins to engage with the opposing yoke-shaped block 163'. After a while, the cam follower 49*e* is released from the cam groove 182. Also, the arbor R' is guided to the aluminum foil row from the package-paper row in the same manner.

That is, when the arbor R' is in the package-paper row, the cam follower 49'*e* is engaged with none of the cam grooves 182',183'. In the initial stage of guiding, when the cam follower 49'*e* begins to engage with cam groove 183', the cam follower 49'*d* is not disengaged from the yoke-shaped block 163'. As the engagement between the cam follower 49'*e* and said cam groove is progressed, the cam follower 49'*d* is gradually released from the yoke-shaped block 163'. As a result, the arbor R' is shifted from the package-paper row to the aluminum foil row. When the cam follower 49'*e* is still engaged with cam groove 183' at the edge of the exit thereof, the cam follower 49'*c* begins to engage with the opposing yoke-shaped block 163. After a while, the cam follower 49'*e* is released from cam groove 183'.

Said yoke-shaped block 163 can be guided to the position with the same height of the positions of said groove cams 182, 182' and 183, 183' by a groove cam 165 through a cam follower 163*a*. Likewise, the yoke-shaped block 163' can be brought to that position by a groove cam 165' through a cam follower 163'*a*.

With the above constitution, the arbor R which is in, for example, an aluminum foil row is guided by the cam groove 165 adapted to move the aluminum foil arbor up and down. During the up and down movement of the arbor transmitted from the cam follower 49*c*, it is subjected to the folding operation of the aluminum foil, as already described above. After the folding of the aluminum foil, the arbor R is shifted to the package-paper row according to the row crossing movement of the cam follower 179*b* guided by the cam drum 180, and simultaneously the arbor R' which is arranged in tandem is shifted to the aluminum foil row from package-paper row. When the above-mentioned shifting movement is effected, the arbors R and R' can travel on the same radial plane of the packing drum A by differentiating the height of positions thereof. After the arbor R is moved to the package-paper row, it is subjected to the folding operation of the package-paper as already described in the foregoing.

In the meantime, the arbor R' which is moved to the aluminum foil row is subjected to the receiving operation of the cigarettes piled up in the form of predetermined layers.

As mentioned above, two rows of circumferentially spaced arbors, i.e., one for aluminum foil and the other for the packing paper, are formed on the packing drum A, the aluminum foil row is axially spaced from the package-paper row, and the arbors R and R' are arranged in tandem thereon. The respective arbors can be moved in the radial direction guided by the cam 165, through the rod 49 axially supported by the block 161. On the lower end of the rod 49, the three-way shaft 49*b* and the cam followers 49*c*, 49*d* and 49*e* are provided, and the arbor is guided in such a manner as that when it is in the aluminum foil row, it is engaged with and guided by the cam 165 adjacent the aluminum foil row through the cam follower 49*c* in the radial direction, and when it is in the package row, it is engaged with and guided by the cam 165' adjacent the package-paper rwo through the cam follower 49*d* in the radial direction. The arbors R and R' constituted similarly are arranged as one set, and the racks 172 and 172' is integrated with the blocks 161, 161' supporting the respective arbors R and R' are arranged to effect a relative movement through the pinion 173. When the relative movement is effected, the arbors R and R' are guided by the cam grooves 182 and 183' through the cam followers 49*e* and 49'*e* at predetermined radial positions as shown in FIG. 49 on exclusive one way paths. The arbors R and R' thereby shift their tandem arrangement in the described manner.

Referring to FIGS. 55, 56 and 57, there are schematically illustrated therein the process of the cigarette packing machine which the present invention intends, from the flow of cigarettes in the packing process till the cigarette inserting process inserts cigarettes into the bags which are shaped in the intermediate bag making and/or shaping process using packing materials. In the drawing, after the cigarettes are taken out of a hopper, they are piled up in three layers consisting of 20 pieces in total and transferred as a cigarettes group 191 which are inserted into a double bag shaped by a packing drum A according to the present invention.

As shown in the drawing, the packing drum A includes a first arbor row $A_0$ for winding and folding the aluminum foil P on the surface of the arbors R and a second arbor row $A'_0$ for winding and folding the package-paper Q thereupon. According to the stage numbers progressing counterclockwise, a bag shaping operation is effected in a consecutive manner. However, the aluminum suction ring B and package-paper suction ring C for feeding packing materials are not illustrated. Instead, processing of the packing materials on the surface of the arbors R and R' is shown.

As already mentioned in the foregoing, a number of cam devices are employed for making and shaping the double bags. Representative embodiments of such cam devices are shown in FIGS. 59, 60, 61 and 62. It should be understood, however, that the cam devices are not limited to those shown in the above figures but that many other disc cams may also be jointly employed.

From stage numbers S3 to S9, the aluminum suction ring B serves to carry the aluminum foil P and bring it to a predetermined position opposite the arbor R. The pivotal movement of the aluminum suction ring B is transmitted by the groove cam 26'*b*.

The arbor R is transmitted by the groove cam 165 and kept ascending from a remote position towards the peripheral direction after S8. Between S10 and S11, the aluminum foil P is pressed by the bottom clamp F and the provisional folding is effected by the guide walls 2*c* and 3*c*. At S13, it is pushed into the U-clamp G for the body folding in the shape of "U". Succeedingly, the bottom inner flap $P_1$ is folded by the bottom inner flap folding claw H. The plate cam 35 is provided in order to regulate the suction of the suction ring B.

After S13, the folding claw starts the closing operation. At S14, the body inner flap $P_2$ is folded by the claw I. The folding claw J starts operation after S14 and the body outer flap $P_3$ is folded by the claw J at S15. The plate cams 8 and 9 for said operations are shown.

At S17, the body seaming is maintained by the seam-clamp L. Said seam-clamp L is moved by the groove cam 54.

After S18, the bottom outer flap folding claw K is moved forward. After S19, the arbor R is descended. Because of the relative operation with the claw K, the bottom outer flap $P_4$ is folded.

Between S22 and S1, the arbor R is moved to the second arbor row $A'_0$. In turn, the arbor R' is moved to the first arbor row $A_0$ from the second arbor row $A'_0$. During this period of time, the arbor change, or positional shifting of the arbors is effected. The arbor R is which is moved to the second row $A'_0$, is subjected to the winding and folding operation of the package paper on the aluminum foil P. The arbor in the above row is distinguished from the other by assigning a character "R'" just for convenient in description.

The package paper suction ring C, which is in the second row for feeding the package paper Q, functions to carry the package paper Q between S19 and S1 and brings it to a predetermined position opposing the arbor R'. The pivotal movement of the suction ring C is controlled by the groove cam 120, and a plate cam 35' is provided for regulating the suction.

After S1, the arbor R' is controlled by the groove cam 165' and ascended in the peripheral direction from the remote position. At S2, the package paper Q is pressed and contacted by the bottom clamp F', and provisionally folded by the guide walls 56*d* and 57*d*. At S3 and S4, it is pushed into the U-clamp G' and the body folding in the shape of a "U" is effected. Said bottom clamp F' is controlled by the groove cam 68.

Subsequently, the aluminum main presser M is actuated by the plate cam 83 in order to maintain the folded aluminum P and to prevent its loosening. Simultaneously, the seaming clamp L' is moved by the groove cam 54' and released from the aluminum seam. Also, the guide wall 57*d* is caused to be moved away outwardly by the plate cam 62.

After S4, the plate cam 63 starts the closing operation. At S5, the body portion hung down due to the folding claw I' is folded and maintained by the seaming claw L' at S6. Thereafter, the holding of the aluminum main presser M is released, and the folding claw I' is returned. Said aluminum main presser M is moved by the plate cam 83.

Between S6 and S7, the arbor R' starts descending together with the bottom clamp F' and the seaming clamp L'. Between S8 and S9, it is engaged with the guide wall 57*d* for folding the body outer flap $Q_2$. Subsequently, the arbor R' is contacted with the heater block N, between S9 and S1, which was progressed and waiting at S6. Furthermore, it is contacted with the cooler block O between S11 and S21 for completing the body adhesion.

Said heater block N and the cooler block O are controlled by the plate cam 96 and groove cam 99'*a*, respectively.

Following the body adhesion, the package paper bottom supporting clamp T which is contrarotated and ascended by the plate cam 219 is inserted into the arbor R' by the groove cam 213*b* at S14, so that it can serve as a supporting table when the package paper is folded.

At S14, the package paper bottom ears Q3 are folded by the folding claws W and W'. At S15, the package paper bottom inner flap $Q_4$ is folded by the folding claw X. At S16, the package paper bottom outer flap $Q_5$ is folded by the heater block $Y_1$. Said folding claws are controlled by the plate cam 224'a. Said folding claw X is controlled by the plate cams 230'b and 232'b. Said heater block $Y_1$ is controlled by the groove cam 149.

The package paper bottom folding portion is contacted with the heater block $Y_1$ between S16 and S18, and contacted with the cooler block $Y_2$ between S18 and S21, so that the adhesion of the bottom folding portion is completed.

Between S22 and S1, the arbor change take place, as already mentioned. According to the arbor change, the arbor R' covered with the double bag with its one end portion closed is moved toward the first arbor row. As shown in the drawing between S1 and S5, in the first arbor row, the ejector rod 193 which is prepared beforehand is moved by the winding and ejecting cam 194 for inserting the groups of cigarettes into the arbors R. Then, the arbors R with said double bags containing the cigarettes are ejected or extruded into the receiving drum (not shown) on the next step.

The state of the extruded packed goods is shown on the extension line of the stages between S5 and S9.

Figure 58:
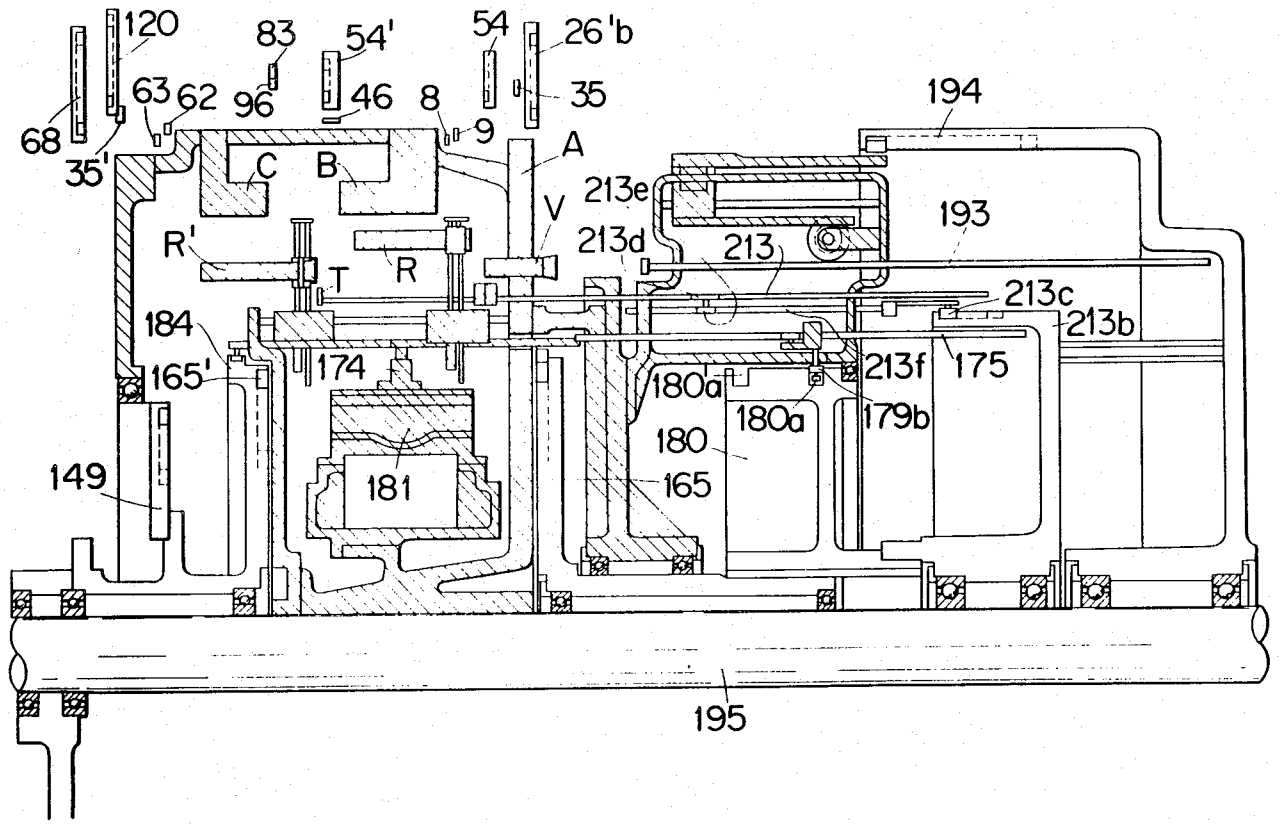
FIG. 58 is a schematic sectional view of a packing drum device taken on its rotary axis line.
Figure 60:
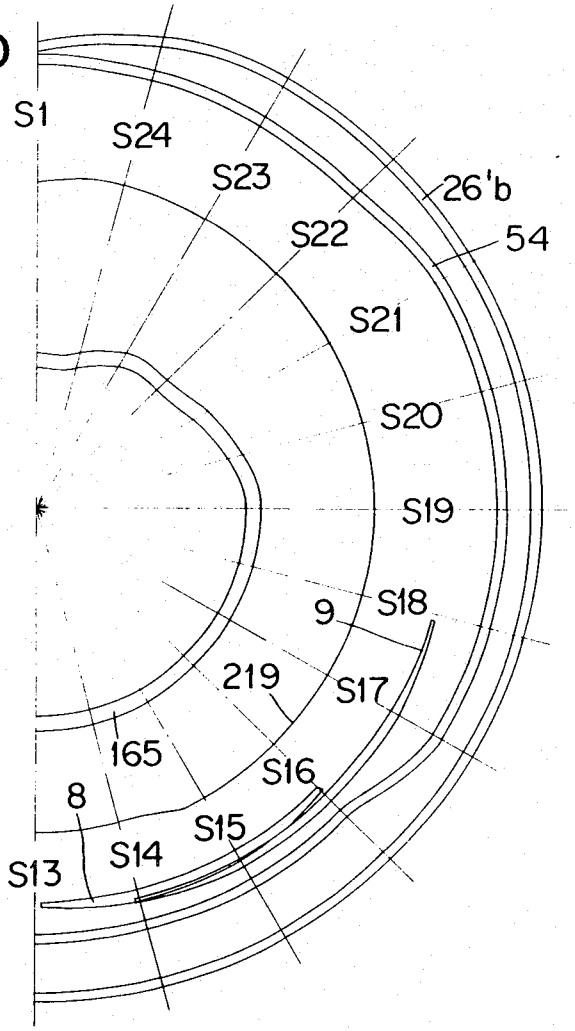
FIGS. 59 and 60 are a front view of an aluminum foil cam divided into two portions along the meridian just for convenient purposes.
Figure 59:
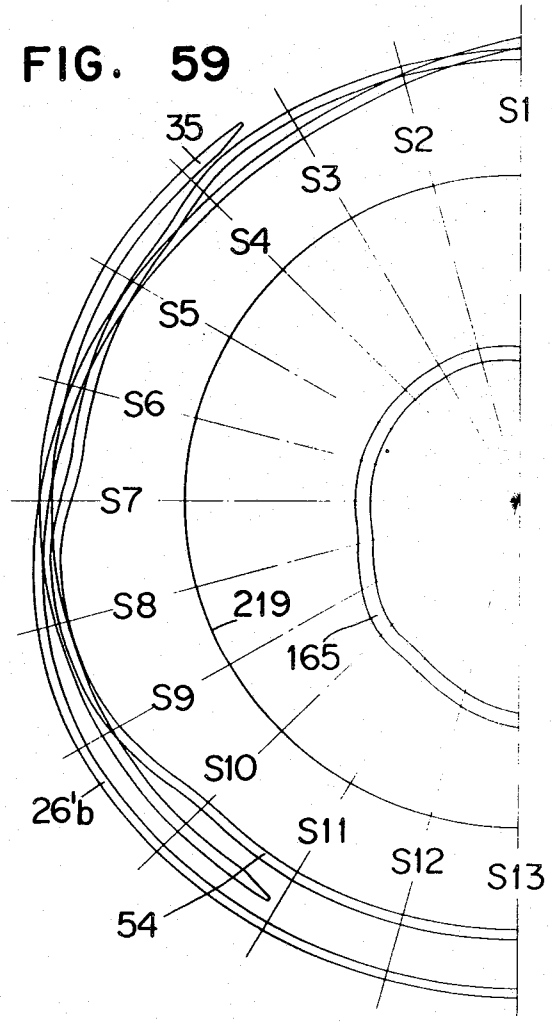
Figure 62:
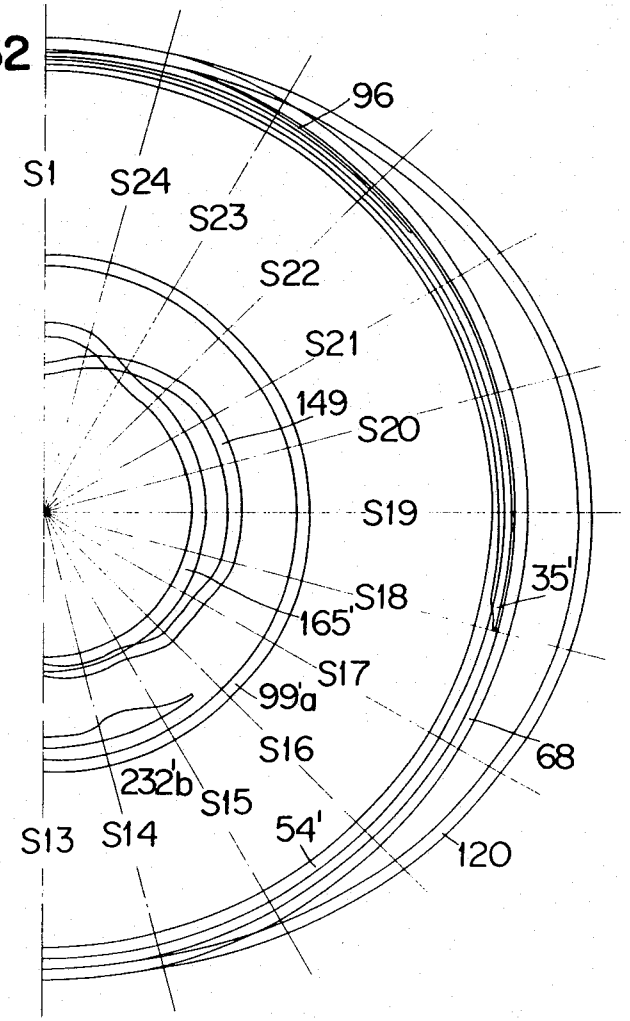
FIGS. 61 and 62 are front views of a package paper folding cam which is divided along the meridian just for convenient purposes.
Figure 61:
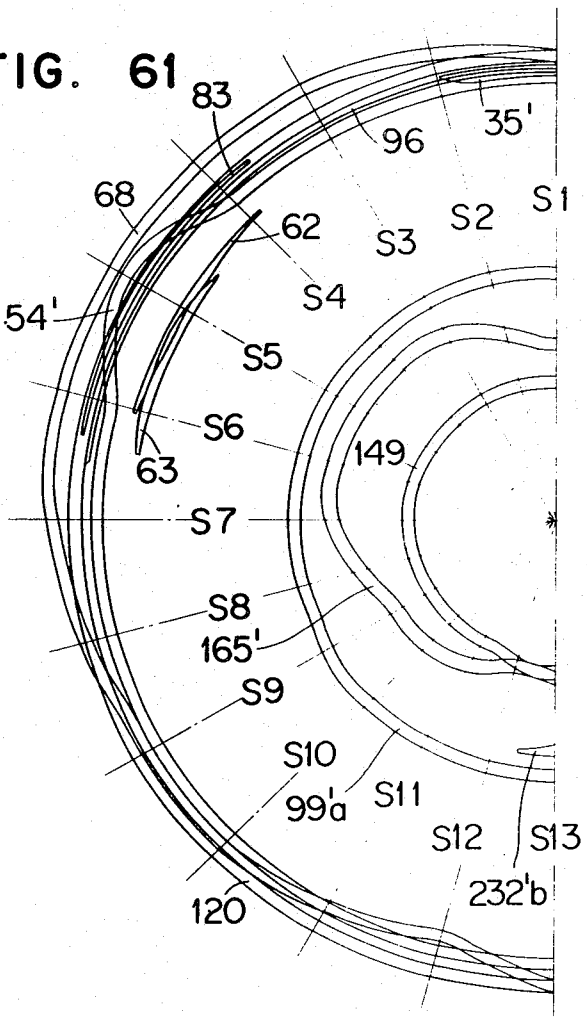
Figure 63:
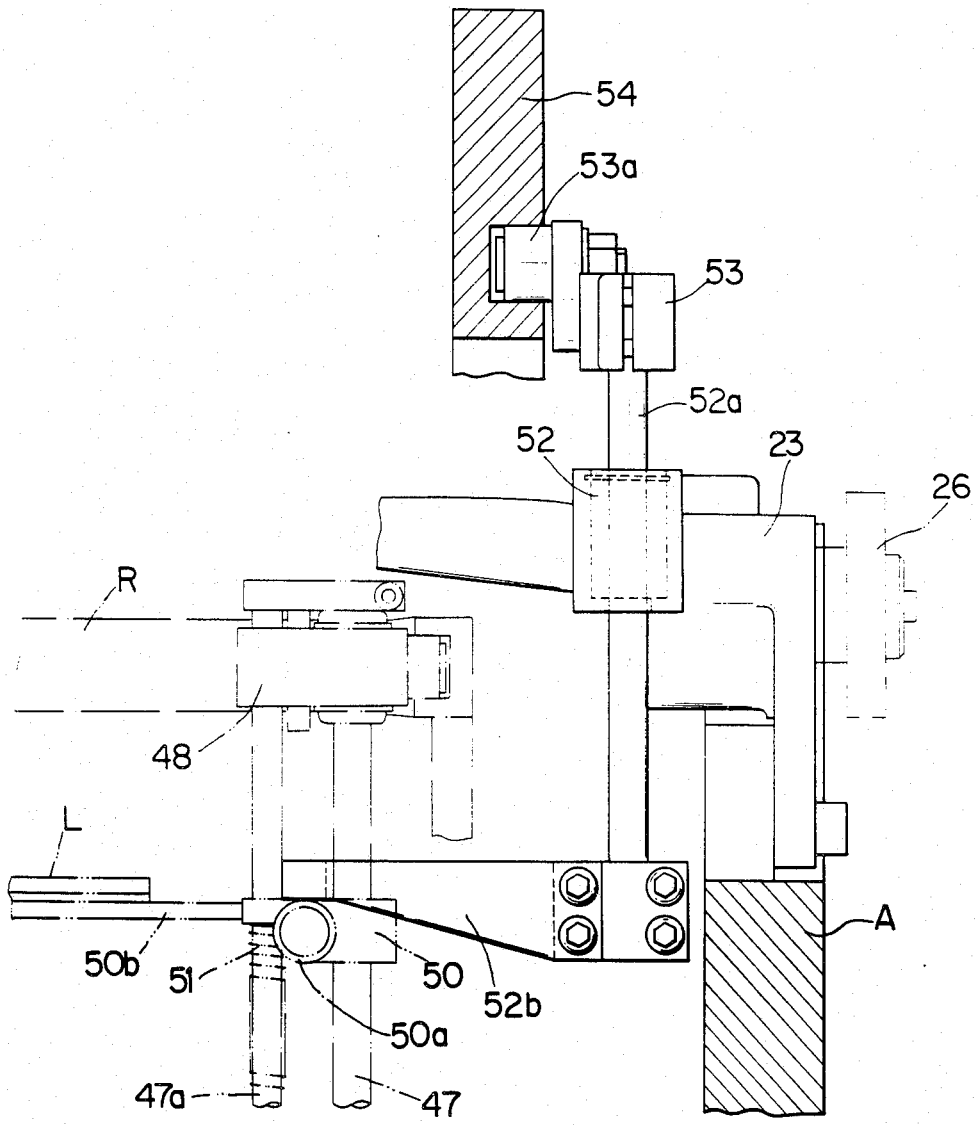
FIG. 63 is a side view of a seaming clamp driving mechanism for the aluminum foil.
Figure 64:
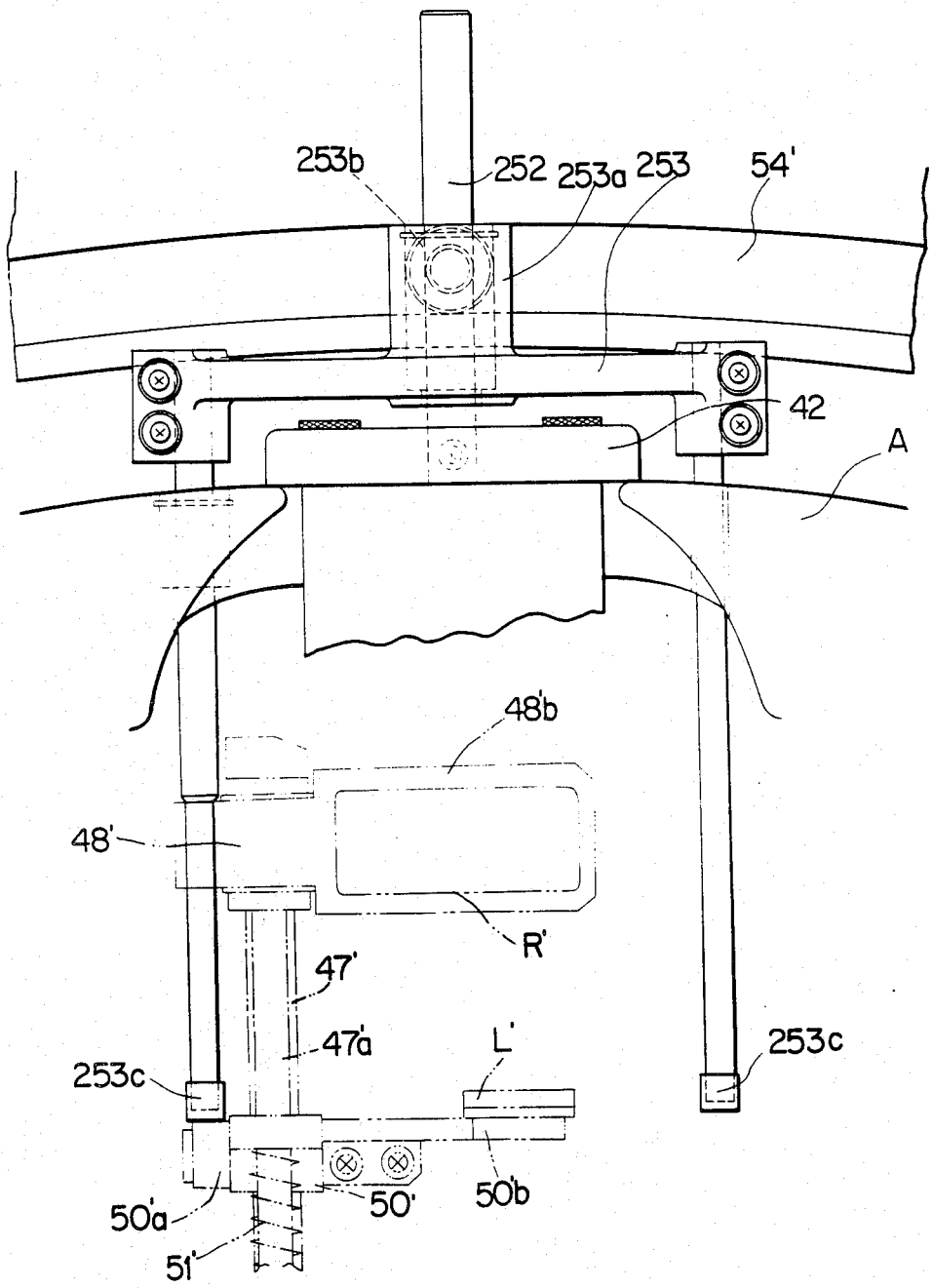
FIG. 64 is a front view of a seaming clamp driving mechanism for the package paper.
Figure 65:
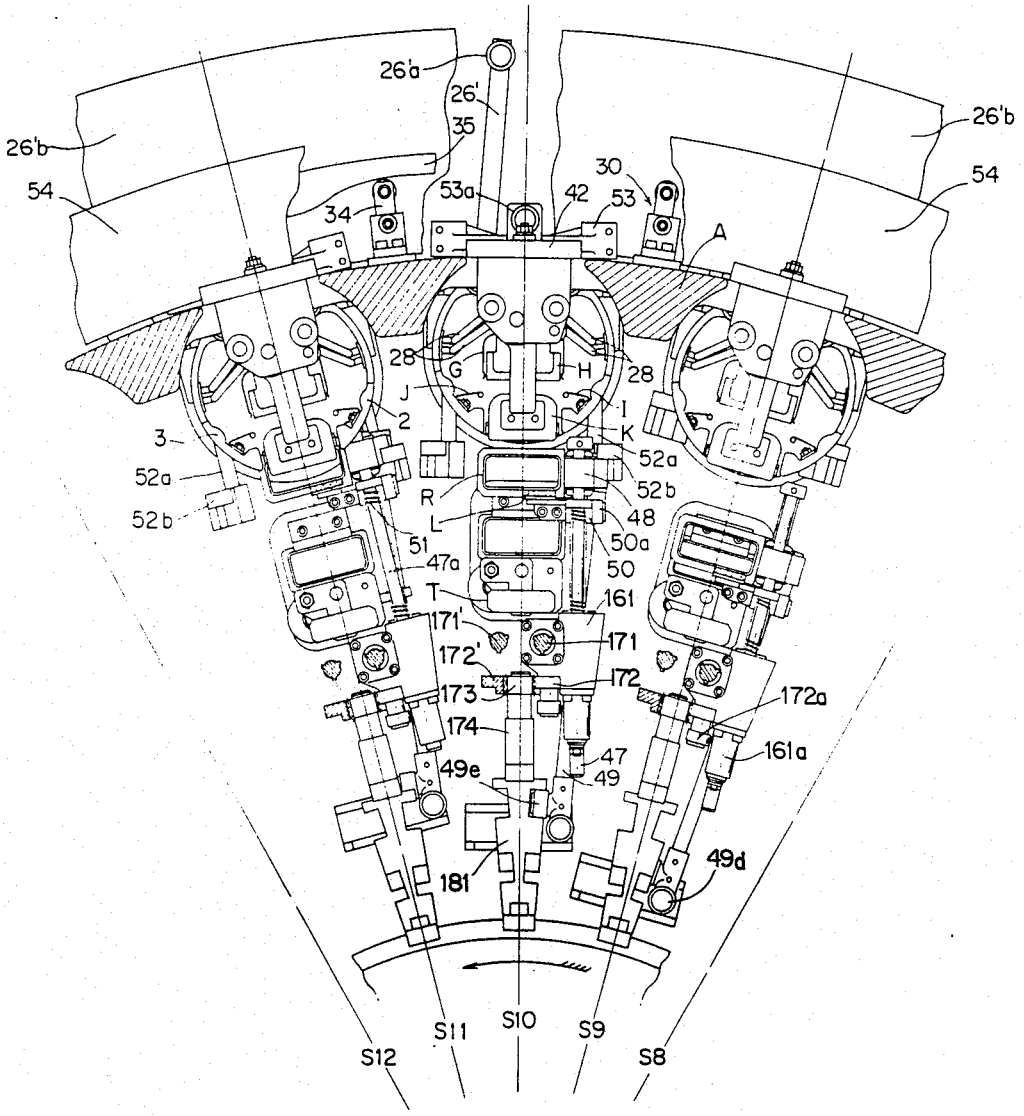
FIG. 65 is a front view showing only one eighth divisions of the full circumference of a packing drum in the aluminum bag forming row of arbors and eliminating other portions.
Figure 66:
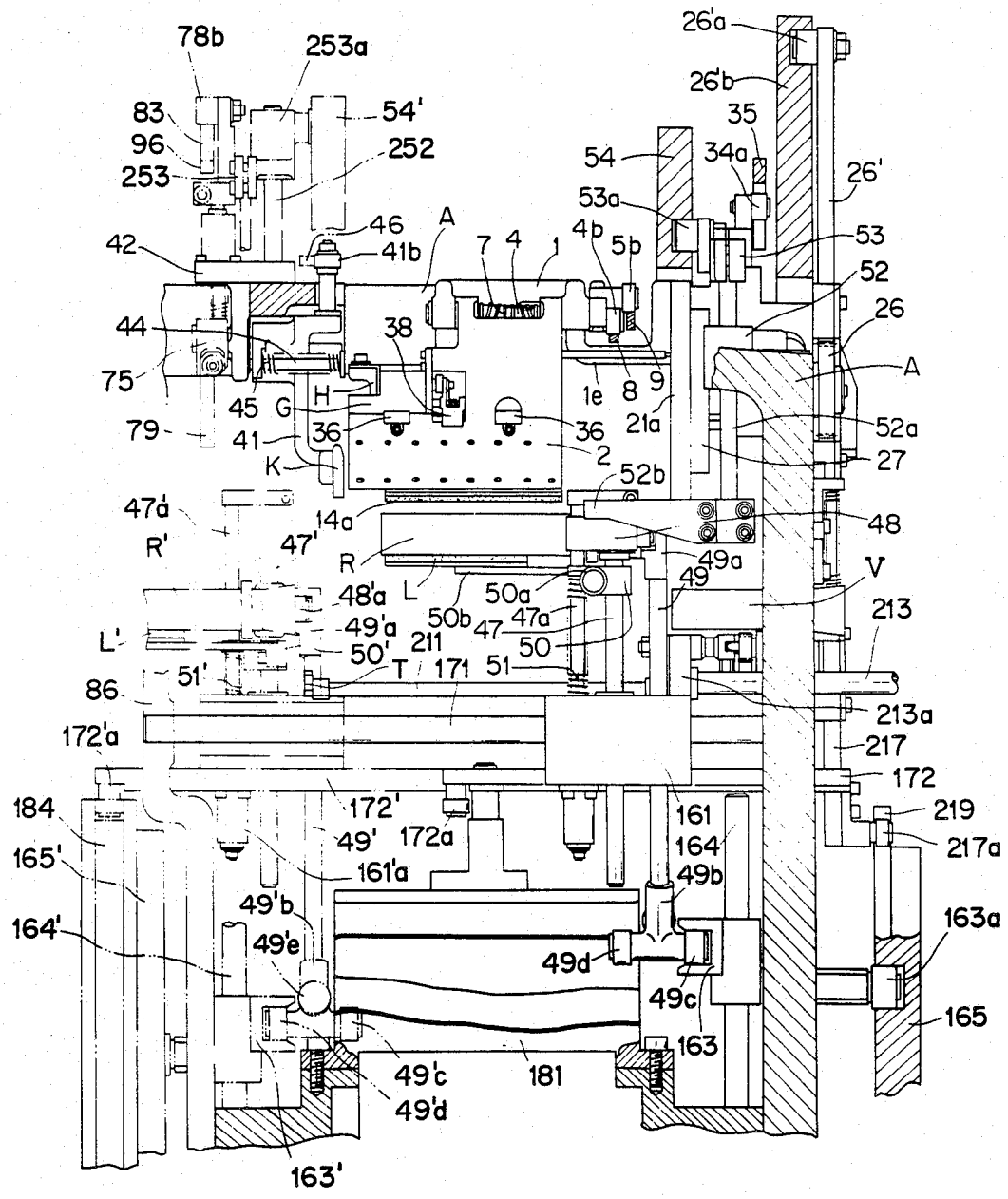
FIG. 66 is a side view of one stage division of the above.
Figure 67:
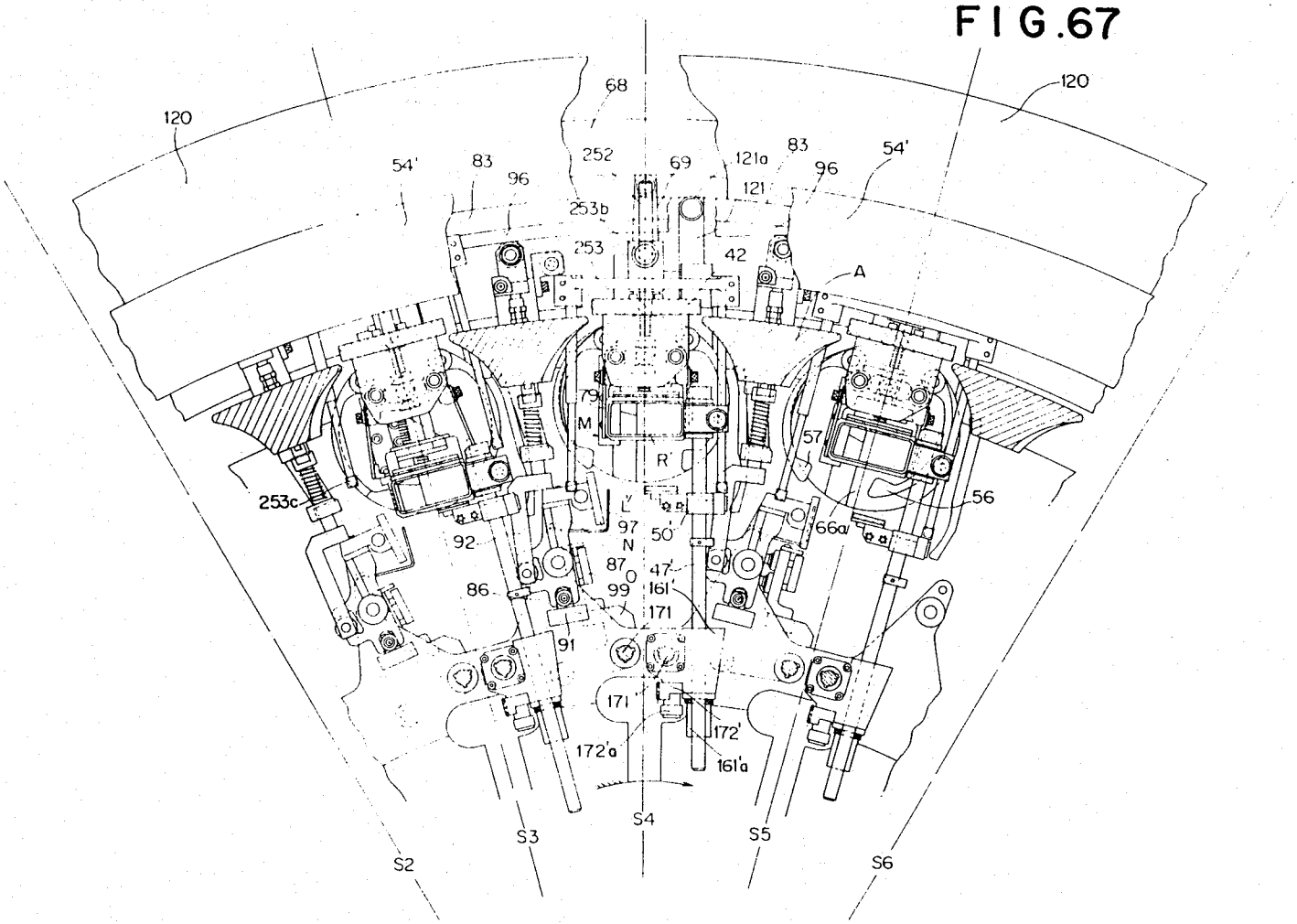
FIG. 67 is a rear view showing only one eighth divisions of the full circumference of a packing drum in the package paper bag forming row of arbors and eliminating the other portions.
Figure 68:
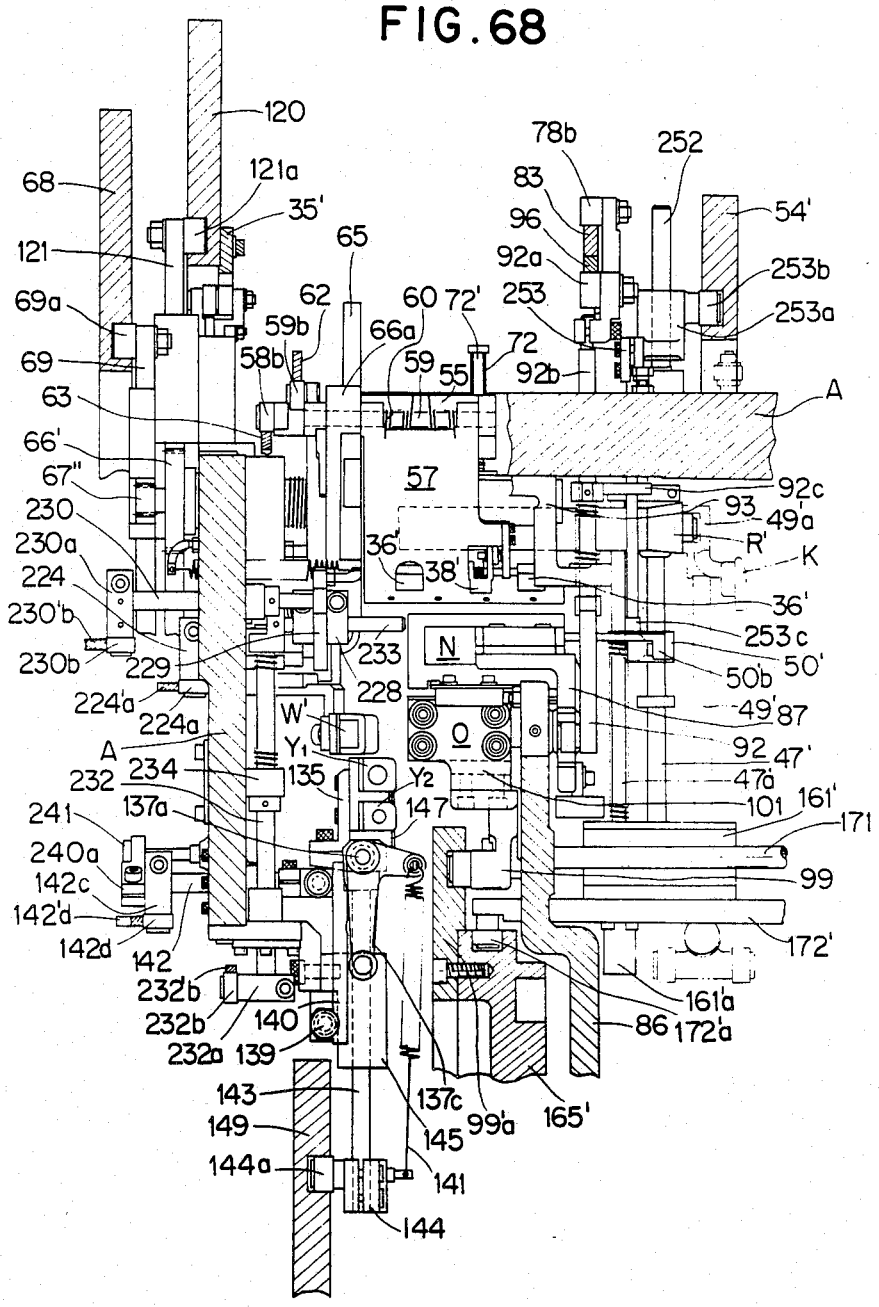
FIG. 68 is a side view of one stage division of the above.
Figure 69:
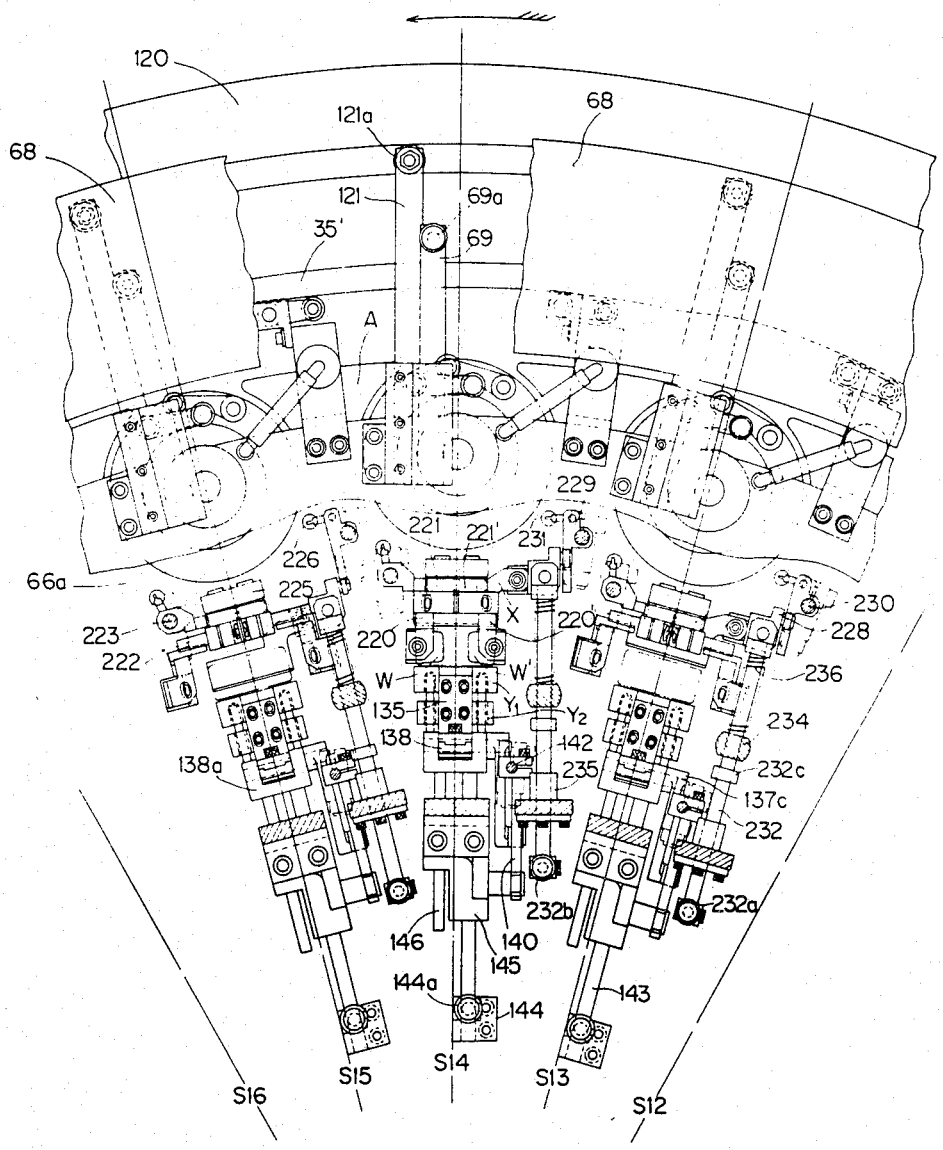
FIG. 69 is a front view showing only one eighth divisions of the full circumference of the package paper bottom folding device arranged on the packing drum and eliminating the other portions.

In FIG. 58, there is schematically illustrated the sectional view of a packing drum device according to the present invention taken out on the line of its rotary shaft. In the drawing, in order to distinguish the rotatable portion in association with the rotary shaft 195, from the non-rotatable portion, the former is shown in shadow with slant line, while the latter is left blank. However, reference should be made excluding the rotary shaft and sliding shaft. Also, it should be noted that in the drawing only a half of the symmetrical portion of the packing drum device is shown in section.

As is apparent from the foregoing, it is possible in the arbor guiding apparatus according to the present invention that a first arbor row should shift to the second arbor row while arbors are rotating on the packing drum. Thus, a bag making process is divided into consecutive steps in which two arbor rows are arranged.

What is claimed is:

1. An arbor apparatus for forming packing containers comprising double bags of first and second packing sheet materials, said apparatus comprising:

a rotary packing drum;

means for forming first bags with said first sheet material, said first bag forming means including a first row of circumferentially spaced arbors connected to said drum;

means for forming second bags on said first bags with said second sheet material, said second bag forming means including a second row of circumferentially spaced arbors connected to said drum and axially spaced from said first row of arbors, said arbors of said rotary rows being arranged in tandem;

means connected to said drum and to said arbors for guiding said arbors in radial movement with respect to said drum; and, means connected to said drum and to said arbors for effecting relative axial movement of tandem arbors with respect to said drum rotation of said drum.

2. An arbor apparatus according to claim 1, wherein: said radial movement guiding means includes first slide members integrally connected to said arbors, connecting rods each having a yoke-shaped driving member located at one end thereof, said yoke-shaped driving members being connected to said first slide members, said connecting rods each having three shafts projecting three ways on the other end thereof; and, second slide members at the middle portions of said connecting rods, said second slide members containing bearing means therein for slidably carrying said connecting rods with respect to the radial direction of said drum.

3. An arbor apparatus according to claim 2, wherein said radial movement guiding means further includes for each connecting rod:

a first cam follower on one of said three-way projecting shafts;

a second cam follower on a second of said three-way projecting shafts, said second shaft projecting in a direction opposite to said first shaft;

a first cam means adjacent said first row and adapted to engage said first cam follower for radially guiding an arbor when in said first row; and, a second cam means adjacent said second row and adapted to engage said second cam follower for radially guiding said arbor when in said second row.

4. An arbor apparatus according to claim 1, wherein: said means for effecting relative axial movement includes a pair of racks extending in the axial direction of said drum, slide members connected to said arbors and mounted on said racks, a pinion interposed between said racks, and a guide block fixedly mounted on said drum, said pinion being mounted on said guide block at the top thereof.

5. An arbor apparatus according to claim 4, wherein said guide block has two side faces with two cam grooves on one side face thereof and two cam grooves on the other side face thereof, each cam groove on one side face corresponding to one of the cam grooves on the other side face, said corresponding cam grooves being arranged parallel with respect to each other.

6. An arbor apparatus according to claim 1, wherein: said radial movement guiding means includes first slide members integrally connected to said arbors, connecting rods each having a yoke-shaped driving member located at one end thereof, said yoke-shaped driving members being connected to said first slide members, said connecting rods each having three shafts projecting three ways on the other end thereof, and second slide members at the middle portions of said connecting rods, said second slide members containing bearing means therein for slidably carrying said connecting rods with respect to the radial direction of said drum; and, said means for effecting relative axial movement includes a pair of racks extending in the axial direction of said drum, said second slide members being mounted on said racks, a pinion interposed between said racks, and a guide block fixedly mounted on said drum, said pinion being mounted on said guide block at the top thereof.

7. An arbor apparatus according to claim 6 wherein said radial movement guiding means further includes for each connecting rod:

a first cam follower on one of said three-way projecting shafts;

a second cam follower on a second of said three-way projecting shafts, said first and second shafts projecting in opposite axial directions with respect to said drum;

a first cam means adjacent said first row and adapted to engage said first cam follower for radially guiding an arbor when in said first row; and, a second cam means adjacent said second row and adapted to engage said second cam follower for radially guiding said arbor when in said second row.

8. An arbor apparatus according to claim 7, wherein:

said guide block has two side faces with two cam grooves on one side face thereof and two cam grooves on the other side face thereof, each cam groove on one side face corresponding to one of the cam grooves on the other side face, said corresponding cam grooves being arranged parallel with respect to each other, said cam grooves projecting axially with respect to said drum; and, said means for effecting relative axial movement includes for each connecting rod a third cam follower on the third of said three-way projecting shafts, said third shaft projecting transversely with respect to the axis of said drum, said third cam follower and one of said cam grooves of said guide block being adapted to interengage during axial movement of an arbor with respect to said drum.

9. An arbor apparatus according to claim 6, wherein said guide block has two side faces with two cam grooves on one side face thereof and two cam grooves on the other side face thereof, each cam groove on one side face corresponding to one of the cam grooves on the other side face, said corresponding cam grooves being arranged parallel with respect to each other.

10. An arbor apparatus for forming packing containers comprising double bags of first and second packing sheet materials, said apparatus comprising:

a rotary packing drum;

means for forming first bags with said first sheet material, said first bag forming means including a first row of circumferentially spaced arbors connected to said drum;

means for forming second bags on said first bags with said second sheet material, said second bag forming means including a second row of circumferentially spaced arbors connected to said drum and axially spaced from said first row of arbors, said arbors of said rotary rows being arranged in tandem;

means connected to said drum and to said arbors for guiding said arbors in radial movement with respect to said drum; and, means connected to said drum and to said arbors for shifting tandem arbors between said first and second rows of arbors through relative axial movement of tandem arbors with respect to said drum during rotation of said drum.

* * * * *